US011172753B2

(12) United States Patent
Picking

(10) Patent No.: US 11,172,753 B2
(45) **Date of Patent: *Nov. 16, 2021**

(54) PACK ASSEMBLY FOR A MOBILE DEVICE

(71) Applicant: UVu, LLC, Phoenix, AZ (US)

(72) Inventor: Karl D. Picking, Gardnerville, NV (US)

(73) Assignee: UVU, LLC, Phoenix, AZ (US)

( * ) Notice: Subject to any disclaimer, the term of this patent is extended or adjusted under 35 U.S.C. 154(b) by 8 days.

This patent is subject to a terminal disclaimer.

(21) Appl. No.: 16/254,405

(22) Filed: Jan. 22, 2019

(65) Prior Publication Data

US 2019/0159579 A1 May 30, 2019

Related U.S. Application Data

(63) Continuation-in-part of application No. 15/926,595, filed on Mar. 20, 2018, now Pat. No. 10,182,639, (Continued)

(51) Int. Cl.
*A45F 3/14* (2006.01)
*A45F 3/04* (2006.01)
(Continued)

(52) U.S. Cl.
CPC ..... *A45F 3/14* (2013.01); *A45F 3/047* (2013.01); *A45F 5/021* (2013.01);
(Continued)

(58) Field of Classification Search
None
See application file for complete search history.

(56) References Cited

U.S. PATENT DOCUMENTS 4,320,863 A * 3/1982 Lyer ..... A45F 5/00 224/259
4,461,411 A * 7/1984 Harrow ..... F16M 11/041 224/617
(Continued)

FOREIGN PATENT DOCUMENTS

CN 201345961 1/2019
WO WO-2012151200 A1 * 11/2012 ..... A45F 3/14

OTHER PUBLICATIONS

International Preliminary Report issued in International Application No. PCT/US2019/023223, dated Oct. 1, 2020, 10 pages.
(Continued)

*Primary Examiner* — Fayyaz Alam
(74) *Attorney, Agent, or Firm* — Messner Reeves LLP

(57) ABSTRACT

A wearable pack assembly for a mobile device having a touchscreen and a camera. The wearable pack assembly includes a harness and a pack. The harness includes a base and a strap assembly configured to be worn by a wearer. The pack is removably coupled to the base and includes an extension panel and an envelope platform. The envelope platform includes an envelope with an inlet configured to receive the mobile device, and cover having apertures that form windows on the outward and inward facing sides of the envelope to enable viewing and touching of the touchscreen and taking of pictures and video with the camera from the windowed pocket through the window. The envelope platform and the extension panel can be rotatably coupled at opposing edged to provide an extended position in which the touchscreen can be positioned at the wearer's eye level.

17 Claims, 38 Drawing Sheets

Related U.S. Application Data which is a continuation-in-part of application No. 15/256,536, filed on Sep. 3, 2016, now Pat. No. 9,923,590.

(60) Provisional application No. 62/214,132, filed on Sep. 3, 2015.

(51) Int. Cl.
*A45F 5/02* (2006.01)
*A45F 3/00* (2006.01)

(52) U.S. Cl.
CPC ... *A45F 2003/003* (2013.01); *A45F 2003/006* (2013.01); *A45F 2003/045* (2013.01); *A45F 2003/146* (2013.01); *A45F 2200/0516* (2013.01); *A45F 2200/0525* (2013.01)

(56) References Cited

U.S. PATENT DOCUMENTS 5,323,942 A * 6/1994 Dahan ..... A45F 5/14 224/639
8,418,264 B2 4/2013 Alexander
8,960,511 B2 * 2/2015 Shepherd ..... A45C 3/00 224/259
8,984,666 B1 3/2015 LoBue
9,244,337 B2 * 1/2016 Weihe ..... G03B 17/561
2006/0175370 A1 * 8/2006 Arney ..... A45F 5/021 224/666
2010/0116860 A1 * 5/2010 Tello ..... G06F 1/163 224/576
2012/0144557 A1 6/2012 Walker
2012/0185999 A1 7/2012 Raviv
2012/0186000 A1 7/2012 Raviv
2012/0267409 A1 * 10/2012 Chavis ..... A45F 5/00 224/579
2012/0280009 A1 * 11/2012 Carroll ..... A45F 3/14 224/257
2013/0004153 A1 * 1/2013 McKee ..... F16M 11/14 396/420
2013/0256346 A1 * 10/2013 Rohrbach ..... A45C 11/00 224/222
2013/0342969 A1 * 12/2013 Krupich ..... H04B 1/3888 361/679.01
2014/0082814 A1 3/2014 Rober et al.
2015/0060506 A1 * 3/2015 Cameron ..... A45C 11/00 224/267
2015/0074866 A1 3/2015 Diakite
2015/0150359 A1 * 6/2015 Lowry ..... A45F 5/00 224/222
2015/0208789 A1 * 7/2015 Pylkovas ..... A45C 3/02 224/607
2017/0055683 A1 * 3/2017 Willows ..... A45F 3/14
2017/0142299 A1 * 5/2017 Brown ..... G06F 1/163

OTHER PUBLICATIONS

International search report and written opinion for the PCT application PCT/US19/23223, dated Jul. 25, 2019, 12 pages.

* cited by examiner

PACK ASSEMBLY FOR A MOBILE DEVICE

CROSS-REFERENCE TO RELATED APPLICATIONS

This application is a continuation-in-part of U.S. patent application Ser. No. 15/926,595, filed Mar. 20, 2018, which is a continuation-in-part of U.S. patent application Ser. No. 15/256,536, filed Sep. 3, 2016, now U.S. Pat. No. 9,923,590, which claims the benefit of U.S. Provisional Patent Application No. 62/214,132, filed Sep. 3, 2015, the entire contents of which applications are incorporated herein by reference.

FIELD OF THE INVENTION

The present invention relates to mobile devices and, more particularly, to a wearable pack assembly useful for holding a mobile device having a camera for employing the camera of the mobile device as a body camera for recording the wearer's interactions with the environment and others.

BACKGROUND OF THE INVENTION

A body camera is a body-worn camera useful for recording the wearer's interactions with the environment and others. There are a variety of exemplary body cameras known in the art, the popularity of which has risen in recent years amongst outdoor enthusiasts and law enforcement personnel who use the technology to record their outdoor and law enforcement activities. Although body cameras are useful and popular, they are expensive, bulky, cumbersome when worn, and single-purpose, having no other use other than recording video.

The technology of mobile devices has advanced significantly in recent years. Of particular significance are the improvements in mobile device cameras, which are capable of taking high-definition and high-quality pictures and video. In view of the inherent expensive and single-purpose characteristics of dedicated body cameras, and the inherent multi-purpose functionality of mobile devices, users have begun to use their mobile devices to take pictures and videos of their activities. Typically, the user will hold and operate the mobile device by hand for taking pictures and video during a given activity. However, operating the mobile device by hand while performing an activity is inherently distracting and routinely results in accidents resulting in bodily injury and, in some cases, even death. Mobile devices are often dropped and damaged as well. Given these and other deficiencies in the art, there is a need for a wearable useful with a mobile device for enabling a user to take pictures and video with the mobile device without the need to hold the mobile device by hand and which also protects the mobile device from becoming dropped and damaged from exposure to external influences.

SUMMARY OF THE INVENTION

According to some embodiments, a wearable pack assembly for a mobile device having a touchscreen and a camera includes a harness, and a pack. The harness including a base and the pack is removably coupled to the base. The pack includes a windowed pocket having an inlet configured to receive the mobile device and to enable viewing and touching of the touchscreen and taking of pictures and video with the camera from the windowed pocket. The pack also includes door movable between an open position away from the windowed pocket and a closed position at least partially covering the windowed pocket. The door is configured to enable the camera to take pictures and video through the windowed pocket when the door is in the closed position. The harness positions the pack ahead of a chest of an upper torso of a wearer, with the windowed pocket facing outwardly relative to the chest of the upper torso of the wearer, when the harness is worn on the upper torso of the wearer.

The pack further includes an engagement assembly removably coupling the pack to the base. The pack also includes a spacer carried by the base. The spacer is configured to interact between the base and the chest of the upper torso of the wearer for concurrently tipping the base and the pack upwardly or downwardly relative to the chest of the upper torso of the wearer when the harness is worn by the upper torso of the wearer. The wearable pack assembly also includes a latch assembly configured to secure the door to the pack when the door is in the closed position. The latch assembly includes a hook and loop fastener having an element thereof carried by the door and a complemental element thereof carried by the pack. Additionally, the harness includes a strap assembly coupled to the base. The strap assembly includes a waist strap configured to extend around a waist of the wearer, shoulder straps configured to extend over shoulders of the wearer toward the back of the wearer, and a ring configured to interconnect the shoulder straps and the waist strap.

According to some embodiments, a wearable pack assembly for a mobile device having a touchscreen and a camera includes a harness, and a pack. The harness includes a base and a strap assembly configured to be worn by a wearer. The pack is removably coupled to the base and includes a windowed pocket and a door. The windowed pocket includes an inlet configured to receive the mobile device and a window configured to enable viewing and touching of the touchscreen and taking of pictures and video with the camera from the windowed pocket through the window. The door is movable between an open position away from the windowed pocket and a closed position partially covering the windowed pocket and leaving a portion of the window uncovered.

The pack further includes a fastening element configured to close the inlet of the windowed pocket. Also, the pack is removably coupled to the base by one of hook and loop fasteners and buckles. The pack further includes a flap configured to secure the door in the closed position. The door is positioned off-center between a first side edge and a second side edge of the pack, and the windowed pocket is positioned equidistant between the first side edge and the second side edge. The assembly further includes a wedge-shaped spacer having an angled side configured to be coupled to an outer side of the base so as to tip the pack upward or downward when the pack is coupled to an inner side of the base.

In some embodiments, the harness is configured to be worn on an upper torso of the wearer. The strap assembly includes a left shoulder strap configured to extend over the wearer's left shoulder, a right shoulder strap configured to extend over the wearer's right shoulder, a waist strap configured to extend around the wearer's waist, and a back strap configured to be positioned along the wearer's back when the harness is worn by the wearer. The pack assembly further includes a tie-down ring configured to connect the right shoulder strap, the left shoulder strap, and the back strap, and the back strap is further coupled to the waist strap. The strap assembly also includes at least one buckle configured to be de-united and united to enable the wearer to put on the harness.

In some embodiments, the harness is configured to be worn on a leg of the wearer. The strap assembly includes a first upper strap configured to extend from a first side of the base, a second upper strap configured to extend from a second side of the base, and a leg strap configured to extend around the wearer's leg when the harness is worn by the wearer. The first upper strap is configured to be coupled to a first ring releasably coupled to a first hook member, the second upper strap is configured to be coupled to a second ring releasably coupled to a second hook member, and the first hook member and the second hook member are configured to engage a belt of the wearer when the harness is worn by the wearer. The strap assembly includes at least one buckle configured to be de-united and united to enable the wearer to put on the harness.

Consistent with the foregoing summary of illustrative embodiments, and the ensuing detailed description, which are to be taken together, the invention also contemplates associated apparatus and method embodiments.

DETAILED DESCRIPTION

Figure 1:
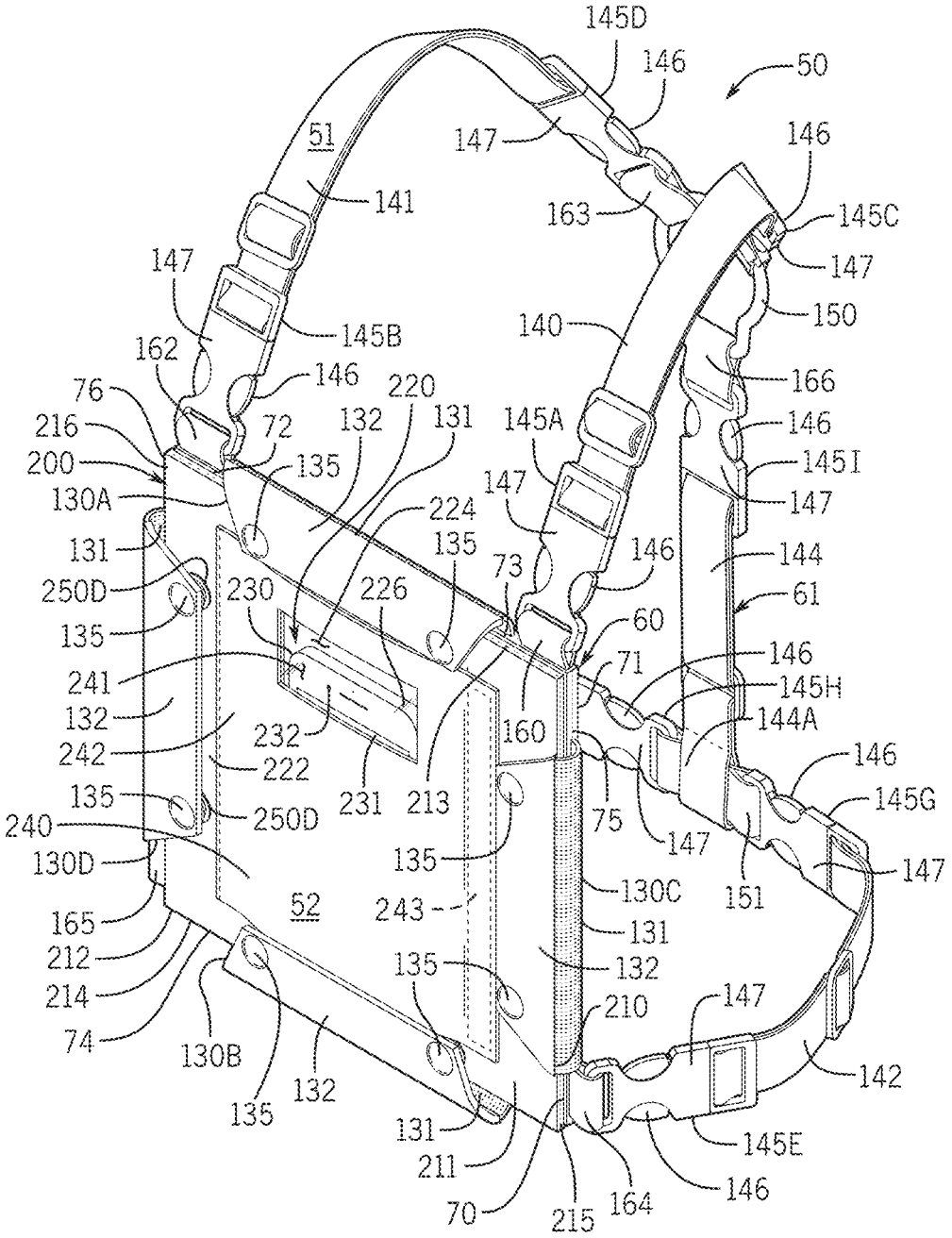
FIG. 1 is a front perspective view of an example embodiment of a wearable pack assembly for a mobile device.

Turning now to the drawings, in which like reference characters indicate corresponding elements throughout the several views, attention is first directed to FIG. 1 in which there is seen a wearable pack assembly 50 for a mobile device. The term "mobile device" means a small computing device, typically small enough to be handheld, having a touchscreen, a display screen with touch input, and a camera. Such exemplary and ubiquitous known mobile devices include smartphones or mobile phones with an advanced mobile operating system that combines features of a personal computer operating system with other features useful for mobile or handheld use. Such mobile devices are usually pocket-sized, include features of a cell phone, such as the ability to receive and make phone calls and text messages, are enabled to access the Internet, and, again, include a graphical user interface in the nature of a touchscreen, and a camera for taking videos and still pictures.

Pack assembly 50 includes a harness 51, and a pack 52. Harness 51 is wearable, and pack 52 is configured to be carried by harness 51, and is shown as it would appear being carried by harness 51 in FIGS. 1 and 2. Pack 52 includes a windowed pocket 220 for receiving a mobile device through an opening to windowed pocket 220 so as to juxtapose a touchscreen and a camera of the mobile device with the windowed pocket to enable the viewing and the touching of the touchscreen and the taking of pictures and video with the camera in the operation of the mobile device from windowed pocket 220. Harness 51 is configured to hold pack 52 ahead of a chest of an upper torso of a wearer with windowed pocket 220 facing outwardly relative to the chest of the upper torso of the wearer when harness 51 is worn by the upper torso of the wearer and when pack 52 is carried by harness 51 for enabling the wearer to usefully employ the camera of the mobile device as a body camera for recording a wearer's interactions with the environment when the mobile device is carried operatively by the pack 52.

Figure 2:
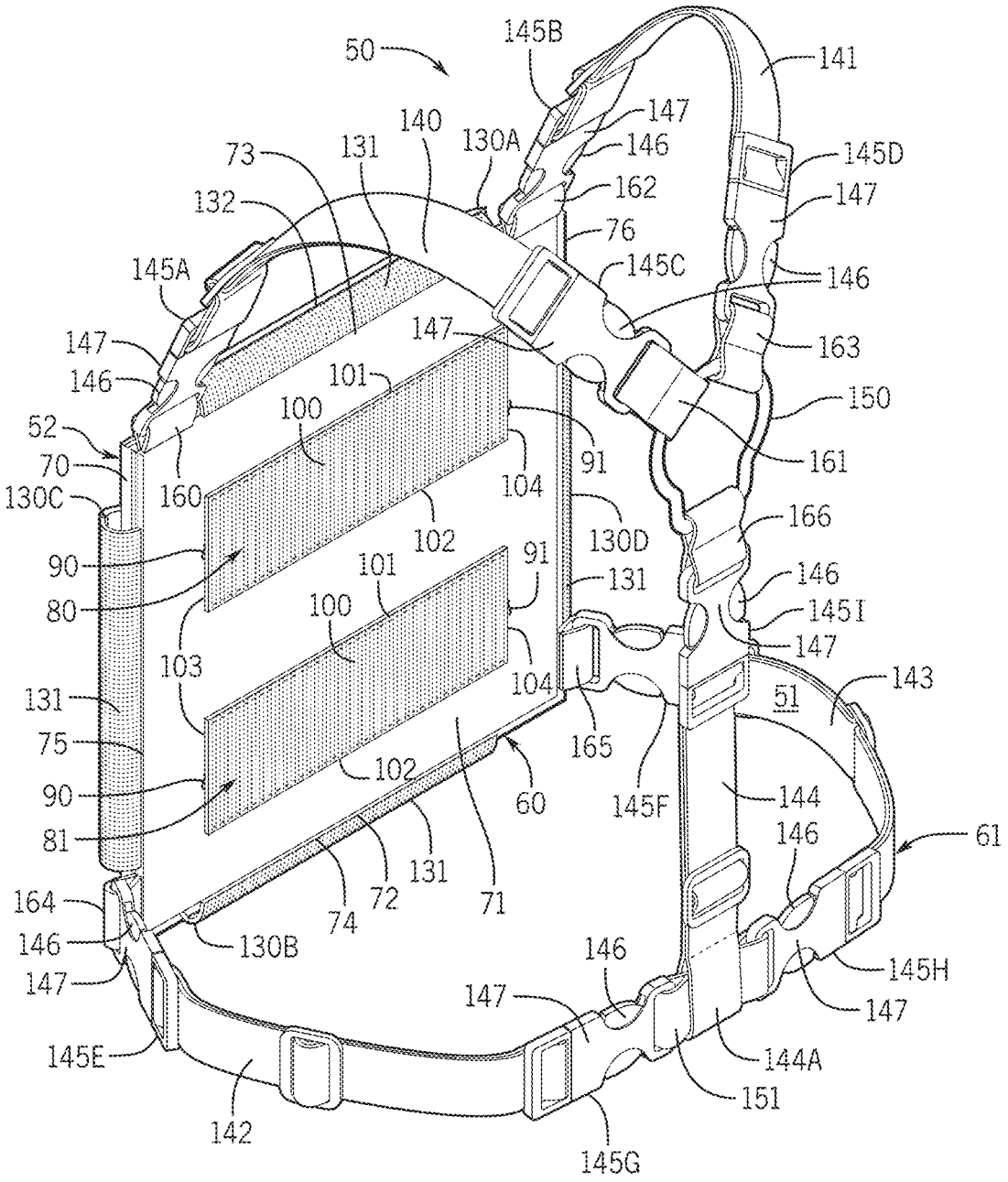
FIG. 2 is rear perspective view of the pack assembly of FIG. 1.
Figure 12:
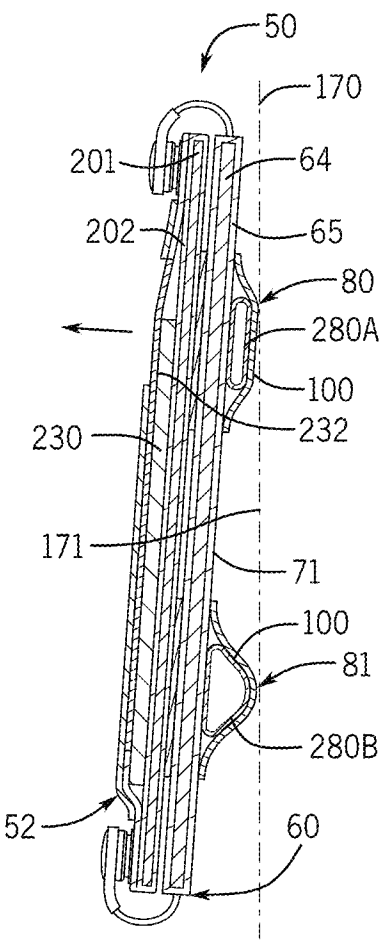
FIGS. 10-12 are section views taken along line 10-10 of FIG. 9, showing various configurations for inflating inflatable bladders of the pack assembly of FIG. 9.
Figure 11:
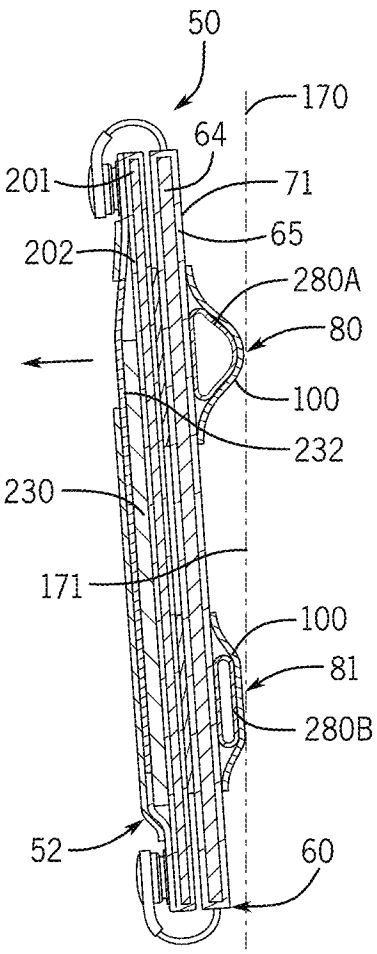
Figure 10:
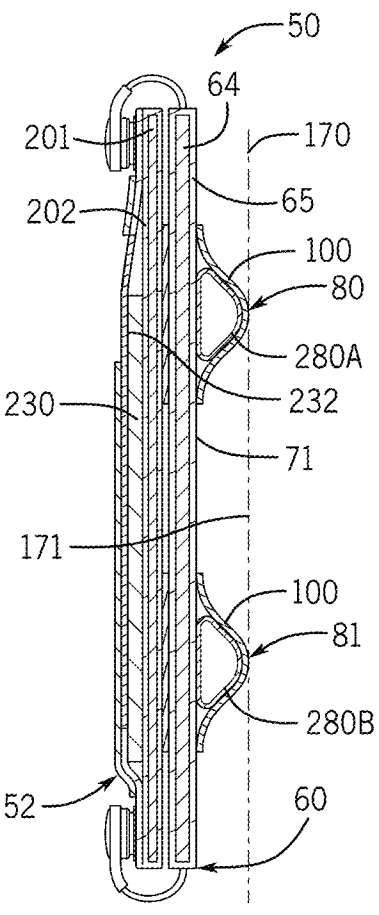

Referring to FIGS. 1 and 2, harness 51 includes base 60, and strap assembly or system 61. Base 60 is flat and generally square in overall shape. Base 60 is a panel assembly including, as shown in FIGS. 10-12, panel 64 covered with outer layering 65 consisting of one or more layers of material. Panel 64 is fashioned of plastic, wood, metal, or other material or combination of materials having an inherently stiff material characteristic, being inherently rigid or firm and resistant to bending. Outer layering 65 is fashioned of leather, tightly woven nylon, canvas, or other material or combination of materials having the inherent properties of flexibility, resilience, tear-resistance, and ruggedness. Panel 64 is upholstered with outer layering 65, which encloses panel 64 and defines the major sides and peripheral edge of base 60 as described below.

Figure 3:
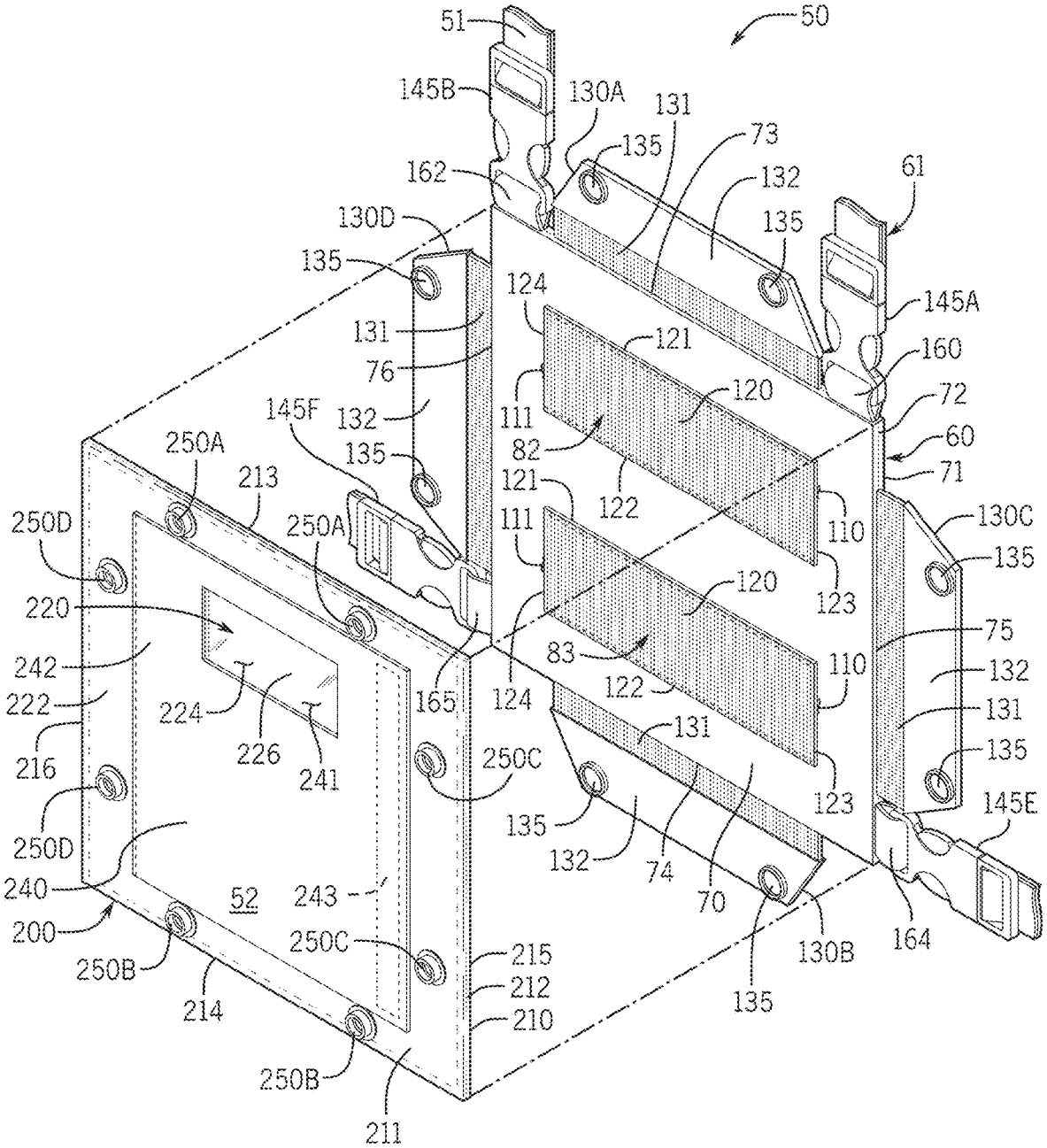
FIG. 3 is an enlarged front perspective view of the pack assembly of FIG. 1, showing the pack detached from the base of the harness.

Referring in relevant part to FIGS. 1-3, base 60 includes inner side 70 and opposed outer side 71, and peripheral edge 72. Peripheral edge 72 is defined by first end edge 73 and opposed second end edge 74, and first side edge 75 and opposed second side edge 76 that extend from the first end edge 73 to second end edge 74. First and second end edges 73 and 74 are parallel with respect to each other, and first and second side edges 75 and 76 are parallel with respect to each other and are orthogonal with respect to first and second end edges 73 and 74. Base 60 has a length from first end edge 73 to second end edge 74 and a width from first side edge 75 to second side edge 76, and the length of base 60 and the width of base 60 are substantially the same characterizing the generally square shape of base 60. However, in some embodiments, the base 60 may instead be rectangular in shape (e.g., where the length of the base 60 and the width of the base 60 are different).

FIG. 2 illustrates upper and lower outer sleeves 80 and 81 formed on outer side 71 of base 60, and FIG. 3 illustrates upper and lower inner sleeves 82 and 83 formed on inner side 70 of base 60. Upper and lower outer sleeves 80 and 81 are parallel relative to each other, are parallel relative to first and second end edges 73 and 74, are orthogonal relative to first and second side edges 75 and 76, and are each open toward first and second side edges 75 and 76 to enable the application and withdrawal of, for example, a spacer (as described below). Upper outer sleeve 80 is adjacent to first end edge 73, and lower outer sleeve 81 is adjacent to second end edge 74. Upper and lower inner sleeves 82 and 83 are parallel relative to each other, are parallel relative to first and second end edges 73 and 74, are orthogonal relative to first and second side edges 75 and 76, and are each open toward first and second side edges 75 and 76 to enable the application and withdrawal of, for example, a spacer (as described below). Upper inner sleeve 82 is adjacent to first end edge 73, and lower inner sleeve 83 is adjacent to second end edge 74. Upper outer and inner sleeves 80 and 82 are diametrically opposed and parallel relative to each other, and lower outer and inner sleeves 81 and 83 are diametrically opposed and parallel relative to each other. Sleeves 80-83 are identical in structure, in size, and in shape.

Upper outer sleeve 80 is elongate, extends from first open end 90 near first side edge 75 to second open end 91 near second side edge 76. Upper outer sleeve 80 includes strap 100. Strap 100 is elongate and elastic being formed of elasticized material that can stretch and that can return to its original length, shape, etc., after being stretched. Strap 100 is applied across outer side 71, being parallel relative to first and second end edges 73 and 74 and orthogonal relative to first and second side edges 75 and 76, and includes opposed, parallel upper and lower major edges 101 and 102 affixed to outer side 71, such as with stitching, adhesive, heat bonding, or the like, and opposed parallel first and second minor edges 103 and 104 that extend from upper major edge 101 to lower major edge 102. Upper outer sleeve 80 is defined by strap 100 and the portion of outer side 71 opposing strap 100. First and second minor edges 103 and 104 are not affixed or otherwise adhered to outer side 71, thereby forming first and second open ends 90 and 91, respectively. Lower outer sleeve 81 is identical in every respect to upper outer sleeve 80. Accordingly, the foregoing discussion of upper outer sleeve 80 applies in every respect to lower outer sleeve 81.

Upper inner sleeve 82 is elongate, extends from first open end 110 near first side edge 75 to second open end 111 near second side edge 76. Upper inner sleeve 82 includes strap 120. Like each strap 100, strap 120 is elongate and elastic being formed of elasticized material. Strap 120 is applied across inner side 70, being parallel relative to first and second end edges 73 and 74 and orthogonal relative to first and second side edges 75 and 76, and include opposed, parallel upper and lower major edges 121 and 122 affixed to inner side 70, such as with stitching, adhesive, heat bonding, or the like, and opposed parallel first and second minor edges 123 and 124 that extend from upper major edge 121 to lower major edge 122. Upper inner sleeve 82 is defined by strap 120 and the portion of inner side 70 opposing strap 120. First and second minor edges 123 and 124 are not affixed or otherwise adhered to outer side 71, thereby forming first and second open ends 110 and 111, respectively. Lower inner sleeve 83 is identical in every respect to upper inner sleeve 82. Accordingly, the foregoing discussion of upper inner sleeve 82 applies in every respect to lower inner sleeve 83.

Pack assembly 50 includes an engagement assembly for removably coupling pack 52 to base 60. The engagement assembly includes flaps 130 carried by base 60, and fasteners 135, 250 for securing flaps 130 releasably to pack 52, as further described below. The fasteners 135, 250, which are releasable fasteners, are snap fasteners in a preferred embodiment, and can be button fasteners, hook-and-loop fasteners, or the like in alternate embodiments.

In FIG. 3, base 60 includes flaps 130 coupled to peripheral edge 72. Flaps 130 include flap 130A coupled to first end edge 73, flap 130B connected to second end edge 74, flap 130C coupled to first side edge 75, and flap 130D coupled to second side edge 76.

Flap 130A includes a proximal part 131, and a distal part 132. Proximal part 131 is coupled between first end edge 73 and distal part 132. Proximal part 131 is an elongate flap segment, is elastic being formed of elasticized material that can stretch and that can return to its original length, shape, etc., after being stretched, and is attached to first end edge 73 with stitching, adhesive, heat bonding, or the like, and extends outwardly from first end edge 73 to distal part 132 attached to proximal part 131 with stitching, adhesive, heat bonding, or the like. Distal part 132 is an elongate flap segment fashioned of leather, tightly woven nylon, canvas, or other material or combination of materials having the properties of flexibility, resilience, tear-resistance, and ruggedness, and extends outwardly from proximal part 131. Distal part 132 is formed with engagement or fastener elements 135 on either end thereof. Proximal part 131 elastically connects distal part 132 to peripheral edge 72, specifically first end edge 73. Flap 130A is centered between first and second side edges 75 and 76, and extends along a majority of the length of first end edge 73 from proximate to first side edge 75 to proximate to second side edge 76.

Flaps 130B-130D are identical to flap 130A in every respect, and the foregoing discussion of flap 130A applies to each of flaps 130B-130D. Briefly, flap 130B is centered between first and second side edges 75 and 76, extends along a majority of the length of second end edge 74 from proximate to first side edge 75 to proximate to second side edge 76, and includes proximal part 131 that extends outwardly from second end edge 74 to distal part 132 formed with engagement or fastener elements 135. Flap 130C is centered between first and second end edges 73 and 74, extends along a majority of the length of first side edge 75 from proximate to first end edge 73 to proximate to second end edge 74, and includes proximal part 131 that extends outwardly from first side edge 75 to distal part 132 formed with engagement or fastener elements 135. Flap 130D is centered between first and second end edges 73 and 74, extends along a majority of the length of second side edge 76 from proximate to first end edge 73 to proximate to second end edge 74, and includes proximal part 131 that extends outwardly from second side edge 76 to distal part 132 formed with engagement or fastener elements 135.

In FIGS. 1 and 2, strap system 61 is connected to base 60, is used to strap base 60 to the upper torso of the wearer, and includes left and right shoulder straps 140 and 141, left and right waist straps 142 and 143, and a back strap 144 interconnected with buckles 145 and looped connecting straps. Straps 140-144 are each fashioned of leather, tightly woven nylon, canvas, or other material or combination of materials having the properties of flexibility, resilience, tear-resistance, and ruggedness, and are conventionally length-adjustable straps. Each buckle 145 is a conventional slide release buckle including a male buckle member 146, the hook end, and a female buckle member 147, the catch end. In each buckle 145, male buckle member 146 includes a center guide rod forwardly extending from the front side with two spring arms equally spaced from the center rod. The two spring arms each have a retaining block that terminates at the front end. The female buckle member 147 has a front open side and two side holes which hold and secure the two spring arms of the male buckle member. This sort of buckle, which is commonly referred to as a parachute buckle, is found on backpacks, belts, rifle slings, boots, and a host of other common items. However, other buckles or fastening mechanisms may be used in other embodiments.

Left and right shoulder straps 140 and 141 are connected to first end edge 73 on either side of flap 130A with respective buckles 145A and 145B, and extend rearwardly therefrom to respective buckles 145C and 145D coupled to a tie-down ring 150. Left waist strap 142 is connected to first side edge 75 alongside flap 130C near second end edge 74 with buckle 145E, and right waist strap 143 is connected to second side edge 76 alongside flap 130D near second end edge 74 with buckle 145F. Left and right waist straps 142 and 143 extend rearwardly from base 60 to respective buckles 145G and 145H coupled to either end of a connecting strap 151. Back strap 144 interconnects tie-down ring 150 and connecting strap 151. In this embodiment, back strap 144 is connected to tie-down ring 150 with buckle 145I, and extends downwardly therefrom to looped end 144A through which connecting strap 151 extends.

In the present embodiment, connecting strap 160 attached to first end edge 73 along the left side of flap 130A proximate to first side edge 75 is coupled to female buckle member 147 of buckle 145A. Male buckle member 146 of buckle 145A is coupled releasably to female buckle member 147 of buckle 145A, and left shoulder strap 140 extends rearwardly from male buckle member 146 of buckle 145A to male buckle member 146 of buckle 145C. Female buckle member 147 of buckle 145C is coupled releasably to male buckle member 146 of buckle 145C, and connecting strap 161 couples female buckle member 147 of buckle 145C to tie-down ring 150.

Connecting strap 162 attached to first end edge 73 along the right side of flap 130A proximate to second side edge 76 is coupled to female buckle member 147 of buckle 145B. Male buckle member 146 of buckle 145B is coupled releasably to female buckle member 147 of buckle 145B, and right shoulder strap 141 extends rearwardly from male buckle member 146 of buckle 145B to male buckle member 146 of buckle 145D. Female buckle member 147 of buckle 145D is coupled releasably to male buckle member 146 of buckle 145D, and connecting strap 163 couples female buckle member 147 of buckle 145D to tie-down ring 150.

Connecting strap 164 attached to first side edge 75 along the lower side of flap 130C proximate to second end edge 74 is coupled to female buckle member 147 of buckle 145E. Male buckle member 146 of buckle 145E is coupled releasably to female buckle member 147 of buckle 145E, and left waist strap 142 extends rearwardly from male buckle member 146 of buckle 145E to male buckle member 146 of buckle 145G. Female buckle member 147 of buckle 145G is coupled releasably to male buckle member 146 of buckle 145G, and female buckle member 147 of buckle 145G is coupled to the left end of connecting strap 151.

Connecting strap 165 attached to second side edge 76 along the lower side of flap 130D proximate to second end edge 74 is coupled to female buckle member 147 of buckle 145F. Male buckle member 146 of buckle 145F is coupled releasably to female buckle member 147 of buckle 145F, and right waist strap 143 extends rearwardly from male buckle member 146 of buckle 145F to male buckle member 146 of buckle 145H. Female buckle member 147 of buckle 145H is coupled releasably to male buckle member 146 of buckle 145H, and female buckle member 147 of buckle 145H is coupled to the right end of connecting strap 151.

Connecting strap 166 couples tie-down ring 150 to female buckle member 147 of buckle 145I. Male buckle member 146 of buckle 145I is coupled releasably to female buckle member 147 of buckle 145I, back strap 144 extends downwardly from male buckle member 146 of buckle 145I to connecting strap end 144A of back strap 144, and connecting strap end 144A of back strap 144 is coupled to connecting strap 151 between its left and right ends.

Figure 6:
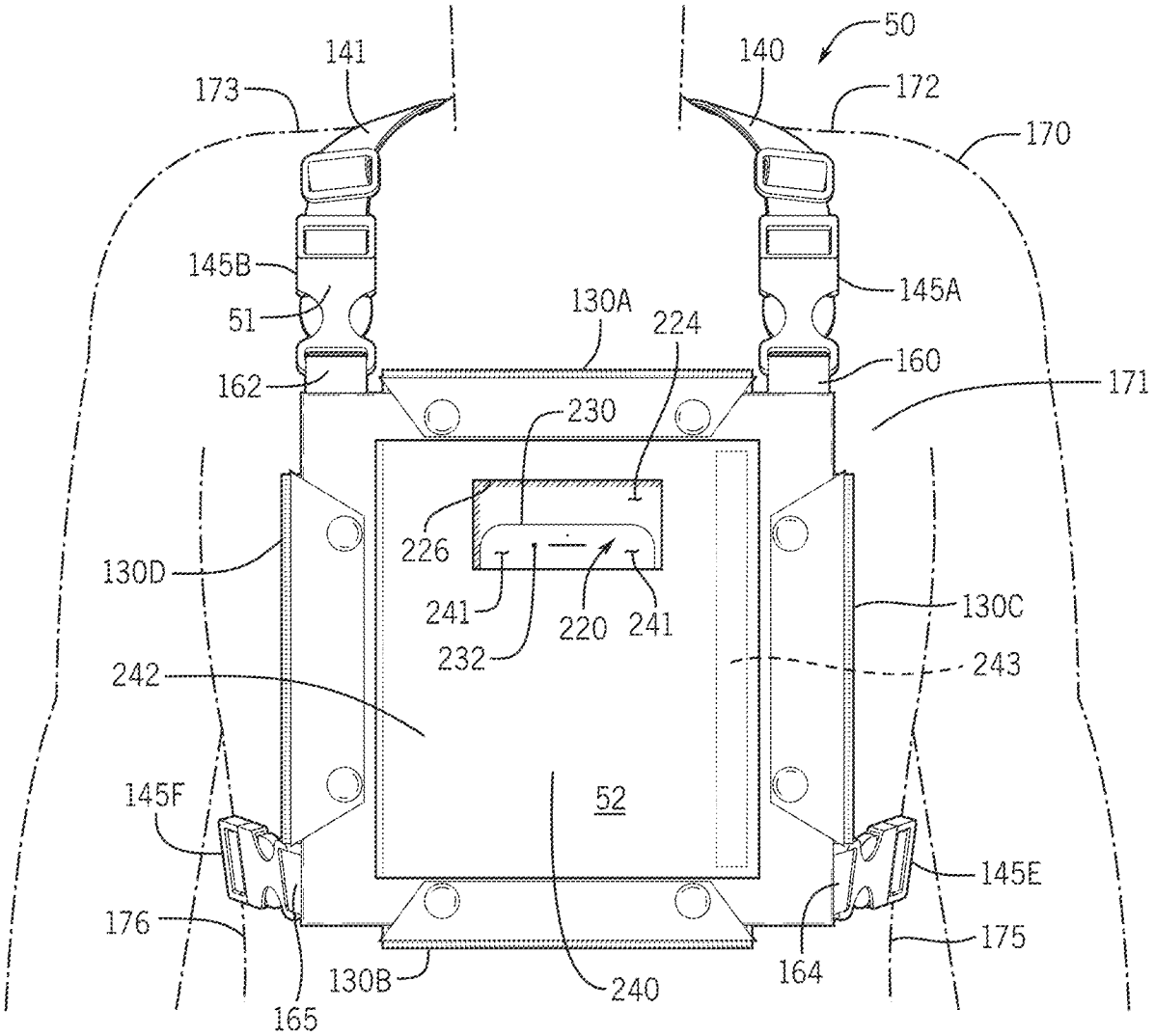
FIG. 6 is a front view of the pack assembly of FIG. 1 worn by a wearer.
Figure 7:
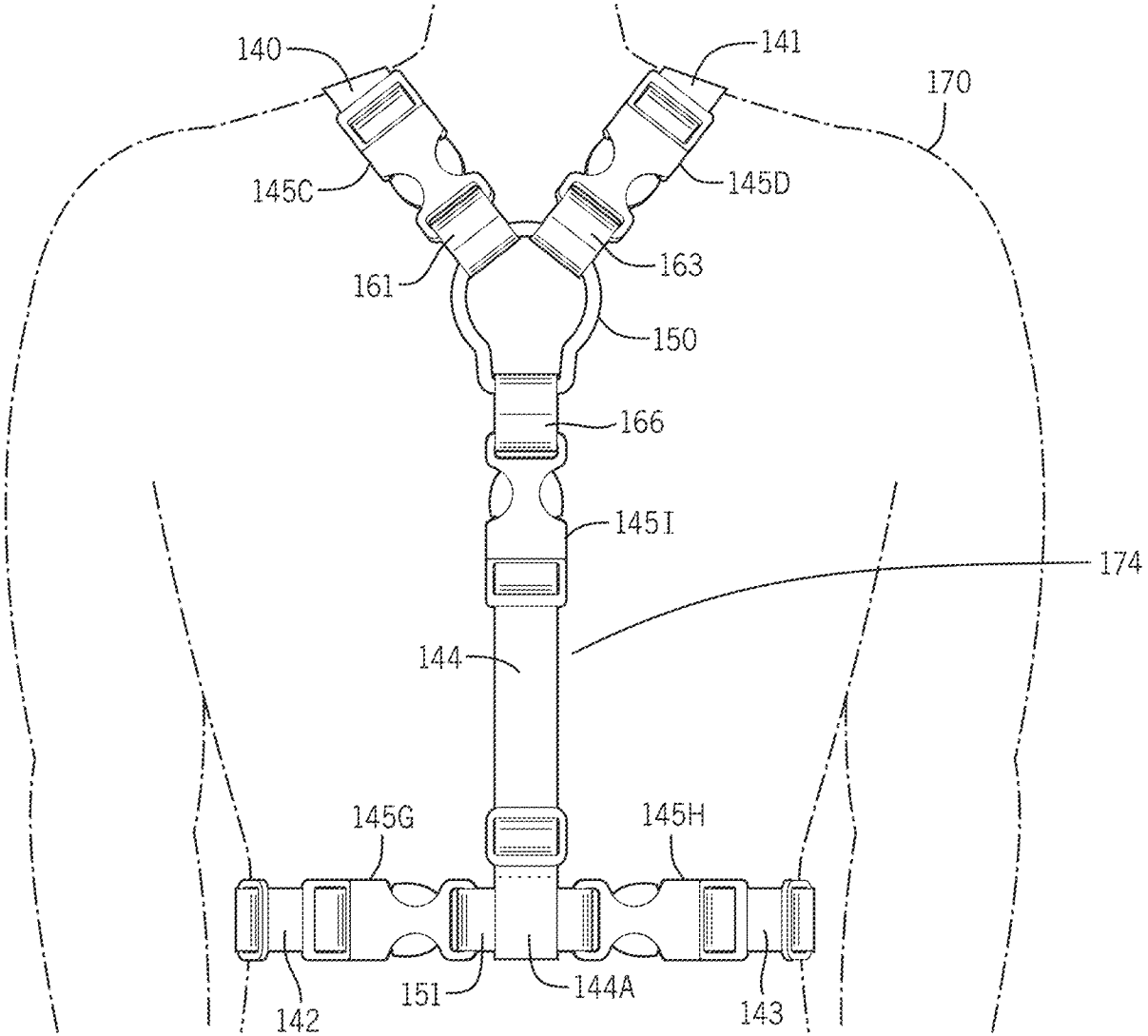
FIG. 7 is a rear view of the pack assembly of FIG. 1 worn by a wearer.

Referring in relevant part to FIGS. 6 and 7, outer side 71 of base 60 is positioned against chest 171 of the upper torso of human wearer 170, represented here as an adult human male as a matter of illustration and reference, left shoulder strap 140 extends over left shoulder 172 of wearer 170 from base 60 to tie-down ring 150 centered along the upper part of back 174 of wearer 170, right shoulder strap 141 extends over right shoulder 173 of wearer 170 from base 60 to tie-down ring 150 centered along the upper part of back 174 of wearer 170, left waist strap 142 extends over left waist 175 of wearer 170 from base 60 to connecting strap 151 centered along the lower part of back 174 of wearer 170, right waist strap 143 extends over right waist 176 of wearer 170 from base 60 to connecting strap 151 centered along the lower part of back 174 of wearer 170, and back strap 144 extends downwardly along the center of back 174 of wearer 170 from tie-down ring 150 to connecting strap 151, when harness 51 is worn by wearer 170. Male and female buckle members 146 and 147 of the respective buckles 145 can be selectively de-united and united to enable wearer 170 to put on harness 51. The lengths of straps 140-144 can be length-adjusted as needed in order to fit harness 51 snugly/closely to wearer 170, especially on the outside of the wearer's garment(s).

Referring now in relevant part to FIGS. 1 and 3, pack 52 includes base 200, which, like base 60, is flat and generally square in overall shape and coextensive with respect to base 60. Base 200 is a panel assembly including, as seen in FIGS. 10-12, panel 201 covered with outer layering 202 consisting of one or more layers of material. Panel 201 is fashioned of plastic, wood, metal, or other material or combination of materials having an inherently stiff material characteristic, being inherently rigid or firm and resistant to bending. Outer layering 202 is fashioned of leather, tightly woven nylon, canvas, or other material or combination of materials having the inherent properties of flexibility, resilience, tear-resistance, and ruggedness. Panel 201 is upholstered with outer layering 202, which encloses panel 201 and defines the major sides and peripheral edge of base 200 as described below.

Referring in relevant part to FIGS. 1 and 3, base 200 includes inner side 210 and opposed outer side 211, and peripheral edge 212 defined by first end edge 213 and opposed second end edge 214, and first side edge 215 and opposed second side edge 216 that extend from first end edge 213 to second end edge 214. First and second end edges 213 and 214 are parallel with respect to each other, and first and second side edges 215 and 216 are parallel with respect to each other and are orthogonal with respect to first and second end edges 213 and 214. Base 200 has a length from first end edge 213 to second end edge 214 and a width from first side edge 215 to second side edge 216, and the length of base 200 and the width of base 200 are substantially the same as the length of base 60 and the width of base 60, characterizing the generally square shape of base 200. However, as noted above, in some embodiments, the base 200 may instead be rectangular in shape (e.g., where the length of the base 200 and the width of the base 200 are different).

Figure 4:
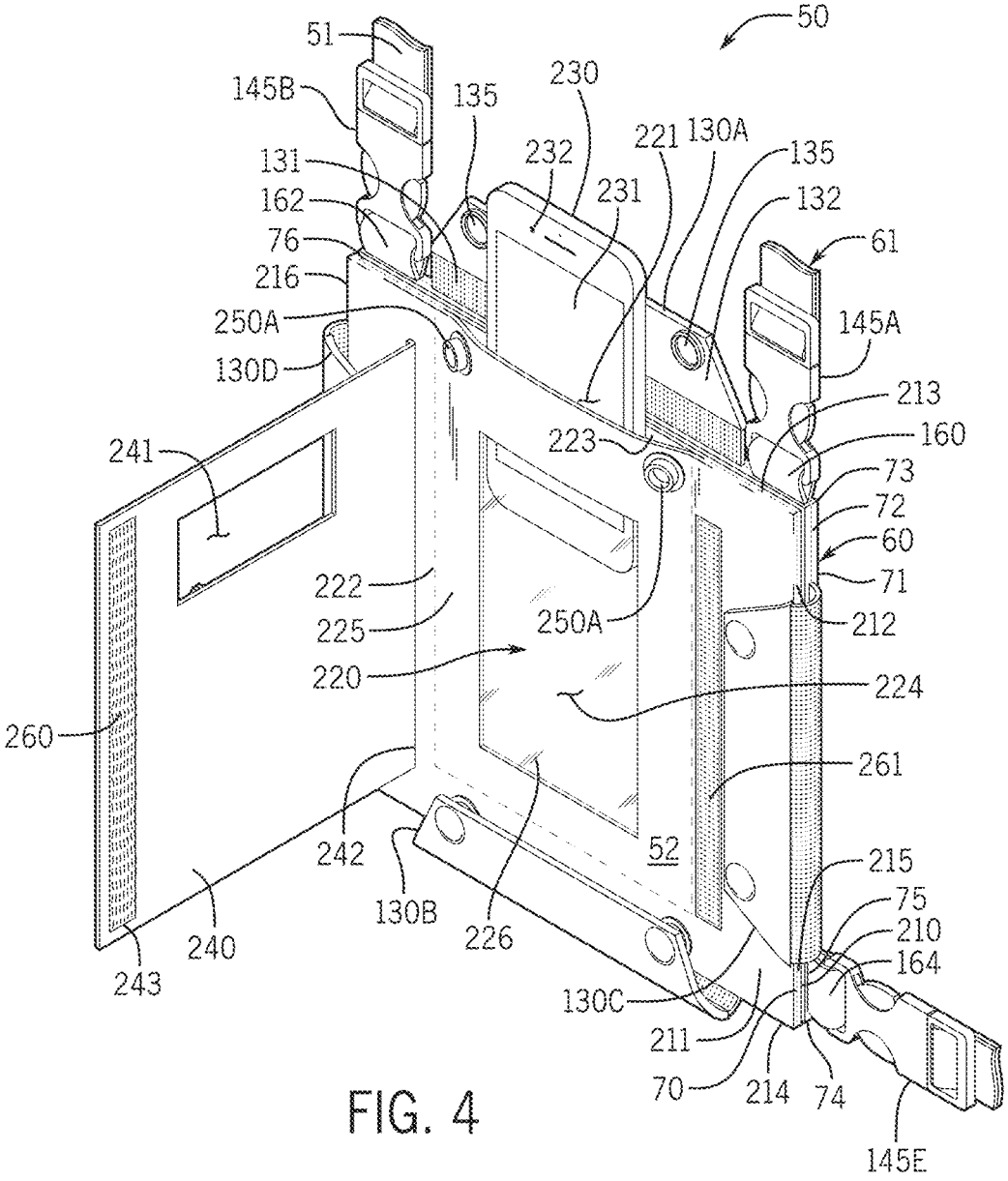
FIGS. 4 and 5 are front perspective views of the pack assembly of FIG. 1, showing insertion of a mobile device into a windowed pocket of the pack.
Figure 5:
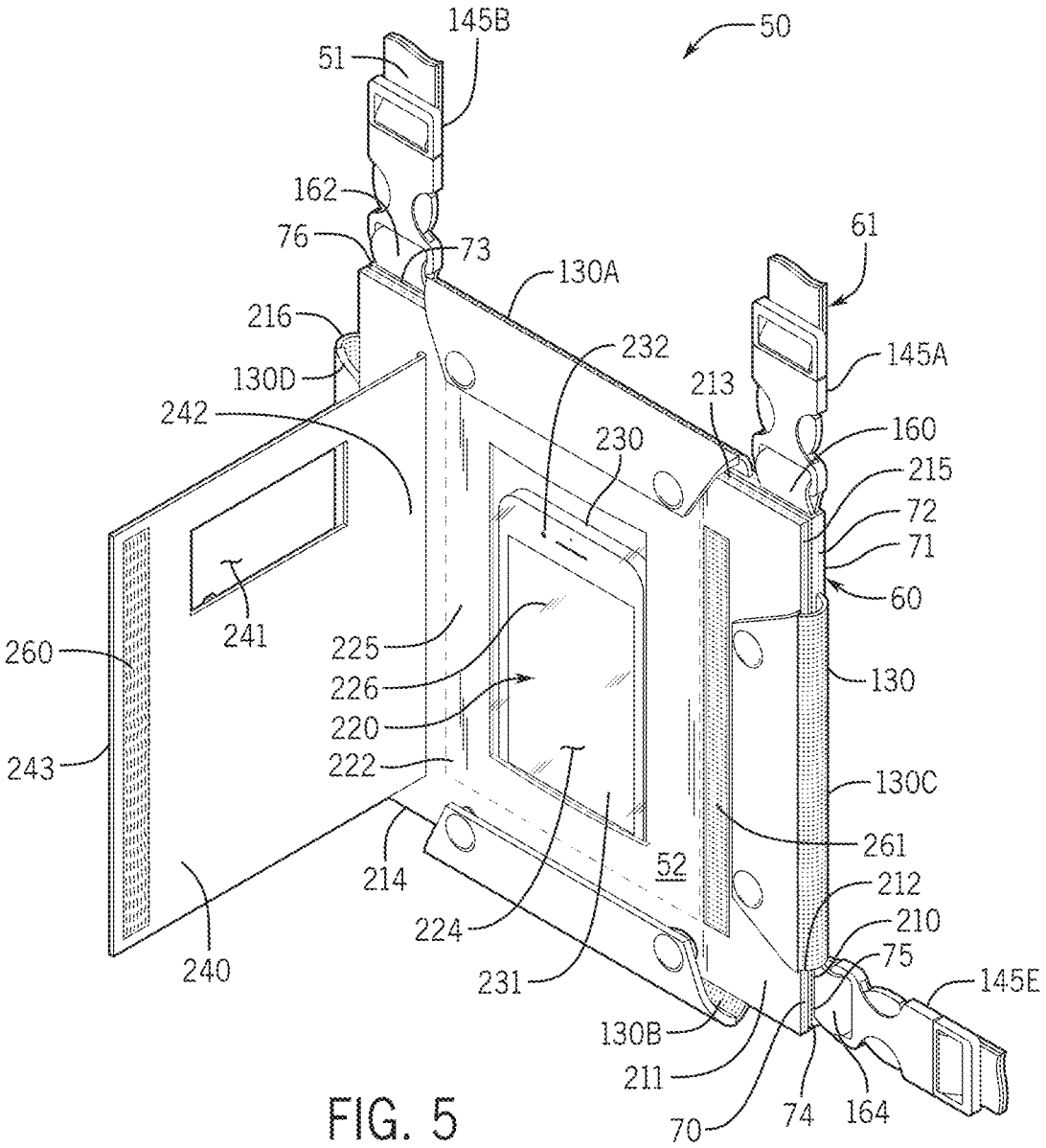

In FIGS. 4 and 5, pack 52 is formed with windowed pocket 220, and pocket inlet 221 to windowed pocket 220. Windowed pocket 220 is formed in outer side 211, and is for receiving mobile device 230, having touchscreen 231 and camera 232, through pocket inlet 221 to windowed pocket 220 so as to juxtapose touchscreen 231 and the camera 232 with windowed pocket 220 to enable the viewing and the touching of touchscreen 231 and the taking of pictures and video with camera 232 in the operation of the mobile device 230 from windowed pocket 220, when mobile device 230 is inserted into windowed pocket 220 (as shown in FIG. 5) through pocket inlet 221 (as shown in FIG. 4).

Windowed pocket 220 is formed in outer side 211 by a pair of outer and inner pocket panels of outer layering 202, including outer or first pocket panel 222 and inner or second pocket panel 223. First pocket panel 222 is superimposed atop, and is coextensive with respect to, second pocket panel 223. First and second pocket panels 222 and 223 are joined along their three edges at or adjacent to second end edge 214 and first and second side edges 215 and 216 of peripheral edge 212 of pack 52 and partially along their fourth edges at first end edge 213 of peripheral edge 212 of pack 52 so as to form pocket inlet 221 in or adjacent to first end edge 213. First and second pocket panels 222 and 223 are further joined along three sides to form the inside closed portion of windowed pocket 220 which extends into outer side 211 from pocket inlet 221 through first end edge 213 of peripheral edge 212. First and second pocket panels 222 and 223 are joined together with stitching, adhesive, heat bonding, or the like. Windowed pocket 220 is accessible through pocket inlet 221.

In FIG. 4, pocket inlet 221 to windowed pocket 220 is formed in first end edge 213 of peripheral edge 212. Pocket inlet 221 is centered or otherwise equidistant between first and second side edges 215 and 216. Windowed pocket 220 extends downwardly from pocket inlet 221 to proximate to second end edge 214, and is equidistant between first and second side edges 215 and 216. First pocket panel 222 of windowed pocket 220 includes window 224 framed by a peripheral edge border or frame 225 of outer side 211. Window 224 is fitted with a thin sheet 226 of transparent material. Sheet 226 is thin in that it has a thickness of approximately 0.2-0.3 millimeters, and is formed of transparent flexible plastic that is affixed to and held by border 225, such as by heat bonding, an adhesive, stitching, or the like.

Figure 8:
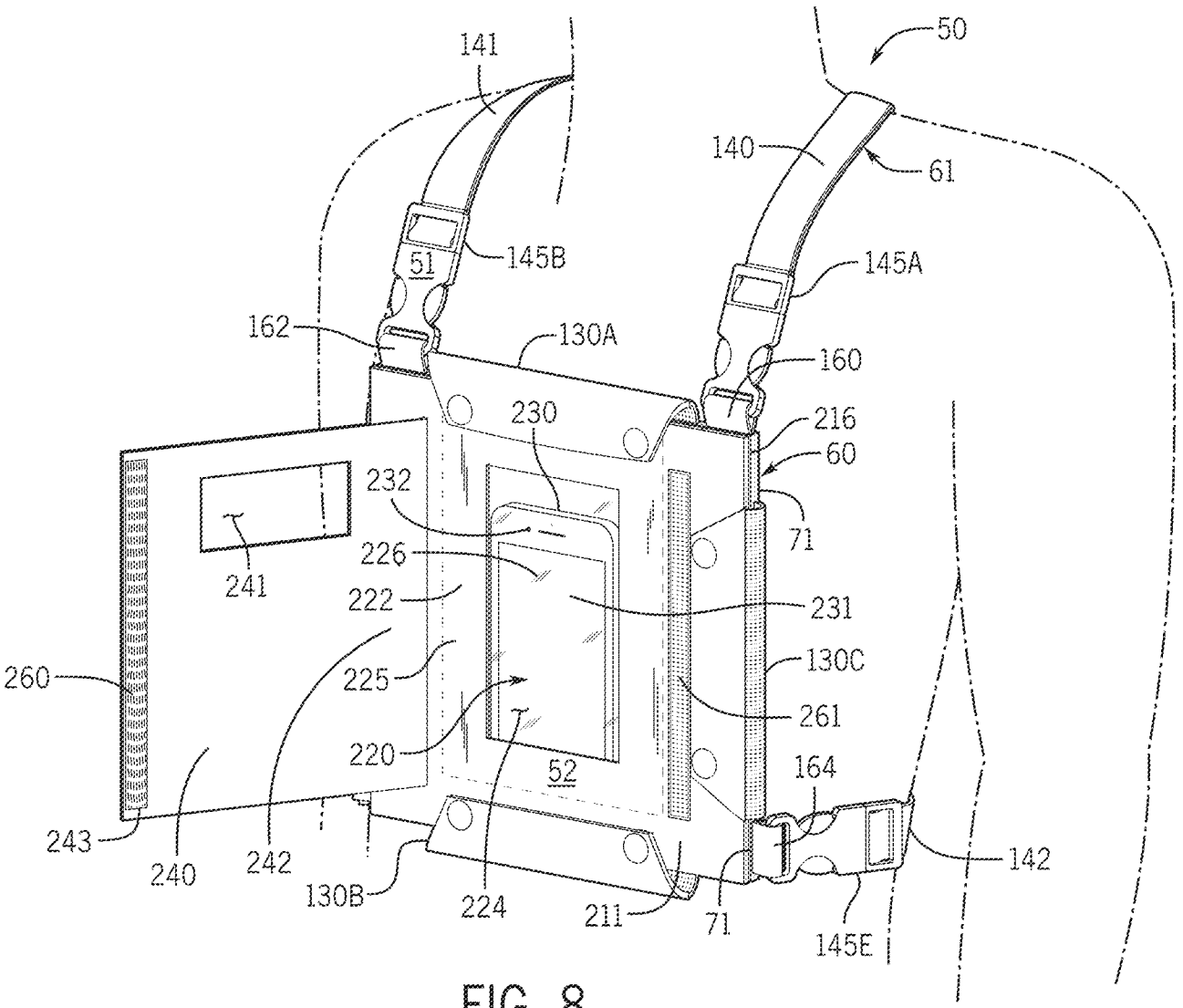
FIG. 8 is a front perspective view of the pack assembly of FIG. 1 worn by a wearer.

Base 200 further includes a door 240. Door 240, like outer layering 202, is fashioned of leather, tightly woven nylon, canvas, or other material or combination of materials having the inherent properties of flexibility, resilience, tear-resistance, and ruggedness. Door 240 is flat and generally square in shape, is formed with window 241, is centered inboard of peripheral edge 212 and includes proximal extremity 242 mounted to outer pocket panel 222 of outer side 211 between second side edge 216 and windowed pocket 220, and an opposed distal extremity 243. Proximal extremity 242 is mounted to first pocket panel 222 of outer side 211 with stitching, heat bonding, adhesive, or the like. The inherent material characteristics of door 240 enables door 240 to pivot at proximal extremity 242 between an open position away from windowed pocket 220 in FIGS. 4, 5, and 8, and a closed position over windowed pocket 220 in FIGS. 1, 2, and 6. Door 240 covers windowed pocket 220 and window 241 of door 240 is juxtaposed with a portion of windowed pocket 220, when door 240 is in the closed position. Furthermore, door 240 covers windowed pocket 220 over touchscreen 231 of mobile device 230 and window 241 of door 240 and windowed pocket 220 are juxtaposed enabling the taking of pictures and video with camera 232 from window 241 of door 240 and windowed pocket 220, when door 240 is in the closed position, when the mobile device 230 is received in windowed pocket 220, and when touchscreen 231 and camera 232 are juxtaposed with windowed pocket 220.

In FIG. 3, first pocket panel 222 of outer side 211 is formed with complemental engagement or fastener elements 250, including complemental fastener elements 250A near first end edge 213 that are registered with the respective fastener elements 135 of flap 130A, complemental fastener elements 250B near second end edge 214 that are registered with the respective fastener elements 135 of flap 130B, complemental fastener elements 250C near first side edge 215 that are registered with the respective fastener elements 135 of flap 130C, and complemental fastener elements 250D near second side edge 216 that are registered with the respective fastener elements 135 of flap 130D. Complemental fastener elements 250 encircle windowed pocket 220, are between door 240 and peripheral edge 212, and encircle door 240 when door 240 is in its closed position. In this embodiment, fastener elements 135 of flaps 130 are female snap elements, and complemental fastener elements 250 are male snap elements, wherein each corresponding pair of fastener and complemental fastener elements is a snap fastener. The positioning of the fastener and complemental fastener elements 135 and 250 can be reversed in an alternate embodiment.

Door 240 and outer pocket panel 222 of outer side 211 of pack 52 incorporate a latch assembly for releasably securing door 240 to pack when door 240 is in its closed position, and which enables door 240 to be repeatedly opened and closed. As shown in FIG. 4, the latch assembly includes a hook and loop fastener having an element 260 thereof carried by distal extremity 243 of door 240, and a complemental element 261 thereof carried by first pocket panel 222 of outer side 211 of pack 52 between windowed pocket 220 and complemental fasteners elements 250 corresponding to flap 130C. In this embodiment, element 260 is the hook element and element 261 is the loop element. This arrangement can be reversed without departing from the invention. In alternate embodiments, the latch assembly can include snap fasteners, a zipper fastener, etc.

To employ pack 52 with mobile device 230 in FIGS. 4 and 5, mobile device 230 is taken up, such as by hand, and applied upright into windowed pocket 220 through pocket inlet 221 in FIG. 4 so as to juxtapose touchscreen 231 and camera 232 with windowed pocket 220 in FIG. 5 to enable the viewing and the touching of touchscreen 231 and the taking of still pictures and video with camera 232 in the operation of mobile device 230 via sheet 226 of transparent material of windowed pocket 220. The shape of windowed pocket 220 corresponds to the shape of mobile device 230 to ensure mobile device 230 is held snugly by windowed pocket 220. Again, mobile device 230 is oriented in place in windowed pocket 220 in an operative position so as to juxtapose touchscreen 231 and camera 232 with windowed pocket 220 to enable the viewing and touching of touchscreen 231 and the taking of pictures and video in the operation of mobile device 230 via sheet 226 of transparent material.

Pack 52 is configured or otherwise adapted to be coupled to, and carried by, base 60 of harness 51. Base 60 of harness 51 is in an open position in FIG. 3 when pack 52 is detached from base 60 and when flaps 130 extend from peripheral edge 72 and fastener elements 135 are detached from complemental fastener elements 250 of pack 52. Referring in relevant part to FIGS. 3 and 5, to attach pack 52 to base 60 from the open position of base 60, inner side 210 of pack 52 is superimposed atop inner side 70 of base 60 positioning upper and lower inner sleeves 82 and 83 between inner side 210 of pack 52 and inner side 70 of base 60 and so as to juxtapose first end edge 213 of pack 52 with first end edge 73 of base 60, so as to juxtapose second end edge 214 of pack 52 with second end edge 74 of base 60, so as to juxtapose first side edge 215 of pack 52 with first side edge 75 of base 60, and so as to juxtapose second side edge 216 of pack 52 with second side edge 76 of base 60. After so positioning pack 52 on base 60, in which base 60 and pack 52 are axially aligned, base 60 is closed to releasably couple pack 52 to base 60. To close base 60 to releasably couple pack 52 to base 60 of harness 51, flap 130A is folded over first end edge 213 of pack 52 over pocket inlet 221 to windowed pocket 220 from first end edge 73 of base 60 to outer side 211 of pack 52 outboard of windowed pocket 220 and fasteners 135 of flap 130A and corresponding complemental fasteners 250A are snapped together releasably securing flap 130A to pack 52, flap 130B is folded over second end edge 214 of pack 52 from second end edge 74 of base 60 to outer side 211 of pack 52 outboard of windowed pocket 220 and fasteners 135 of flap 130B and corresponding complemental fasteners 250B are snapped together releasably securing flap 130B to pack 52, flap 130C is folded over first side edge 215 of pack 52 from first side edge 75 of base 60 to outer side 211 of pack 52 outboard of windowed pocket 220 and fasteners 135 of flap 130C and corresponding complemental fasteners 250C are snapped together releasably securing flap 130C to pack 52, and flap 130D is folded over second side edge 216 of pack 52 from second side edge 76 of base 60 to outer side 211 of pack 52 outboard of windowed pocket 220 and fasteners 135 of flap 130D and corresponding complemental fasteners 250D are snapped together releasably securing flap 130D to pack 52. The inherent flexible and elastic material characteristics of proximal parts 131 of flaps 130 enables flaps 130 to be so folded. And so when base 60 of harness 51 is closed relative to pack 52 and pack 52 is coupled releasably to base 60 and mobile device 230 is applied to windowed pocket 220, flap 130A extends over first end edge 213 of pack 52 over pocket inlet 221 to windowed pocket 220 from first end edge 73 of base 60 to outer side 211 of pack 52 outboard of windowed pocket 220 and fasteners 135 of flap 130A and corresponding complemental fasteners 250A are snapped together releasably securing flap 130A to pack 52 and flap 130A extends completely over and closes pocket inlet 221 to windowed pocket 220 in response entrapping mobile device 230 in windowed pocket 220, as shown in FIG. 5, flap 130B extends over second end edge 214 of pack 52 from second end edge 74 of base 60 to outer side 211 of pack 52 outboard of windowed pocket 220 and fasteners 135 of flap 130B and corresponding complemental fasteners 250B are snapped together releasably securing flap 130B to pack 52, flap 130C extends over first side edge 215 of pack 52 from first side edge 75 of base 60 to outer side 211 of pack 52 outboard of windowed pocket 220 and fasteners 135 of flap 130C and corresponding complemental fasteners 250C are snapped together releasably securing flap 130C to pack 52, and flap 130D extends over second side edge 216 of pack 52 from second side edge 76 of base 60 to outer side 211 of pack 52 outboard of windowed pocket 220 and fasteners 135 of flap 130D and corresponding complemental fasteners 250D are snapped together releasably securing flap 130D to pack 52. To detach pack 52 from base 60, the foregoing pack 52 installation method need only be reversed. Pack 52 can be so repeatedly attached and detached relative to base 60. In an alternate embodiment, pocket opening 221 can be fashioned with a dedicated closure, such as a snap closure, a zipper closure, a hook-and-loop closure, etc., useful for opening and closing pocket inlet 221 independently of flap 130A.

Flaps 130 can be opened and closed independently from one another. As a matter of example, in FIG. 4 flaps 130B-130D are shown as they would appear closed releasably securing pack 52 to base 60 of harness 51, whereas flap 130A is shown as it would appear open thereby opening the pocket inlet 221 to windowed pocket 220 to enable mobile device 230 to be selectively inserted into windowed pocket 220 through pocket inlet 221 and selectively withdrawn from windowed pocket 220 through pocket inlet 221, according to the principle of the invention.

When mobile device 230 is inserted into windowed pocket 220 and pack 52 is coupled removably to base 60 of harness 51 and door 240 is secured in its closed position in FIG. 1, pack assembly 50 is ready for use to employ mobile device 230 usefully as a body camera for taking still pictures and video with camera 232 for recording the wearer's interactions with the environment and others, according to the principle of the invention. Base 60 of harness 51 is configured to be positioned against the chest of the upper torso of the wearer for holding pack 52 ahead of the chest of the upper torso of the wearer with windowed pocket 220 facing outwardly relative to the chest of the upper torso of the wearer, when harness 51 is worn by the upper torso of the wearer in FIGS. 6 and 8. Referring again in relevant part to FIGS. 6-8, inner side 70 of base 60 positioned against chest 171 of wearer 170, left shoulder strap 140 extends over left shoulder 172 of wearer 170 from base 60 to tie-down ring 150 centered along the upper part of back 174 of wearer 170, right shoulder strap 141 extends over right shoulder 173 of wearer 170 from base 60 to tie-down ring 150 centered along the upper part of back 174 of wearer 170, left waist strap 142 extends over left waist 175 of wearer 170 from base 60 to connecting strap 151 centered along the lower part of back 174 of wearer 170, right waist strap 143 extends over right waist 176 of wearer 170 from base 60 to connecting strap 151 centered along the lower part of back 174 of wearer 170, and back strap 144 extends downwardly along the center of back 174 of wearer 170 from tie-down ring 150 to connecting strap 151, when harness 51 is worn by wearer 170. From this position, door 240 can be selectively opened in FIG. 8 to enable wearer 170 to view and touch touchscreen 231 and take pictures and video with camera 232 in the operation of mobile device 230 via sheet 226 of transparent material of windowed pocket 220 as a body camera for recording the wearer's interactions with the environment and others with camera 232. Furthermore, door 240 partially covers windowed pocket 220 and protects mobile device 230 applied therein and window 241 of door 240 and windowed pocket 220 are juxtaposed for enabling the use of mobile device 230 as a body camera, namely, for the taking of pictures and video with camera 232 from window 241 of door 240 and windowed pocket 220 via sheet 226 of transparent material in the operation of mobile device 230, when door 240 is in the closed position, when the mobile device 230 is received in windowed pocket 220, and when touchscreen 231 and camera 232 are juxtaposed with windowed pocket 220 in FIG. 6.

Figure 9:
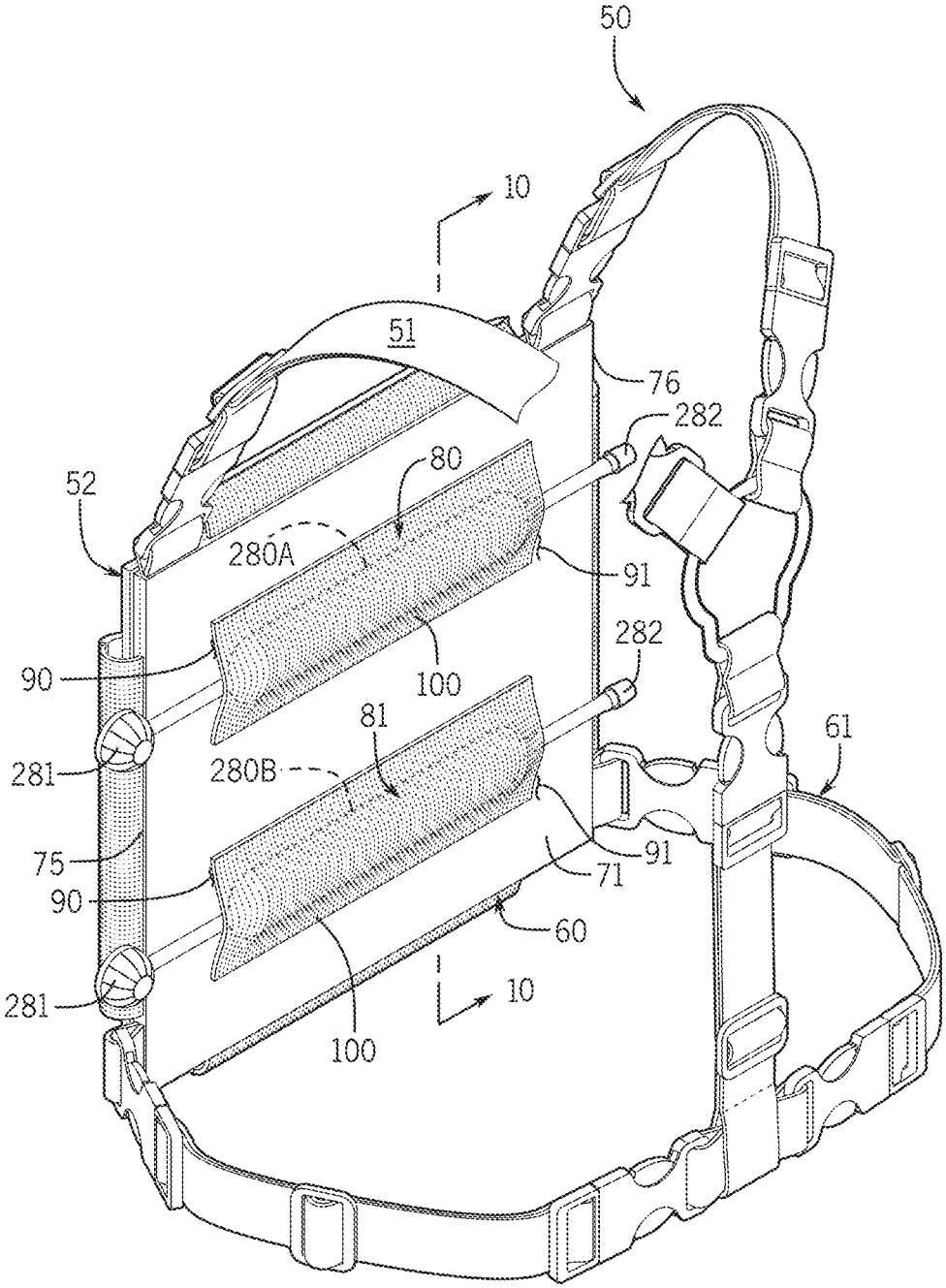
FIG. 9 is a rear perspective view of another example embodiment of a wearable pack assembly for a mobile device.

FIG. 9 is a rear perspective view corresponding to FIG. 2 illustrating inflatable bladders 280 inserted into the respective upper and lower outer sleeves 80 and 81. Bladders 280 can be selectively inflated and deflated for selectively adjusting the field of view of camera 232 of mobile device 230 when mobile device 230 is carried by pack 52, when pack 52 is coupled to base 60 of harness 51, and when harness 51 is worn by the upper torso of the wearer 170, namely, for providing a selected up-angled or down-angled field of view of camera 232 as desired by the wearer of pack assembly 50.

Inflatable bladders 280 each include a pump 281 and a release valve 282. Pumps 281, operable by hand, are used to inflate the respective inflatable bladders 280. Release valves 282, operable by hand, are used to deflate the respective inflatable bladders 280.

In FIGS. 9 and 10, inflatable bladder 280A is inserted into, and is held by, upper outer sleeve 80, through one of its first and second open ends 90 and 91, in which inflatable bladder 280A extends outwardly from open end 90 to pump 281 outboard of first side edge 75 of base 60, and extends outwardly from open end 91 to release valve 282 outboard of second side edge 76 of base 60. The inherent elasticity of strap 100 of upper outer sleeve 80 enables inflatable bladder 280A to be advanced into upper outer sleeve 80 through either one of its first and second open ends 90 and 91 and held in place against outer side 71 by strap 100, and withdrawn from either one of its first and second open ends 90 and 91. Inflatable bladder 280B is inserted into, and is held by, lower outer sleeve 81, through one of its first and second open ends 90 and 91, in which inflatable bladder 280B extends outwardly from open end 90 to pump 281 outboard of first side edge 75 of base 60, and extends outwardly from open end 91 to release valve 282 outboard of second side edge 76 of base 60. The inherent elasticity of strap 100 of lower outer sleeve 81 enables inflatable bladder 280B to be advanced into lower outer sleeve 81 through either one of its first and second open ends 90 and 91 and held in place against outer side 71 by strap 100, and withdrawn from either one of its first and second open ends 90 and 91.

In FIGS. 9 and 10, inflatable bladders 280 are inflated in the respective upper and lower outer sleeves 80 and 81. In FIG. 11, inflatable bladder 280A is inflated in upper outer sleeve 80 and inflatable bladder 280B is deflated in lower outer sleeve 81. In FIG. 12, inflatable bladder 280A is deflated in upper outer sleeve 80 and inflatable bladder 280B is inflated in lower outer sleeve 81. When inflatable bladder 280A is inflated in upper outer sleeve 80 in FIGS. 9, 10, and 11, strap 100 of upper outer sleeve 80 elastically extends. When inflatable bladder 280A is deflated in upper outer sleeve 80 in FIG. 12, strap 100 of upper outer sleeve 80 elastically constricts. When inflatable bladder 280B is inflated in lower outer sleeve 81 in FIGS. 9, 10, and 12, strap 100 of lower outer sleeve 81 elastically extends. When inflatable bladder 280B is deflated in lower outer sleeve 81 in FIG. 11, strap 100 of upper outer sleeve 80 elastically constricts.

Inflatable bladders 280A and 280B interact between chest 171 of wearer 170 concurrently holding base 60 and pack 52 and mobile device 230 held by pack 52 parallel relative to chest 171 of wearer 170 in FIG. 10 when inflatable bladders 280 are inflated in the respective upper and lower outer sleeves 80 and 81, when mobile device 230 is carried by pack 52, when pack 52 is coupled to base 60 of harness 51, and when harness 51 is worn by the upper torso of the wearer 170, so as to provide a normal field of view of camera 232 as desired by the wearer of pack assembly 50. Inflatable bladder 280A interacts between chest 171 of wearer 170 concurrently holding tipping/tilting base 60 and pack 52 and mobile device 230 held by pack 52 downwardly relative to chest 171 of wearer 170 in FIG. 11 when inflatable bladder 280A is inflated in upper outer sleeve 80 and when inflatable bladder 280B is deflated in lower outer sleeve 81, when mobile device 230 is carried by pack 52, when pack 52 is coupled to base 60 of harness 51, and when harness 51 is worn by the upper torso of the wearer 170, so as to provide a down-angled field of view of camera 232 as desired by the wearer of pack assembly 50. Inflatable bladder 280B interacts between chest 171 of wearer 170 concurrently holding tipping/tilting base 60 and pack 52 and mobile device 230 held by pack 52 upwardly relative to chest 171 of wearer 170 in FIG. 12 when inflatable bladder 280B is inflated in lower outer sleeve 81 and when inflatable bladder 280A is deflated in upper outer sleeve 80, when mobile device 230 is carried by pack 52, when pack 52 is coupled to base 60 of harness 51, and when harness 51 is worn by the upper torso of the wearer 170, so as to provide an up-angled field of view of camera 232 as desired by the wearer of pack assembly 50. Accordingly, inflatable bladders 280A and 280B can be selectively inflated, partially inflated, and deflated in upper and lower outer sleeves 80 and 81, respectively, for selectively tipping/tilting mobile device 230 upwardly and downwardly for concurrently defining a selected field of view of camera 232 relative to chest 171 of wearer 170. Additionally, in some embodiments, inflatable bladders 280 can be inserted into respective upper and lower sleeves 82 and 83 on inner side 70 of base 60. Furthermore, in some embodiments, other spacer elements can be in place of inflatable bladders 280.

Figure 13:
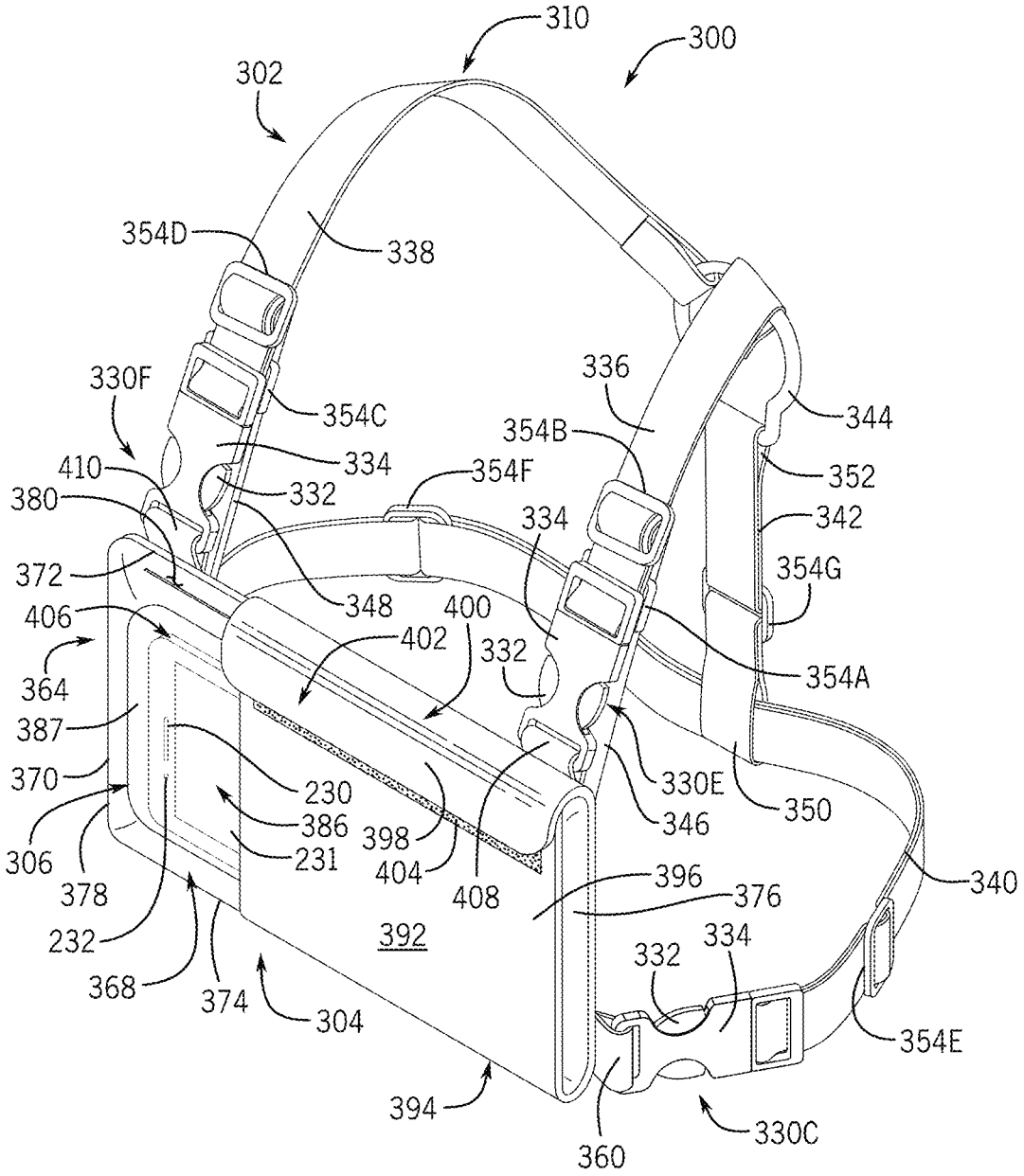
FIG. 13 is a front perspective view of another example embodiment of a wearable pack assembly for a mobile device, with a windowed pocket containing a mobile phone with a rear-facing camera and a touchscreen oriented outward.
Figure 14:
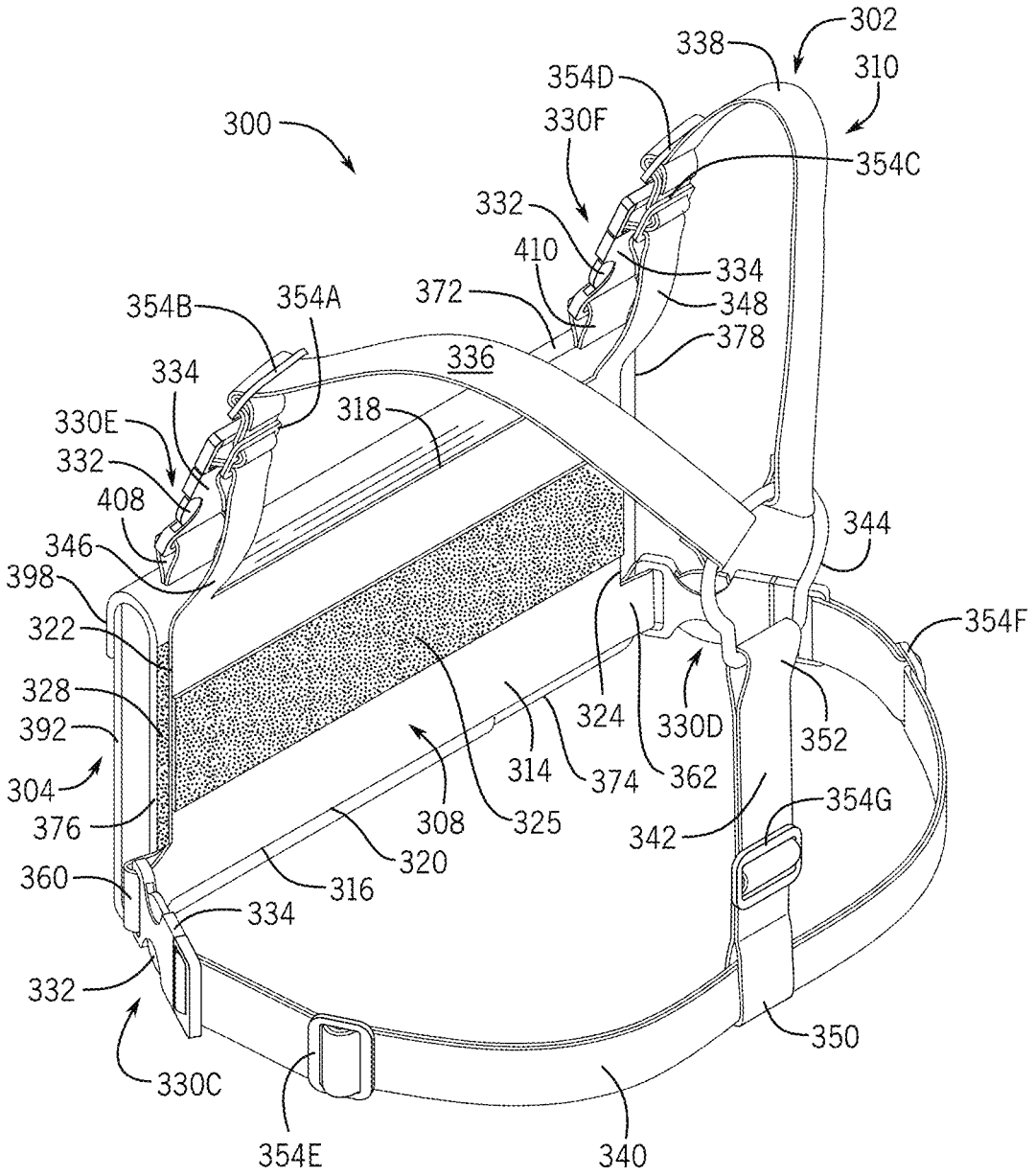
FIG. 14 is rear perspective view of the pack assembly of FIG. 13.

FIGS. 13-24 illustrate a wearable pack assembly 300 for a mobile device according to another embodiment. Pack assembly 300 includes a harness 302 and a pack 304. Harness 302 is wearable, and pack 304 is configured to be carried by harness 302, as shown in FIGS. 13 and 14. Generally, pack 304 includes a windowed pocket 306 for receiving a mobile device through an opening to windowed pocket 306 so as to juxtapose a touchscreen and a camera of the mobile device with the windowed pocket 306 to enable the viewing and the touching of the touchscreen and the taking of pictures and video with the camera in the operation of the mobile device from windowed pocket 306. Harness 302 is configured to hold pack 304 ahead of a chest of an upper torso of a wearer with windowed pocket 306 facing outwardly relative to the chest of the upper torso of the wearer when harness 302 is worn by the upper torso of the wearer and when pack 304 is carried by harness 302 for enabling the wearer to usefully employ the camera of the mobile device as a body camera for recording a wearer's interactions with the environment when the mobile device is carried operatively by the pack 304.

Figure 15:
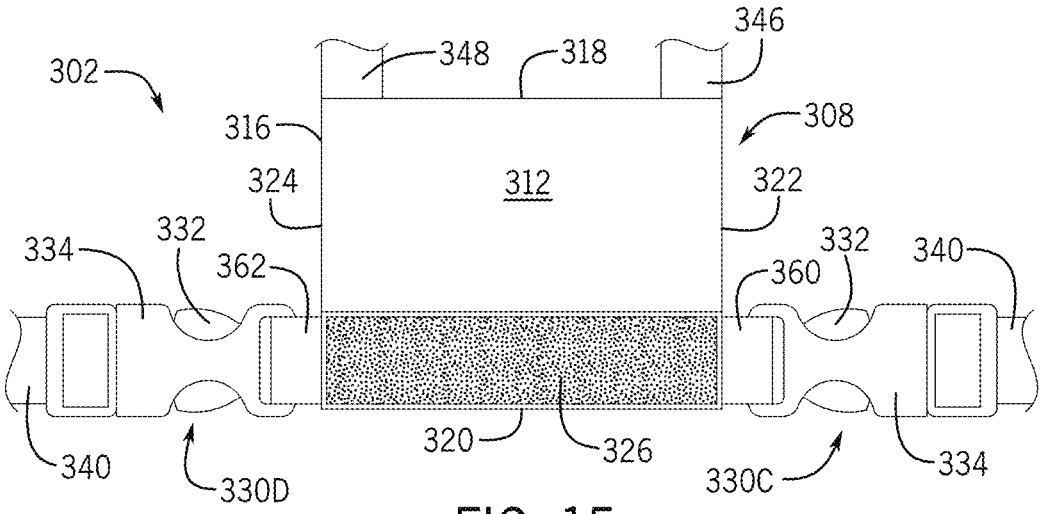
FIG. 15 is a front partial view of a harness and a base of the pack assembly of FIG. 13.

With respect to the harness 302, referring to FIGS. 13-15, the harness 302 can include a base 308 and strap assembly or system 310. The base 308 can be flat and generally rectangular in overall shape. In some embodiments, the base 308 is a panel assembly including a panel covered with outer layering consisting of one or more layers of material, similar to that described above with respect to base 60 of FIGS. 1-12. For example, panel is upholstered with outer layering, which encloses panel and defines the major sides and peripheral edge of base 308, as described below.

Referring in relevant part to FIGS. 13-15, base 308 can include inner side 312 and opposed outer side 314, and peripheral edge 316. As shown in FIG. 15, peripheral edge 316 can be defined by first end edge 318 and opposed second end edge 320, and first side edge 322 and opposed second side edge 324 that extend from the first end edge 318 to second end edge 320. First and second end edges 318 and 320 are parallel with respect to each other, and first and second side edges 322 and 324 are parallel with respect to each other and are orthogonal with respect to first and second end edges 318 and 320. Base 308 therefore has a length from first end edge 318 to second end edge 320 and a width from first side edge 322 to second side edge 324. As shown, the length of base 308 can be shorter than the width of base 308, characterizing the generally rectangular shape of base 308. However, in some embodiments, base 308 may instead be square in shape (e.g., where the length of the base 308 and the width of the base 308 are equal).

FIG. 14 illustrates an engagement mechanism on outer side 314. For example, the engagement mechanism can be configured to engage spacers, as further described below. In one embodiment, the engagement mechanism is a hook and loop fastener 325. More specifically, as shown in FIG. 14, an elongate strip of hook and loop fastener 325 can be applied across outer side 314, from first side edge 322 to second side edge 324 and configured to engage mating hook and loop fastener on a spacer (as further described below). However, in other embodiments, a plurality of smaller strips or squares of hook and loop fastener can be positioned along the outer side 314. Furthermore, in other embodiments, other engagement mechanisms may be contemplated.

Figure 18:
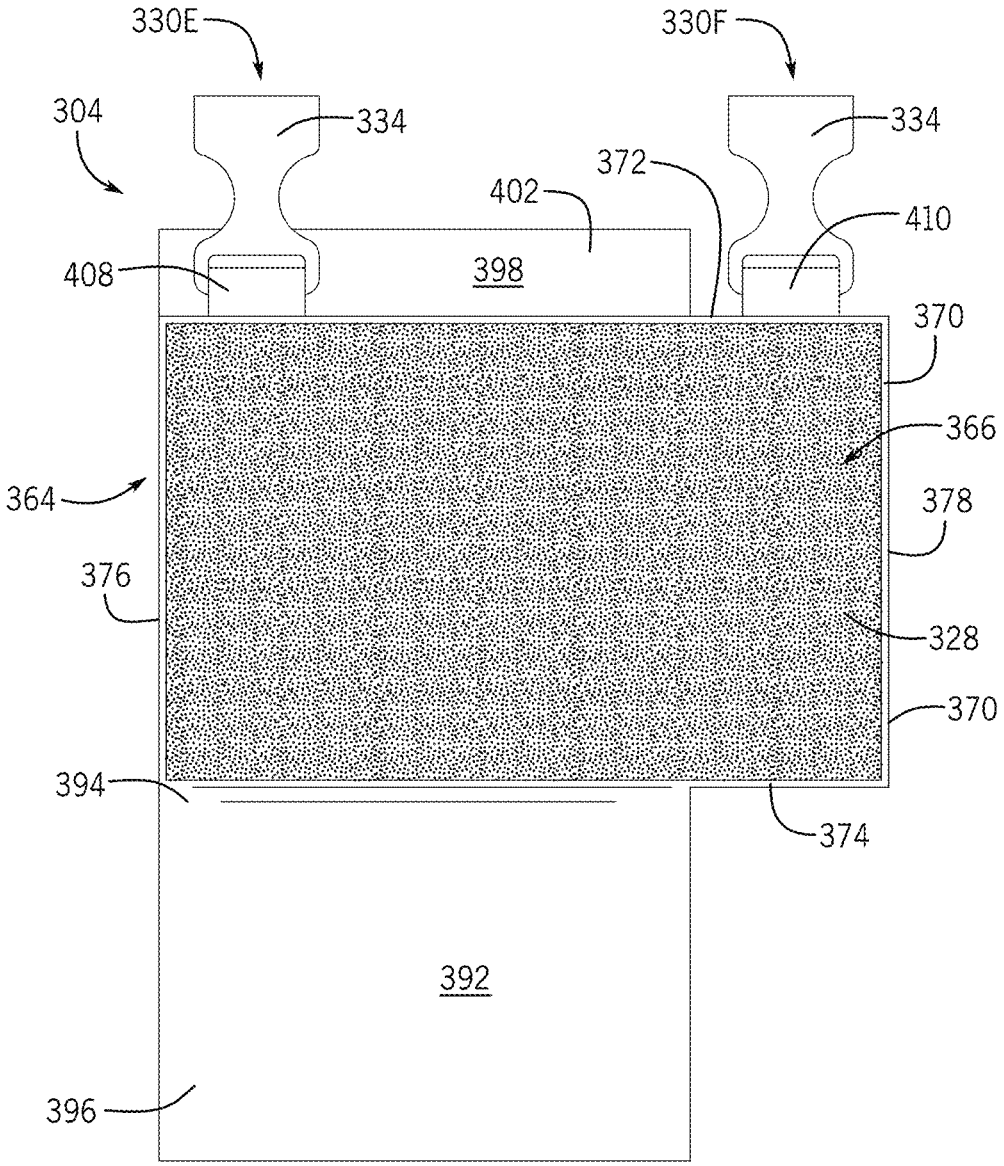
FIG. 18 is a rear view of the pack of FIG. 16 in the open position.

Additionally, pack assembly 300 includes an engagement assembly for removably coupling pack 304 to base 308. For example, the engagement assembly includes a hook and loop fastener 326 on the inner side 312 of the base 308, as shown in FIG. 15, configured to engage a mating hook and loop fastener 328 on the pack 304, as shown in FIG. 18 and further described below. In alternate embodiments, the hook and loop fasteners 326, 328 can be button fasteners, snap fasteners, or other suitable fastening elements. Additionally, the engagement assembly can include buckles 330, similar to buckles 145 described above. For example, harness 302 can include male buckle members 332 and pack 304 can include female buckle members 334 configured to engage the male buckle members 332 of harness 302, as further described below, to removably couple pack 304 to harness 302.

In FIGS. 13-14, strap assembly 310 is connected to base 308, is used to strap base 308 to the upper torso of the wearer, and includes left and right shoulder straps 336 and 338, a waist strap 340, and a back strap 342 interconnected with buckles 330, connecting straps 346-348, 360-362, and a tie-down ring 344. Generally, tie-down ring 344 is configured to connect left shoulder strap 336, right shoulder strap 338, and back strap 342, and back strap 342 is further coupled to waist strap 340. Straps 336-342, 346-348, 360-362 are each fashioned of leather, tightly woven nylon, canvas, elastic material, or other material or combination of materials having the properties of flexibility, resilience, tear-resistance, and ruggedness, and are conventionally length-adjustable straps. Additionally, different straps can incorporate different materials. For example, in some embodiments, one or more of straps 336-342 are fashioned of an elastic material, while one or more of straps 346-348, 360-362 are fashioned of a non-elastic webbing material. Each buckle 330 is a conventional slide release buckle including a male buckle member 332, the hook end, and a female buckle member 334, the catch end, as described above. However, other buckles or fastening mechanisms may be used in other embodiments.

Generally, as shown in FIG. 14, left and right shoulder straps 336 and 338 can be connected to first end edge 318 (e.g., at either end thereof) via left and right connecting straps 346, 348, and extend rearwardly therefrom to tie-down ring 344. Waist strap 340 is connected to first side edge 322, for example, near second end edge 320, with buckle 330C, and is further connected to second side edge 324, for example, near second end edge 320 with buckle 330D. As shown in FIG. 14, waist strap 340 extends rearwardly from either side edge 322, 324 of base 308 and is routed through a first looped end 350 of back strap 342. Back strap 342 interconnects tie-down ring 344 and waist strap 340. In this embodiment, back strap 342 is looped around tie-down ring 344 at a second looped end 352, and extends downwardly therefrom to first looped end 350 through which waist strap 340 extends.

More specifically, in the present embodiment, left connecting strap 346 is attached to first end edge 318 along the left side near first side edge 322 and is coupled to (e.g., looped through) a strap adjuster 354A. Furthermore, left shoulder strap 336 is coupled to strap adjuster 354B (e.g., looped around strap adjuster 354B and attached to itself). Left shoulder strap 336 is routed from strap adjuster 354B, through strap adjuster 354A (e.g., to connect left shoulder strap 336 to left connecting strap 346), then back through strap adjuster 354B, and extends rearwardly from strap adjuster 354B to tie-down ring 344. Strap adjuster 354B can therefore be used to permit shortening or lengthening of left shoulder strap 336. As shown in FIGS. 13 and 14, left shoulder strap 336 can be coupled to tie-down ring 344 by being looped around tie-down ring 344 and attached to itself. However, in some embodiments, an additional buckle (not shown) may be used to couple left shoulder strap 336 to tie-down ring 344. Additionally, at its forward end (e.g., between strap adjuster 354A and strap adjuster 354B), left shoulder strap 336 includes a female buckle member 334 that is part of the engagement assembly described above (e.g., for coupling pack 304 to harness 302).

Right connecting strap 348 is attached to first end edge 318 along the right side, near second side edge 324, and is coupled to (e.g., looped through) a strap adjuster 354C. Furthermore, right shoulder strap 338 is coupled to strap adjuster 354D (e.g., looped around strap adjuster 354D and attached to itself). Right shoulder strap 338 is routed from strap adjuster 354D, through strap adjuster 354C (e.g., to connect right shoulder strap 338 to right connecting strap 348), then back through strap adjuster 354D, and extends rearwardly from strap adjuster 354D to tie-down ring 344. Strap adjuster 354D can therefore be used to permit shortening or lengthening of right shoulder strap 338. As shown in FIGS. 13 and 14, right shoulder strap 338 can be coupled to tie-down ring 344 by being looped around tie-down ring 344 and attached to itself. However, in some embodiments, an additional buckle (not shown) may be used to couple right shoulder strap 338 to tie-down ring 344. Additionally, at its forward end (e.g., between strap adjuster 354C and strap adjuster 354D), right shoulder strap 338 includes a female buckle member 334 that is part of the engagement assembly described above (e.g., for coupling pack 304 to harness 302).

Connecting strap 360 is attached to first side edge 322 proximate to second end edge 320, and is coupled to female buckle member 334 of buckle 330C. Male buckle member 332 of buckle 330C is coupled releasably to female buckle member 334 of buckle 330C, and waist strap 340 extends rearwardly from male buckle member 332 of buckle 330C, through first looped end 350 of back strap 342, and around to male buckle member 332 of buckle 330D. Female buckle member 334 of buckle 330D is coupled releasably to male buckle member 332 of buckle 330D, and female buckle member 334 of buckle 330D is coupled to connecting strap 362 attached to second side edge 324 proximate to second end edge 320. Additionally, waist strap 340 can include one or more strap adjusters 354E, 354F to permit shortening or lengthening of waist strap 340. While a single waist strap 340 is shown and described herein, in some embodiments, two or more waist straps 340 and, optionally, additional buckles 330 may be included. Additionally, while two buckles 330C, 330D are shown and described herein with respect to waist strap 340, in some embodiments, waist strap 340 can be interconnected with a single buckle 330.

Back strap 342 couples tie-down ring 344 to waist strap 340. More specifically, as noted above, back strap 342 is looped around tie-down ring 344 at the second looped end 352, and extends downwardly therefrom to first looped end 350, through which waist strap 340 extends. Additionally, back strap 342 can include a strap adjuster 354G to permit shortening or lengthening of back strap 342. It should be noted that any of the above-described straps can comprise multiple straps permanently coupled together or releasably coupled together via, for example, additional buckles 330. Furthermore, in some embodiments, more or less straps may be incorporated. For example, in one embodiment, the left and right shoulder straps 336, 338 can be coupled to the waist strap 340 via one or more tie-down rings 344 (e.g., without a back strap). Additionally, it should be noted that strap adjusters 354 may be positioned anywhere along straps 336-342 at positions other than what is shown in FIGS. 13 and 14.

Referring in relevant part to FIGS. 20-23, outer side 314 of base 308 is positioned against chest 171 of the upper torso of human wearer 170. Left shoulder strap 336 extends over left shoulder 172 of wearer 170 from base 308 to tie-down ring 344 centered along the upper part of back 174 of wearer 170. Right shoulder strap 338 extends over right shoulder 173 of wearer 170 from base 308 to tie-down ring 344 centered along the upper part of back 174 of wearer 170. Waist strap 340 extends over left waist 175 (or left chest) of wearer 170 from base 308, through back strap 342 centered along the lower part of back 174 of wearer 170, and over right waist 176 (or right chest) of wearer 170 to base 308. Back strap 342 extends downwardly along the center of back 174 of wearer 170 from tie-down ring 344 to waist strap 340, when harness 302 is worn by wearer 170. Male and female buckle members 332 and 334 of at least one respective buckle 330 can be selectively de-united and united to enable wearer 170 to put on harness 302. Lengths of straps 336-342 can be length-adjusted as needed (e.g., via strap adjusters 354) in order to fit harness 302 snugly/closely to wearer 170, especially on the outside of the wearer's garment(s). While waist strap 340 is generally described as extending around waist of wearer 170, waist strap 340 can extend around waist or chest of wearer 170, for example, depending on length adjustments of shoulder straps 336, 338 and back strap 342. As such, in some embodiments, waist strap 340 may alternatively be considered a chest strap.

With respect to the pack 304, referring in relevant part to FIGS. 13 and 14, pack 304 includes base 364, which, like base 308, is flat and generally rectangular in overall shape and coextensive with respect to base 308. Base 364 can be a panel assembly including a panel covered with outer layering consisting of one or more layers of material, similar to that described above with respect to base 200 of FIGS.

1-12. Panel is upholstered with outer layering, which encloses panel and defines the major sides and peripheral edge of base 364, as described below.

Referring to FIGS. 13-14 and 16-19, base 364 includes inner side 366 and opposed outer side 368, and peripheral edge 370 defined by first end edge 372 and opposed second end edge 374, and first side edge 376 and opposed second side edge 378 that extend from the first end edge 372 to second end edge 374. First and second end edges 372 and 374 are parallel with respect to each other, and first and second side edges 376 and 378 are parallel with respect to each other and are orthogonal with respect to first and second end edges 372 and 374. Base 364 therefore has a length from first end edge 372 to second end edge 374 and a width from first side edge 376 to second side edge 378. As shown, the length of base 364 can be shorter than the width of base 364, characterizing the generally rectangular shape of base 364. However, in some embodiments, base 364 may instead be square in shape (e.g., where the length of the base 364 and the width of the base 364 are equal). Generally, in some embodiments, base 364 of pack 304 can be equal in length and width to base 308 of harness 302

Figure 16:
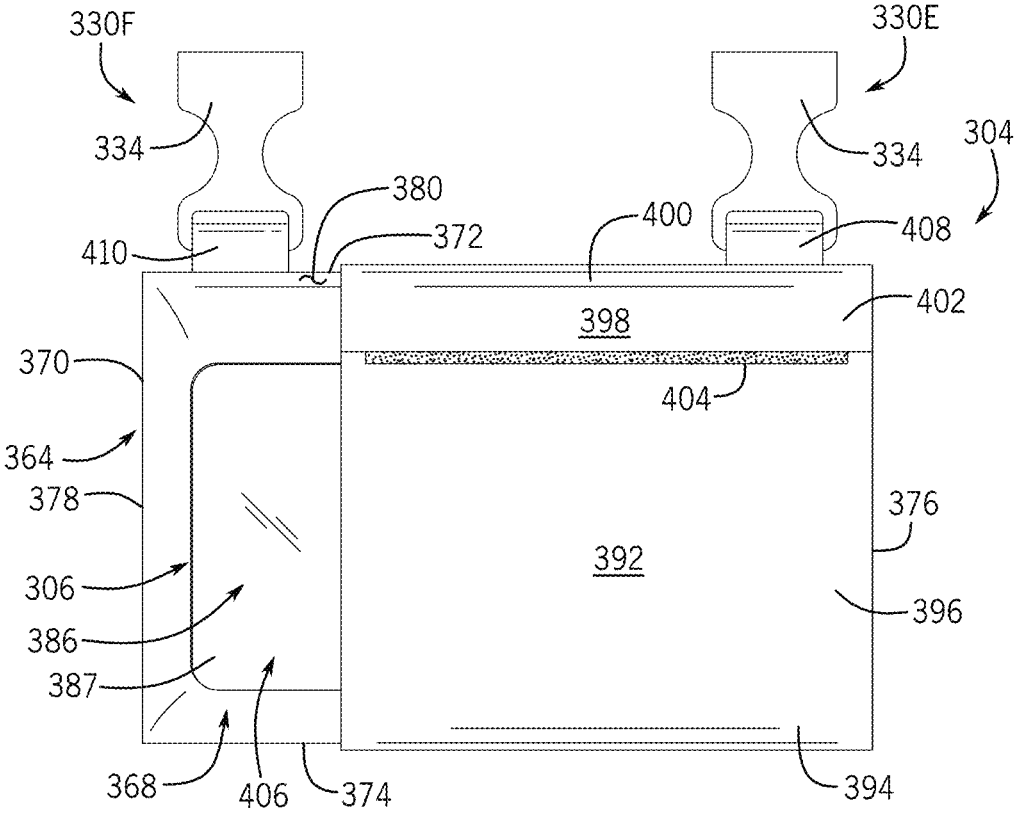
FIG. 16 is a front view of a pack of the pack assembly of FIG. 13, in a closed position.
Figure 17:
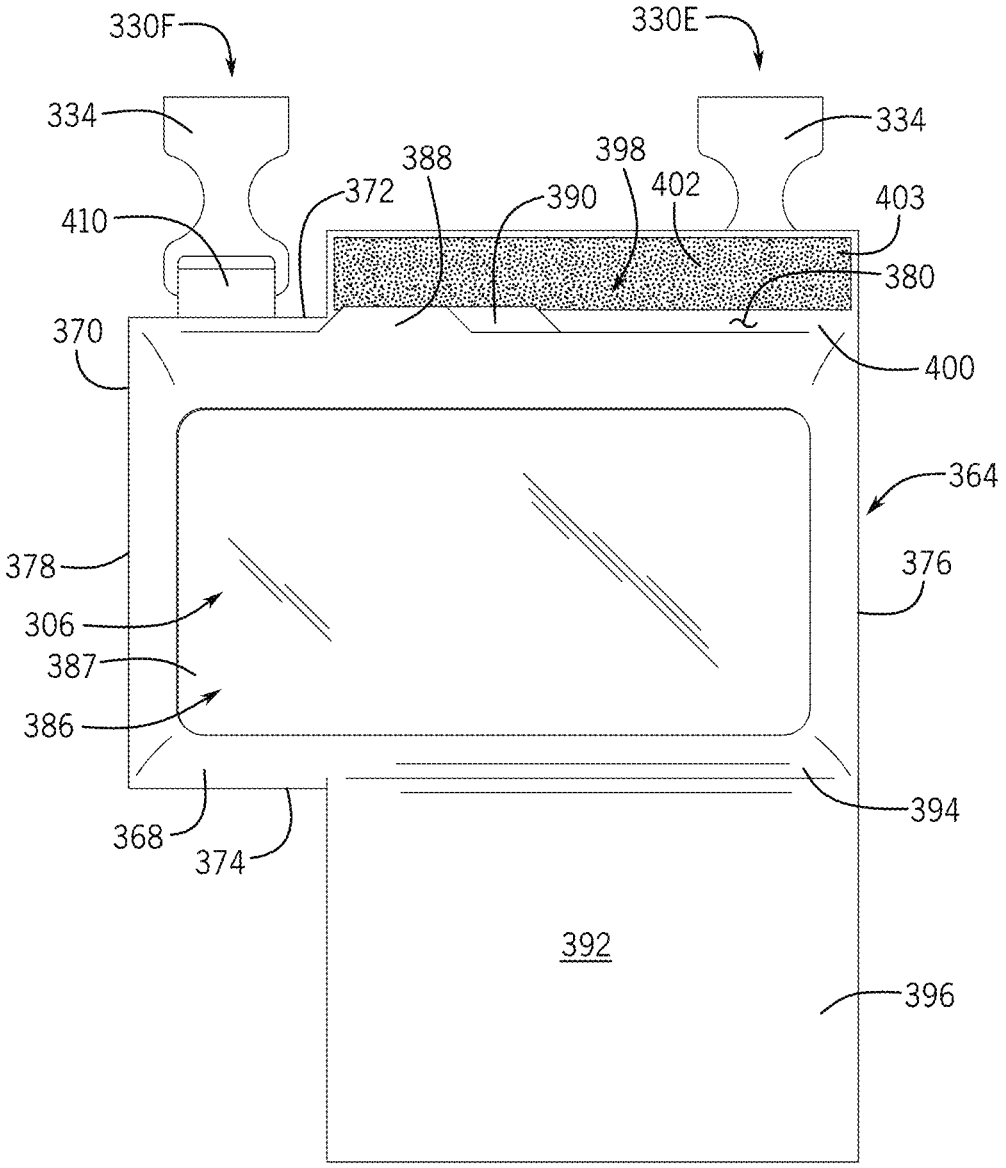
FIG. 17 is a front view of the pack of FIG. 16 in an open position.
Figure 22:
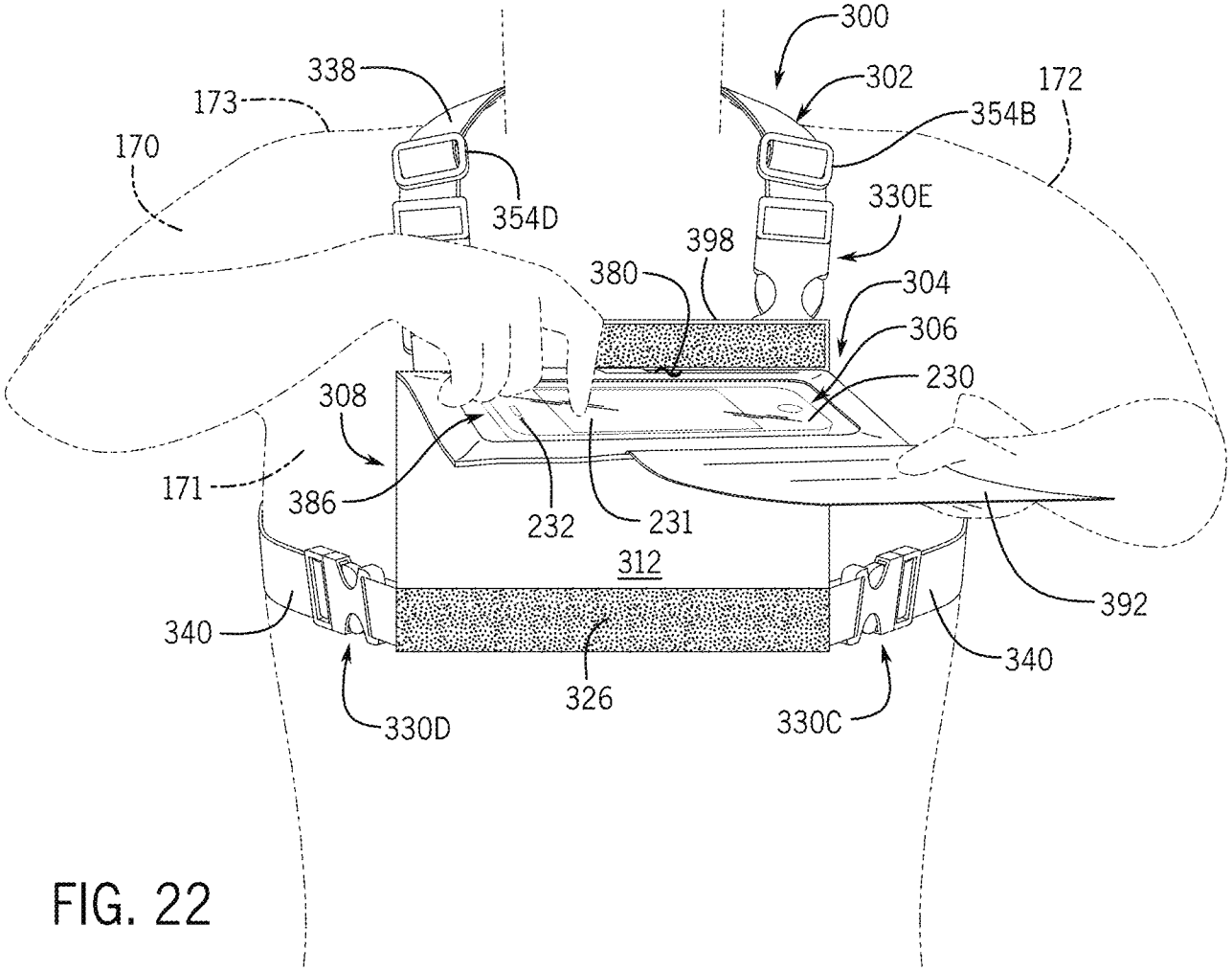
FIG. 22 is a front perspective view of the pack assembly of FIG. 13 worn and held in an extended position by the wearer, so the wearer can manipulate a touchscreen of the mobile device.
Figure 23:
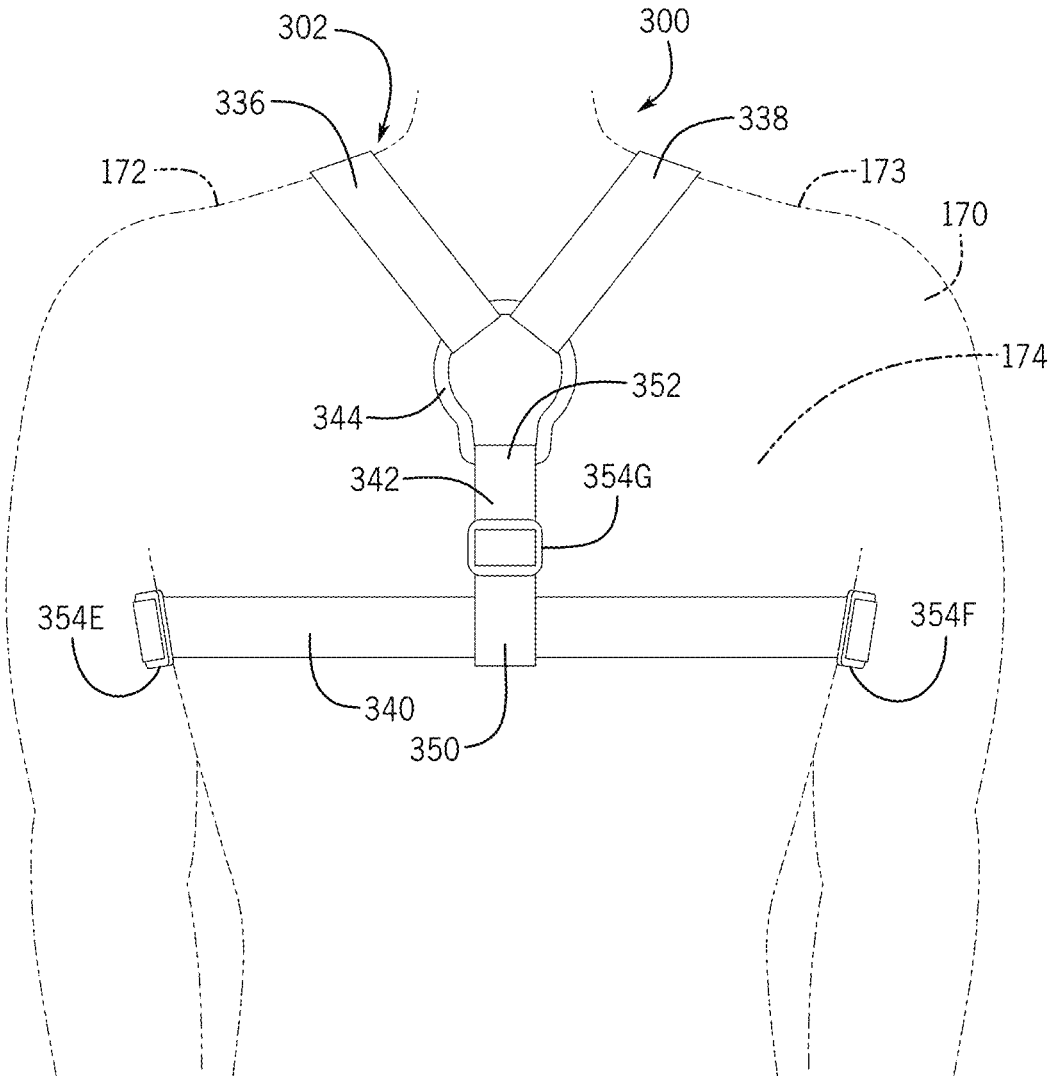
FIG. 23 is a rear view of the pack assembly of FIG. 13 being worn.

In FIGS. 16 and 17, pack 304 is formed with windowed pocket 306, and pocket inlet 380 to windowed pocket 306. Windowed pocket 306 is formed in outer side 368, and is for receiving a mobile device 230, having touchscreen 231 and camera 232 (as shown in FIG. 22), through pocket inlet 380 so as to juxtapose touchscreen 231 and camera 232 with windowed pocket 306 to enable viewing and touching of touchscreen 231 and taking of pictures and video with camera 232 in the operation of the mobile device 230 from windowed pocket 306, when mobile device 230 is inserted into windowed pocket 306 through pocket inlet 380.

Figure 19:
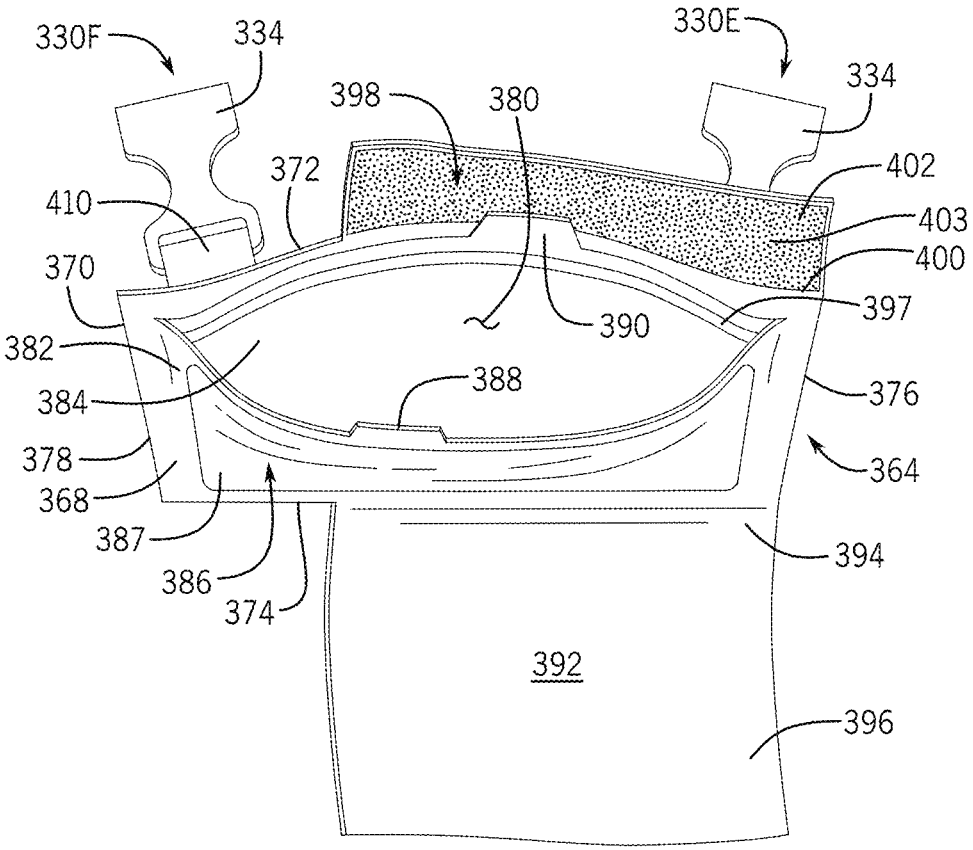
FIG. 19 is a top perspective view of the pack of FIG. 16 in the open position, showing a windowed pocket of the pack opened to receive the mobile device.
Figure 20:
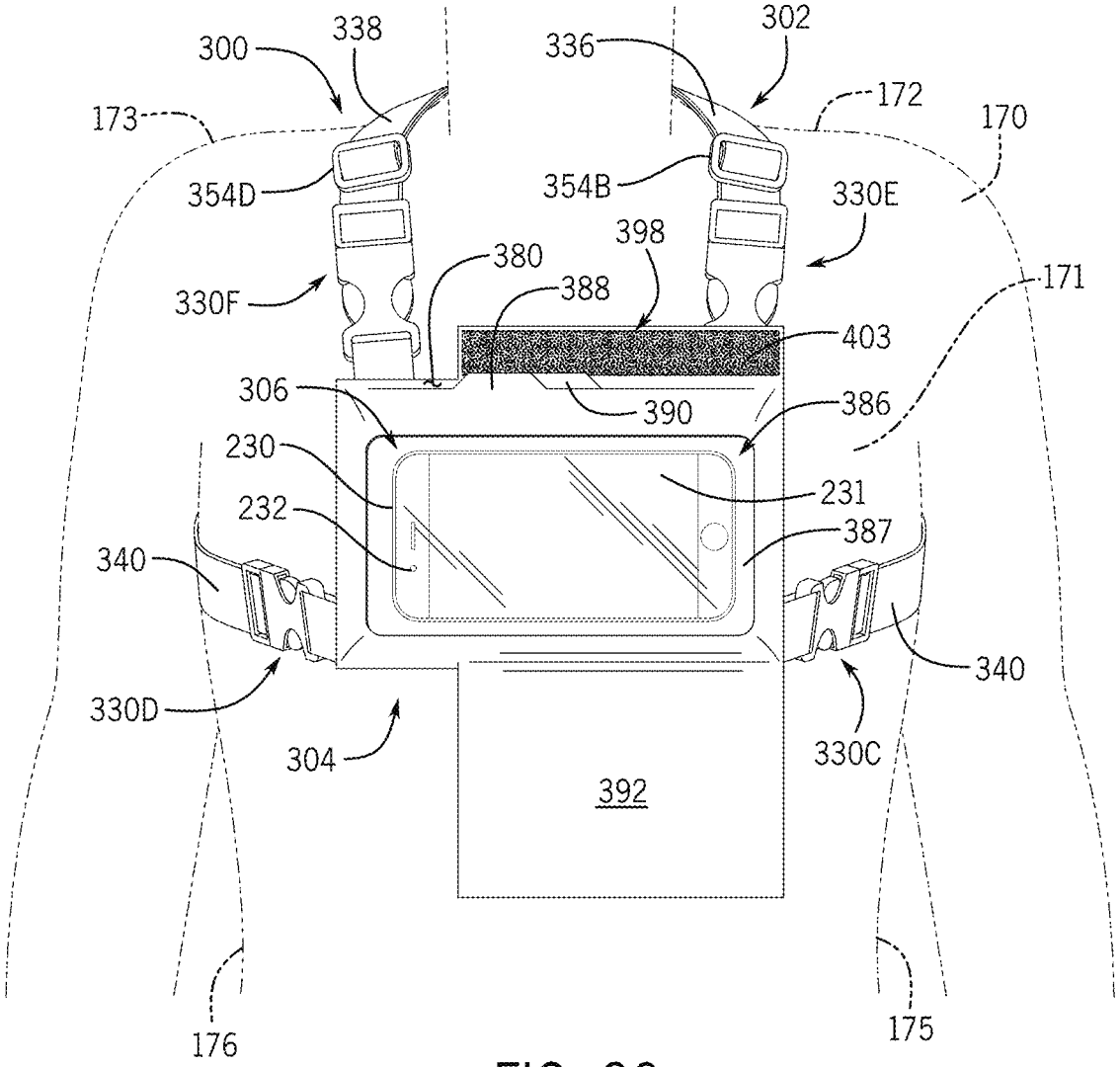
FIG. 20 is a front view of the pack assembly of FIG. 13 being worn in the open position.

Windowed pocket 306 is formed in outer side 368 by a pair of outer and inner pocket panels, including outer or first pocket panel 382 and inner or second pocket panel 384, as shown in FIG. 19. First pocket panel 382 is superimposed atop, and is coextensive with respect to, second pocket panel 384. First and second pocket panels 382 and 384 are joined along their three edges at or adjacent to second end edge 374 and first and second side edges 376 and 378 of peripheral edge 370 of pack 304 and, in some embodiments, partially along their fourth edges at first end edge 372 of peripheral edge 370 of pack 304 so as to form pocket inlet 380 at or adjacent to first end edge 372. First and second pocket panels 382 and 384 are further joined along three sides to form an inside closed portion of windowed pocket 306. First and second pocket panels 382 and 384 can be joined together with stitching, adhesive, heat bonding, or the like. Windowed pocket 306 is therefore accessible through pocket inlet 380. In some embodiments, as shown in FIGS. 17 and 19, first and second pocket panels 382, 384 can each include upper tabs 388, 390 adjacent the pocket inlet 380. For example, tabs 388, 390 can ease opening of pocket inlet 380 to access inside of windowed pocket 306.

In FIGS. 17 and 19, as noted above, pocket inlet 380 to windowed pocket 306 is formed at first end edge 372 of peripheral edge 370. Pocket inlet 380 can be centered or otherwise equidistant between first and second side edges 376 and 378, though need not be in alternate embodiments. Windowed pocket 306 extends downwardly from pocket inlet 380 to proximate to second end edge 374, and can be equidistant between first and second side edges 376 and 378 in some embodiments. First pocket panel 382 of windowed pocket 306 includes window 386 framed by a peripheral edge border or frame of outer side 368. Window 386 is fitted with a thin sheet 387 of transparent material. Sheet 387 is thin in that it can have a thickness of approximately 0.2-0.3 millimeters (e.g., thin enough to permit touch screen capabilities through sheet 387 to mobile device 230 inside pocket 306), and is formed of transparent flexible plastic that is affixed to and held at border or frame of outer side 368, such as by heat bonding, an adhesive, stitching, or the like.

Base 364 further includes a door 392. Door 392, like outer layering, can be fashioned of leather, tightly woven nylon, canvas, or other material or combination of materials having the inherent properties of flexibility, resilience, tear-resistance, and ruggedness. Door 392 can be flat and generally square or rectangular in shape, and includes proximal extremity 394 mounted to outer pocket panel 382 of outer side 368 between second end edge 374 and window 386, and an opposed distal extremity 396. Proximal extremity 394 can be mounted or coupled to first pocket panel 382 with stitching, heat bonding, adhesive, or the like or, alternatively, can be integral with base 364 (e.g., formed as an extension of first pocket panel 382 or other paneling of inner or outer sides 366, 368 of base 364). The inherent material characteristics of door 392 enables door 392 to pivot at proximal extremity 394 between an open position away from windowed pocket 306 in FIGS. 17-19, and a closed position partially over windowed pocket 306 in FIGS. 13 and 16. In other words, in the closed position, distal extremity 396 covers a portion of windowed pocket 306.

Figure 21:
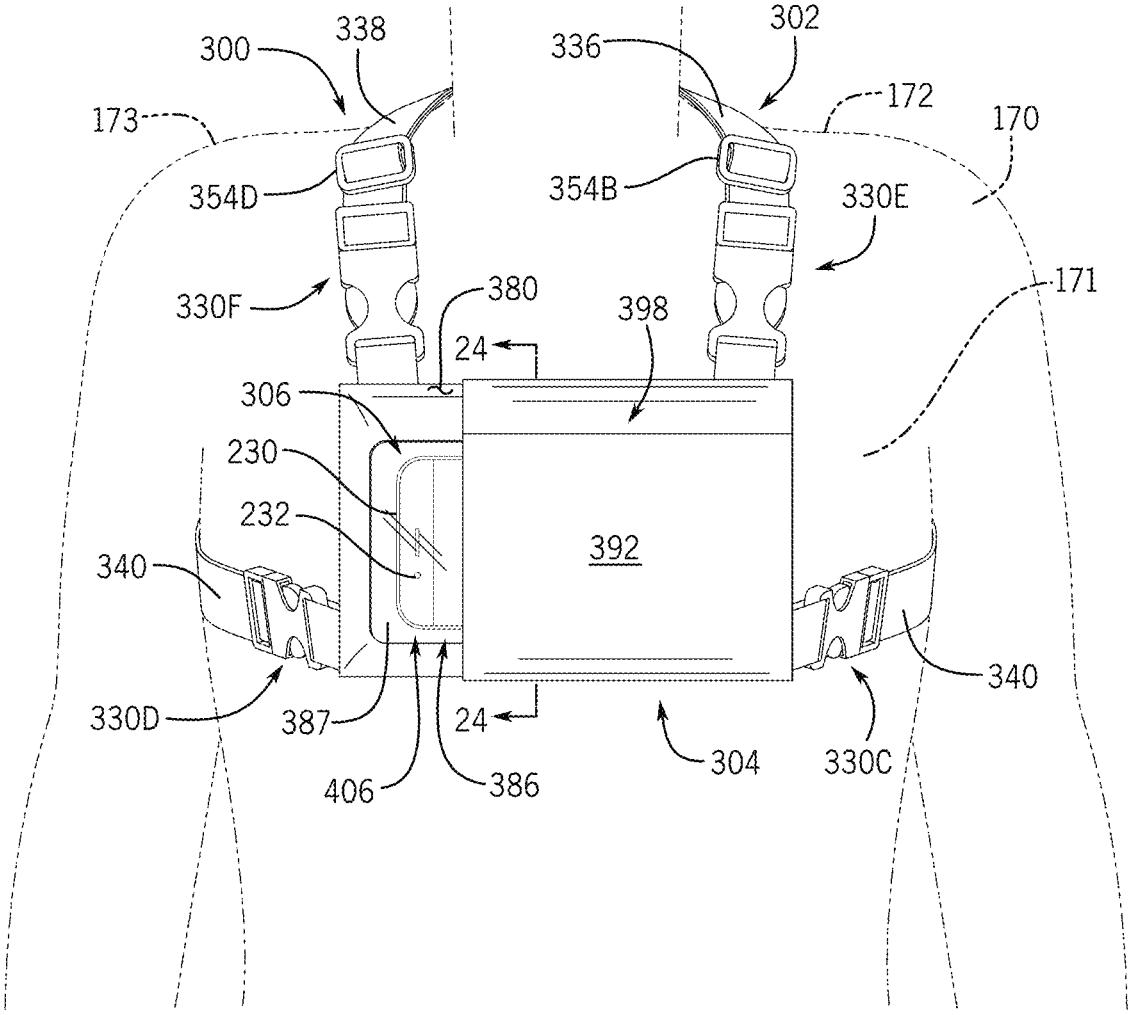
FIG. 21 is a front view of the pack assembly of FIG. 13 being worn in the closed position.
Figure 21A:
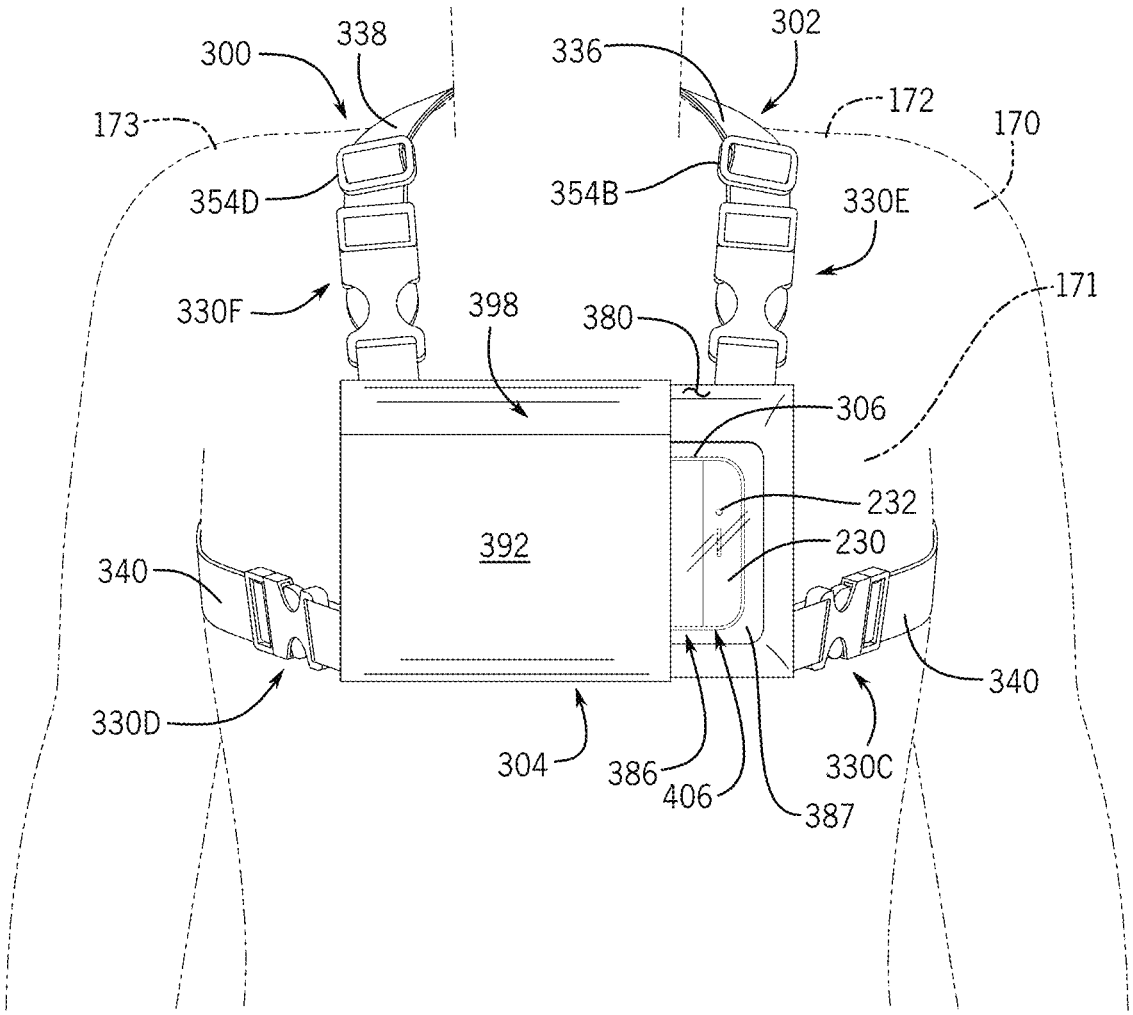
FIG. 21A is a front view of an alternate embodiment of the pack assembly of FIG. 13, being worn in the closed position.

As shown in FIGS. 16-19, door 392 is positioned off-center between first side edge 376 and second side edge 378 and therefore partially covers windowed pocket 306 when door 392 is in the closed position. More specifically, in the closed position, door 392 can partially cover windowed pocket 306 over touchscreen 231 of mobile device 230, enabling the taking of pictures and video with camera 232 from window 386 of windowed pocket 306 when door 392 is in the closed position, when the mobile device 230 is received in windowed pocket 306, and when touchscreen 231 and camera 232 are juxtaposed with windowed pocket 306. As shown in FIG. 21, the pack 304 can include a first arrangement where door 392 is positioned on the base 364 adjacent first side edge 376 so that a right side portion 406 of windowed pocket 306 (relative to body of wearer 170) is uncovered when door 392 is in the closed position. Alternatively, as shown in FIG. 21A, the pack 304 can include a second arrangement where door 392 is positioned on the base 364 adjacent second side edge 378 so that a left side portion 406 of windowed pocket 306 (relative to body of wearer 170) is uncovered when door 392 is in the closed position. The first and second arrangements can be used based on preference of the wearer 170 (such as a right-handed wearer or a left-handed wearer). For example, the first orientation in FIG. 21 may be considered a left-handed orientation, while the second orientation of FIG. 21A may be considered a right-handed orientation.

Referring back to FIG. 19, second pocket panel 384 can include one or more engagement or fastener elements 397 near first end edge 372 that are registered with the one or more respective fastener elements (not shown) on an inside of first pocket panel 382. The fastener elements 397 can be press-seal type fasteners (such as zip-top or Ziploc type elements), allowing the pocket inlet 380 to be closed or substantially sealed when the fastener elements 397 are pressed together. The above-described tabs 388, 390 can facilitate opening or unsealing the fastener elements 397 to open the pocket inlet 380. In alternate embodiments, other zipper fasteners, hook and loop fasteners, or snap fasteners may be included on or adjacent the first pocket panel 382 and second pocket panel 384 to enable opening and closing of the pocket inlet 380. In yet other alternate embodiments, the pocket inlet 380 does not include fastener elements. More specifically, in such embodiments, pocket inlet 380 need not include a dedicated closure and instead can be substantially closed or covered by door 392 and flap 398, as further described below.

Pack 304 can incorporate a latch assembly for releasably securing door 392 to pack 304 when door 392 is in its closed position, and which enables door 392 to be repeatedly opened and closed. As shown in FIGS. 16-19, pack 304 can include a flap 398 extending from the first end edge 372 of the base 364 (e.g., opposite the proximal extremity 394 of the door 392 at the second end edge 374 of the base 364). Flap 398 includes a proximal extremity 400 and a distal extremity 402. Proximal extremity 400 can be mounted or coupled to first pocket panel 382 with stitching, heat bonding, adhesive, or the like or, alternatively, can be integral with base 364 (e.g., formed as an extension of first pocket panel 382 or other paneling of inner or outer sides 366, 368 of base 364). The inherent material characteristics of flap 398 enables flap 398 to pivot at proximal extremity 400 between an open position away from door 392 in FIGS. 17-19, and a closed position over door 392 (when door 392 is in the closed position) in FIGS. 13 and 16. The latch assembly further includes a hook and loop fastener having an element 403 thereof carried by distal extremity 402 of flap 398, and a complemental element 404 thereof carried by distal extremity 396 of door 392 (shown in FIGS. 13 and 16). Thus, in the closed position, door 392 is positioned partially over windowed pocket 306 and flap 398 is positioned over a portion of door 392, engaging elements 403, 404 and preventing door 392 from swinging down away from windowed pocket 306. In alternate embodiments, the latch assembly can include snap fasteners, a zipper fastener, or other suitable fastening elements.

Latch assembly for door 392 can also serve as a latch or fastening assembly for pocket inlet 380. For example, when latch assembly secures door 392 to pack 304 when door 392 is in closed position, door 392 and flap 398 substantially cover pocket inlet 380. Accordingly, door 392 can be in open position, opening the pocket inlet 380 to enable mobile device 230 to be selectively inserted into windowed pocket 306 through pocket inlet 380 and selectively withdrawn from windowed pocket 306 through pocket inlet 380, according to the principle of the invention. In some embodiments, latch assembly can serve as a fastening assembly for pocket inlet 380 secondary to fastener elements 397 described above, or in place of fastener elements 397.

To employ pack 304 with mobile device 230, mobile device 230 is taken up, such as by hand, and applied sideways into windowed pocket 306 through pocket inlet 380 so as to juxtapose touchscreen 231 and camera 232 with windowed pocket 306 (as shown in FIG. 22) to enable the viewing and the touching of touchscreen 231 and the taking of still pictures and video with camera 232 in the operation of mobile device 230 via sheet 387 of transparent material of windowed pocket 306. The shape of windowed pocket 306 corresponds to the shape of mobile device 230 to ensure mobile device 230 is held snugly by windowed pocket 306. Notably, in contrast to pack 52 of FIGS. 1-12, which provides for an upright orientation of mobile device 230 (e.g., providing a portrait field-of-view of camera 232), pack 304 may permit a sideways orientation of mobile device 230 (e.g., providing a landscape field-of-view of camera 232).

Accordingly, mobile device 230 is oriented in place in windowed pocket 220 in an operative position so as to juxtapose touchscreen 231 and camera 232 with windowed pocket 306 to enable the viewing and touching of touchscreen 231 and the taking of pictures and video in the operation of mobile device 230 via sheet 337 of transparent material. Additionally, mobile device 230 is oriented in place in windowed pocket 220 in an operative position so as to juxtapose camera 232 with an uncovered portion 406 of windowed pocket 306 (i.e., when door 392 is in closed position) to enable taking of pictures and video in the operation of mobile device 230 via sheet 337 of transparent material when the door 392 is in closed position. In other words, door 392 does not hinder field-of-view of camera 232 while in open position or closed position. The uncovered portion 406 may be on the right side, as in the arrangement shown in FIG. 21, or the left side, as in the arrangement shown in FIG. 21A.

Pack 304 is configured or otherwise adapted to be coupled to, and carried by, harness 302. For example, base 308 of harness 302 may be considered in an open position in FIG. 15 when pack 304 (not shown in FIG. 15) is detached from inner side 312 base 308, that is, when fastener elements 326 are detached from complemental fastener elements 328 of pack 304. Referring in relevant part to FIGS. 13-15, to attach pack 304 to base 308 from the open position of base 308, inner side 366 of pack 304 is superimposed atop inner side 312 of base 308 so as to juxtapose first end edge 372 of pack 304 with first end edge 318 of base 308, so as to juxtapose second end edge 374 of pack 304 with second end edge 320 of base 308, so as to juxtapose first side edge 376 of pack 304 with first side edge 322 of base 308, and so as to juxtapose second side edge 378 of pack 304 with second side edge 324 of base 308. After so positioning pack 304 on base 308, in which base 308 and pack 304 are axially aligned, base 308 and pack 304 are pressed together to engage fastener elements 326, 328 and to releasably couple pack 304 to base 308.

Additionally, to further attach pack 304 to harness 302, female buckle members 334 of buckles 330E, 330F, which are coupled to pack 304, are coupled releasably to male buckle members 332 of buckles 330E, 330F, which are coupled to left and right shoulder straps 336, 338 of strap assembly 310, as described above. More specifically, as shown in FIG. 13, connecting strap 408 is attached to first end edge 372 proximate to first side edge 376 and is coupled to female buckle member 334 of buckle 330E. Male buckle member 332 of buckle 330E is coupled releasably to female buckle member 334 of buckle 330E, and left shoulder strap 336 extends rearwardly from male buckle member 332 of buckle 330E, through strap adjuster 354A, toward tie-down ring 344. Connecting strap 410 is attached to first end edge 372 proximate to second side edge 378 and is coupled to female buckle member 334 of buckle 330F. Male buckle member 332 of buckle 330F is coupled releasably to female buckle member 334 of buckle 330F, and right shoulder strap 338 extends rearwardly from male buckle member 332 of buckle 330F, through strap adjuster 354C, toward tie-down ring 344.

To detach pack 304 from harness 302, the foregoing pack installation method need only be reversed. Pack 304 can be so repeatedly attached and detached relative to harness 302. Furthermore, pack 304 can be independently attached and detached relative to base 308 or strap assembly 310. For example, pack 304 can be attached to harness 302 only via base 308, as described above. Alternately, pack 304 can be attached to harness 302 only via strap assembly 310, as described above and shown in FIG. 22. The latter attachment allows pack 304 to be moved relative to base 308, for example, to permit a wearer to view the windowed pocket 306 and interact with the touchscreen 231 of the mobile device 230 when harness is worn by wearer 170, as shown in FIG. 22.

Figure 13A:
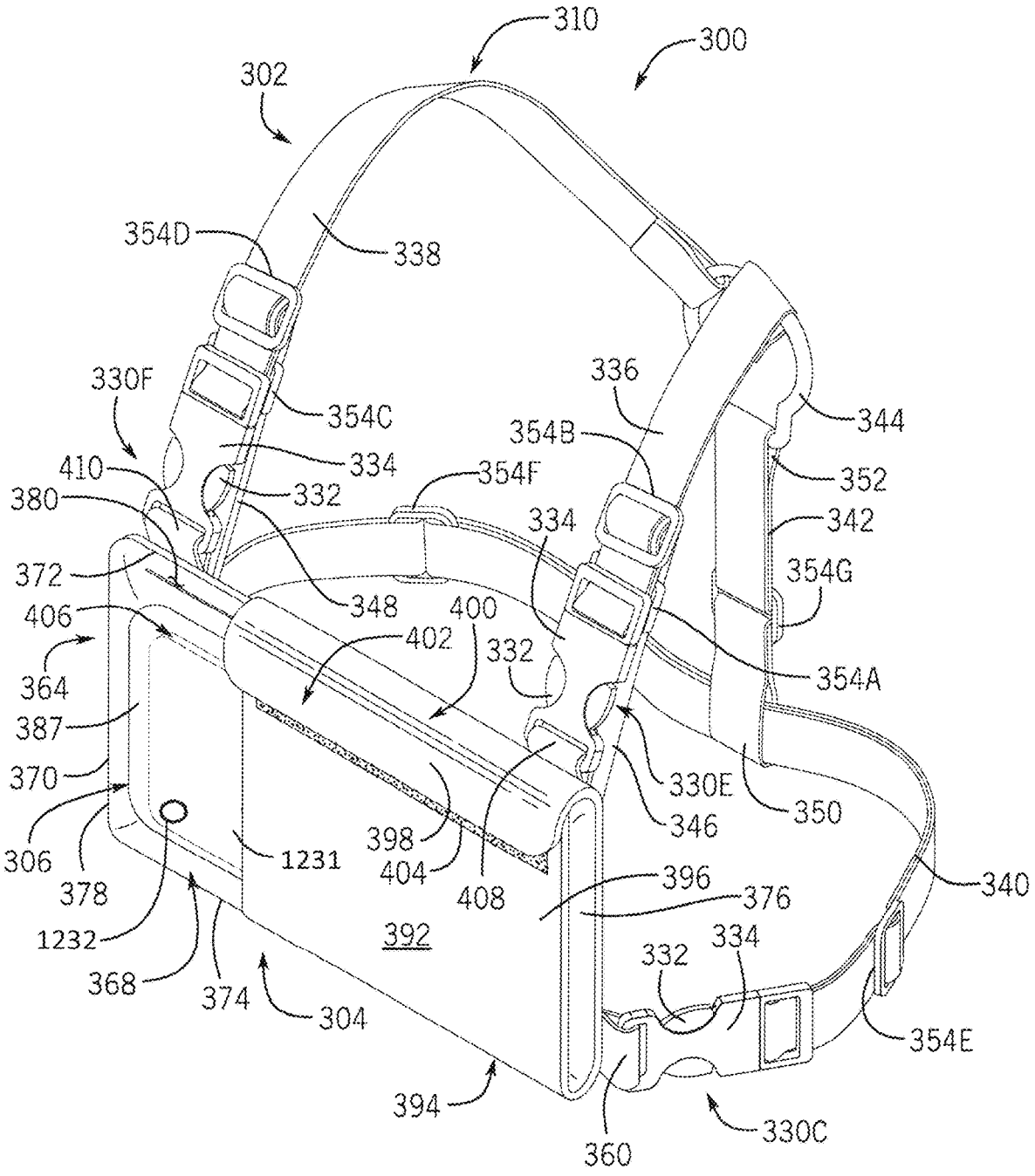
FIG. 13A is a front perspective view of the wearable pack assembly of FIG. 13, with the windowed pocket containing a mobile phone with a front-facing camera oriented outward.

When mobile device 230 is inserted into windowed pocket 220 and pack 304 is coupled removably to harness 302 and door 392 is secured in its closed position in FIG. 13, pack assembly 300 is ready for use to employ mobile device 230 usefully as a body camera for taking still pictures and video with camera 232 for recording the wearer's interactions with the environment and others, according to the principle of the invention. In another embodiment, shown in FIG. 13A, the mobile device 230 may additionally or alternatively have a front-facing camera 1232 disposed on a rear surface 1231 of the mobile device 230 (and thus facing the opposite direction of the rear-facing camera 232 disposed, with the touchscreen 231, on the front surface of the mobile device 230); the wearer, desiring to capture images or video with the front-facing camera 1232, may deposit the mobile device 230 into the windowed pocket 220 with the rear surface 1231 and front-facing camera 1232 facing outward.

Referring again to FIGS. 21-23, as described above, base 308 of harness 302 may be configured to be positioned against the chest of the upper torso of the wearer for holding pack 304 ahead of the chest of the upper torso of the wearer with windowed pocket 306 facing outwardly relative to the chest of the upper torso of the wearer. Outer side 314 of base 308 positioned against chest 171 of wearer 170, left shoulder strap 336 extends over left shoulder 172 of wearer 170 from base 308 to tie-down ring 344 centered along the upper part of back 174 of wearer 170, right shoulder strap 338 extends over right shoulder 173 of wearer 170 from base 308 to tie-down ring 344 centered along the upper part of back 174 of wearer 170, waist strap 340 extends over left waist 175 (or chest) of wearer 170 from base 308, through back strap 342 centered along the lower part of back 174 of wearer 170, and over right waist 176 (or chest) of wearer 170 to base 308, and back strap 342 extends downwardly along the center of back 174 of wearer 170 from tie-down ring 344 to waist strap 340, when harness 302 is worn by wearer 170. From this position, door 392 can be selectively opened to enable wearer 170 to view and touch touchscreen 231 and take pictures and video with camera 232 in the operation of mobile device 230 via sheet 387 of transparent material of windowed pocket 306 as a body camera for recording the wearer's interactions with the environment and others with camera 232. Furthermore, door 392 partially covers windowed pocket 306 and protects mobile device 230 applied therein, and uncovered portion 406 of windowed pocket 220 is juxtaposed with camera 232 for enabling the use of mobile device 230 as a body camera, namely, for the taking of pictures and video with camera 232 when door 392 is in the closed position, when the mobile device 230 is received in windowed pocket 306, and when touchscreen 231 and camera 232 are juxtaposed with windowed pocket 306. Thus, camera functionality of mobile device 230 is enabled when door 392 is in open and closed positions.

Figure 24C:
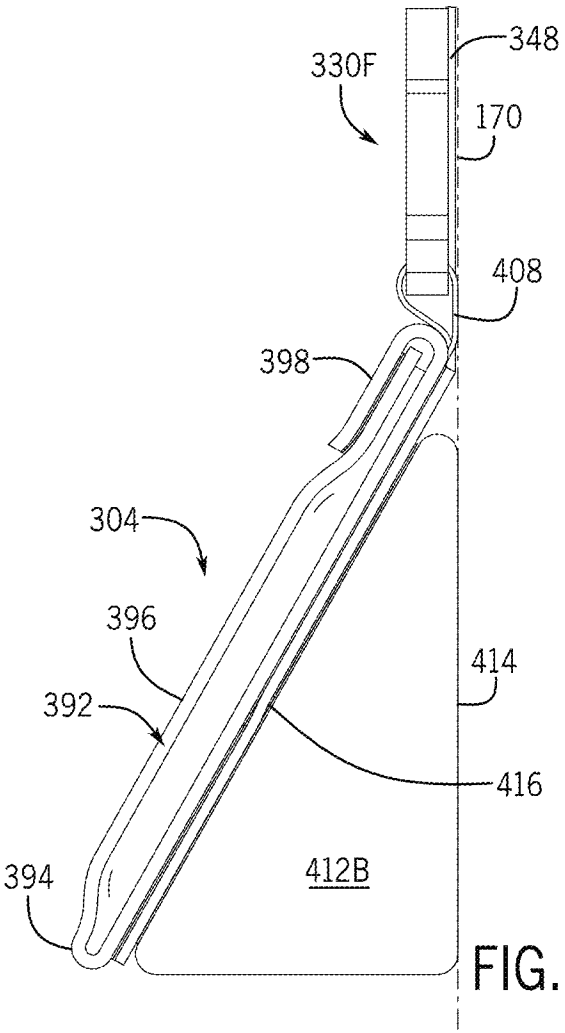
FIG. 24A is a partial section view of the pack assembly taken on line 24-24 of FIG. 21.
FIGS. 24B,C are section views of the pack assembly taken along line 24-24 of FIG. 21 and showing different configurations of a spacer for the pack assembly.
Figure 24B:
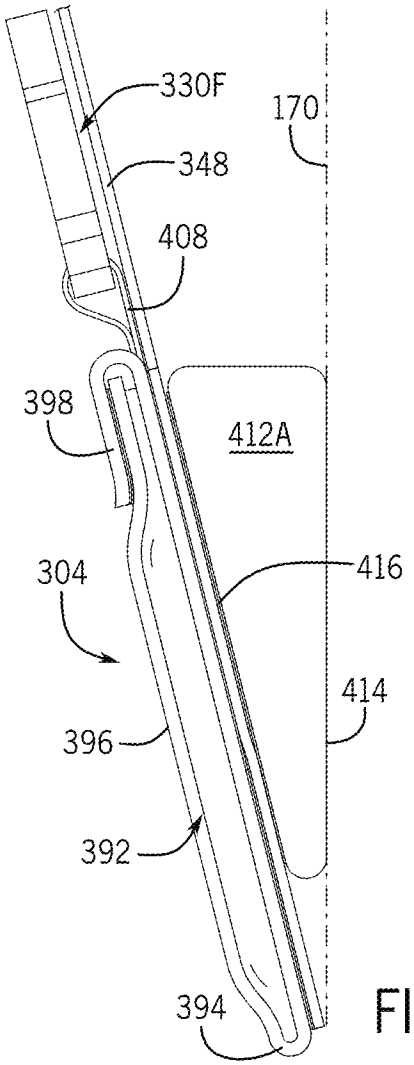
Figure 24A:
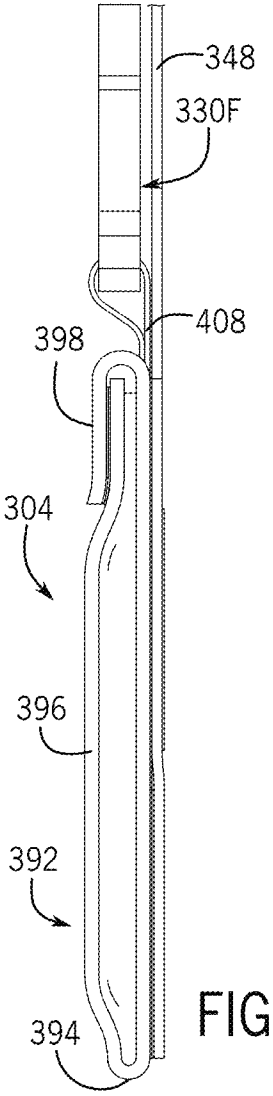

Additionally, pack assembly 300 can incorporate one or more spacers 412 configured to tip the pack 304 relative to the chest of the wearer. For example, FIG. 24A is a sectional view of pack assembly 300 corresponding to line 24-24 of FIG. 21. FIG. 24B is a view corresponding to FIG. 24A illustrating a first spacer 412A coupled to outer side 314 of base 308 of harness 302, tipping/tilting pack 304 downwardly relative to chest of wearer 170 for concurrently tipping mobile device 230 held by pack 304 downwardly relative to wearer 170 when mobile device 230 is inserted into windowed pocket 306. FIG. 24C is a view corresponding to FIG. 24A illustrating a second spacer 412B coupled to outer side 314 of base 308 of harness 302, tipping/tilting pack 304 upwardly relative to chest of wearer 170 for concurrently tipping mobile device 230 held by pack 304 upwardly relative to wearer 170 when mobile device 230 is inserted into windowed pocket 306.

In FIGS. 24B and 24C, spacers 412 can be wedge-shaped (e.g., having a substantially triangular cross-section) and made of foam, plastic, or the like. Furthermore, spacers 412 can include different sizes. For example, FIG. 24B includes a first size spacer 412A (e.g., a smaller size) and FIG. 24C includes a second size spacer 412B (e.g., a larger size). Additional sizes may be available in further embodiments. A wearer can select a particular sized spacer 412 based on preference and needs. For example, size of spacer 270 can be chosen to increase and decrease the down-angled and the up-angled field of view of camera 232 of mobile device 230.

As noted above, spacers 412 can be wedge-shaped. For example, spacers 412 can include a first straight side 414 and a second angled side 416. Straight side 414 can be configured to rest against chest 171 of wearer 170 when spacer 412 is used with the pack assembly 300, and angled side 416 can be coupled to base 308 of harness 302, for example, with an engagement mechanism. As discussed above, in one embodiment, engagement mechanism can be a hook and loop fastener mechanism. As shown in FIG. 14, an elongate strip of hook and loop fastener 325 can be applied across outer side 314 of base 308, from first side edge 322 to second side edge 324. A complementary hook and loop fastener (not shown) can be applied across angled side 416 so that fasteners 325 are engaged when angled side 416 is pressed against outer side 314 of base 308, as shown in FIGS. 24B and 24C. The complementary hook and loop fastener can be applied to the angled side 416 at a location that permits engagement with the base 308 when spacer 412 is in a first orientation (e.g., to permit downward tilting, as shown in FIG. 24B), or when spacer 412 is flipped in a second orientation (e.g., to permit upward tilting, as shown in FIG. 24C). In other embodiments, a plurality of smaller strips or squares of hook and loop fastener can be positioned along outer side 314 and angled side 416. Furthermore, in other embodiments, other engagement mechanisms may be contemplated.

Accordingly, spacer 412 can be selectively installed against base 308 for providing a selected down-angled or up-angled field of view of camera 232 as desired by the wearer of pack assembly 300. More specifically, pack 304 and mobile device 230 held by pack 304 are concurrently tipped/tilted downwardly relative to chest 171 of wearer 170 in FIG. 24B when spacer 412 is applied to base 308 in a first orientation, when mobile device 230 is carried by pack 304, when pack 304 is coupled to base 308 of harness 302, and when harness 302 is worn by the upper torso of the wearer 170, so as to provide a selected down-angled field of view of camera 232 as desired by the wearer of pack assembly 300. Furthermore, pack 304 and mobile device 230 held by pack 304 are concurrently tipped/tilted upwardly relative to chest 171 of wearer 170 in FIG. 24C when spacer 412 is applied to base 308 in a second orientation, when mobile device 230 is carried by pack 304, when pack 304 is coupled to base 308 of harness 302, and when harness 302 is worn by the upper torso of the wearer 170, so as to provide a selected up-angled field of view of camera 232 as desired by the wearer of pack assembly 300. Additionally, other types of spacers can be contemplated for use with the pack assembly 300 in other embodiments.

Figure 25:
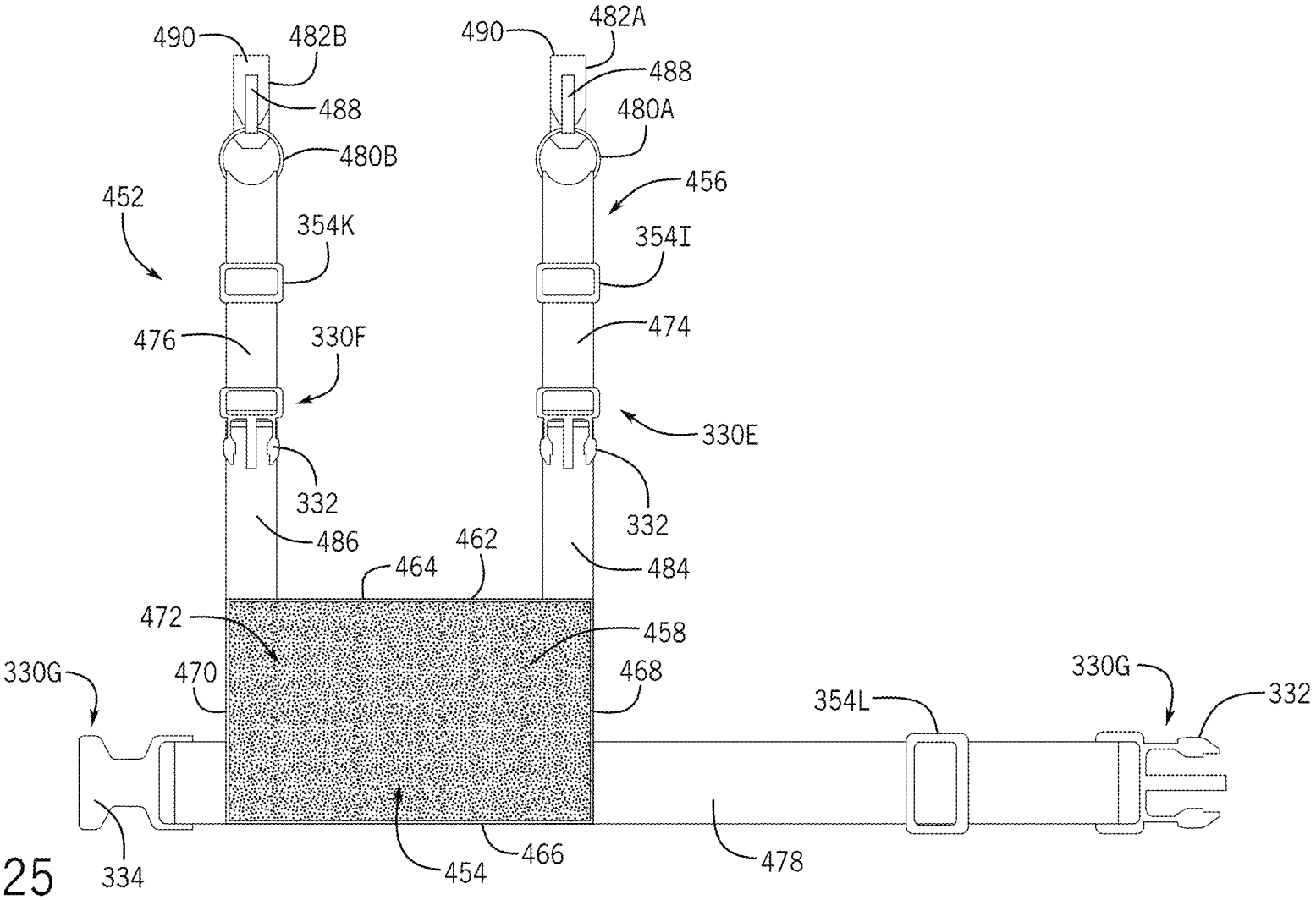
FIG. 25 is a front view of an example harness of the pack assembly of FIG. 13.
Figure 26:
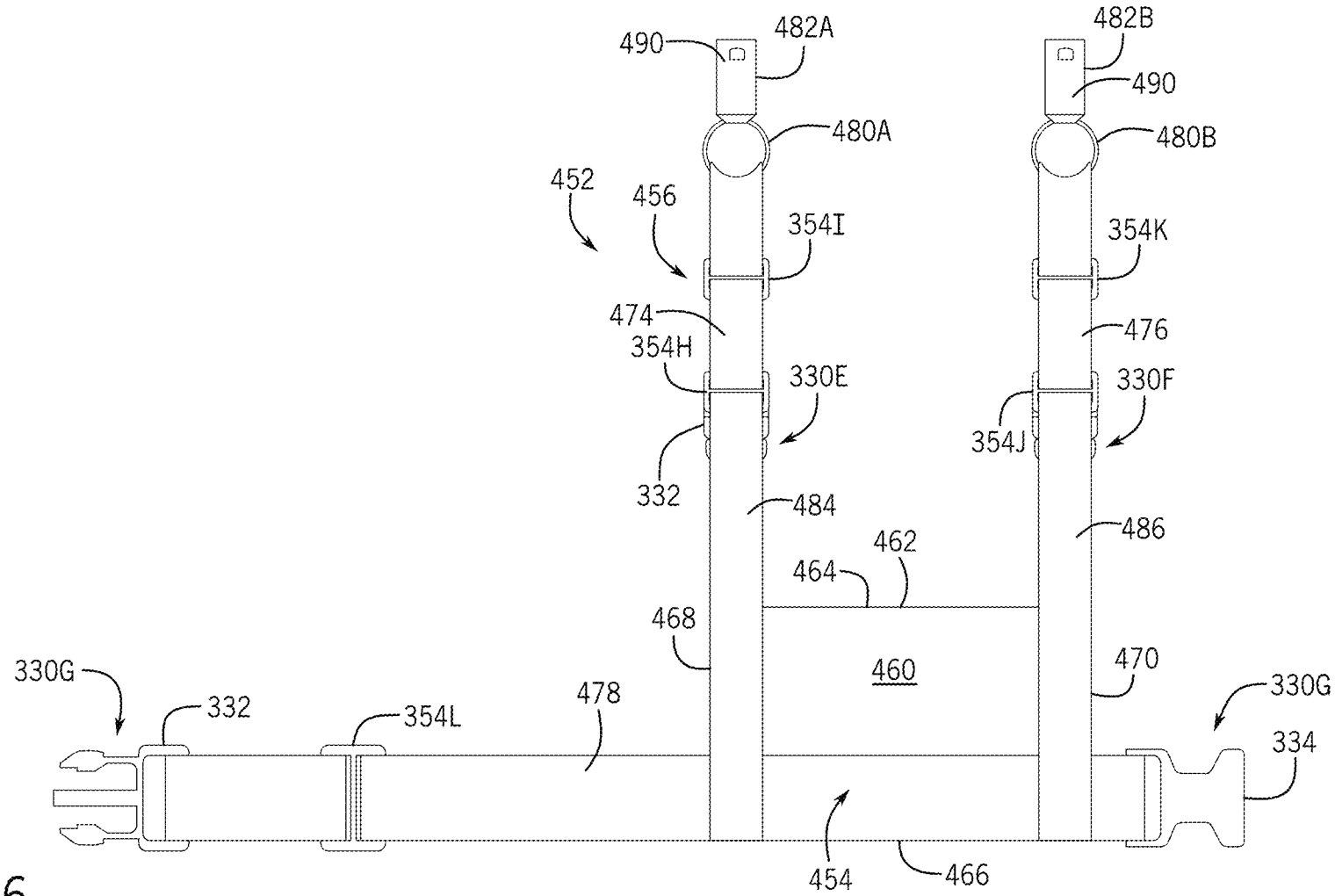
FIG. 26 is a rear view of the harness of FIG. 25.
Figure 39:
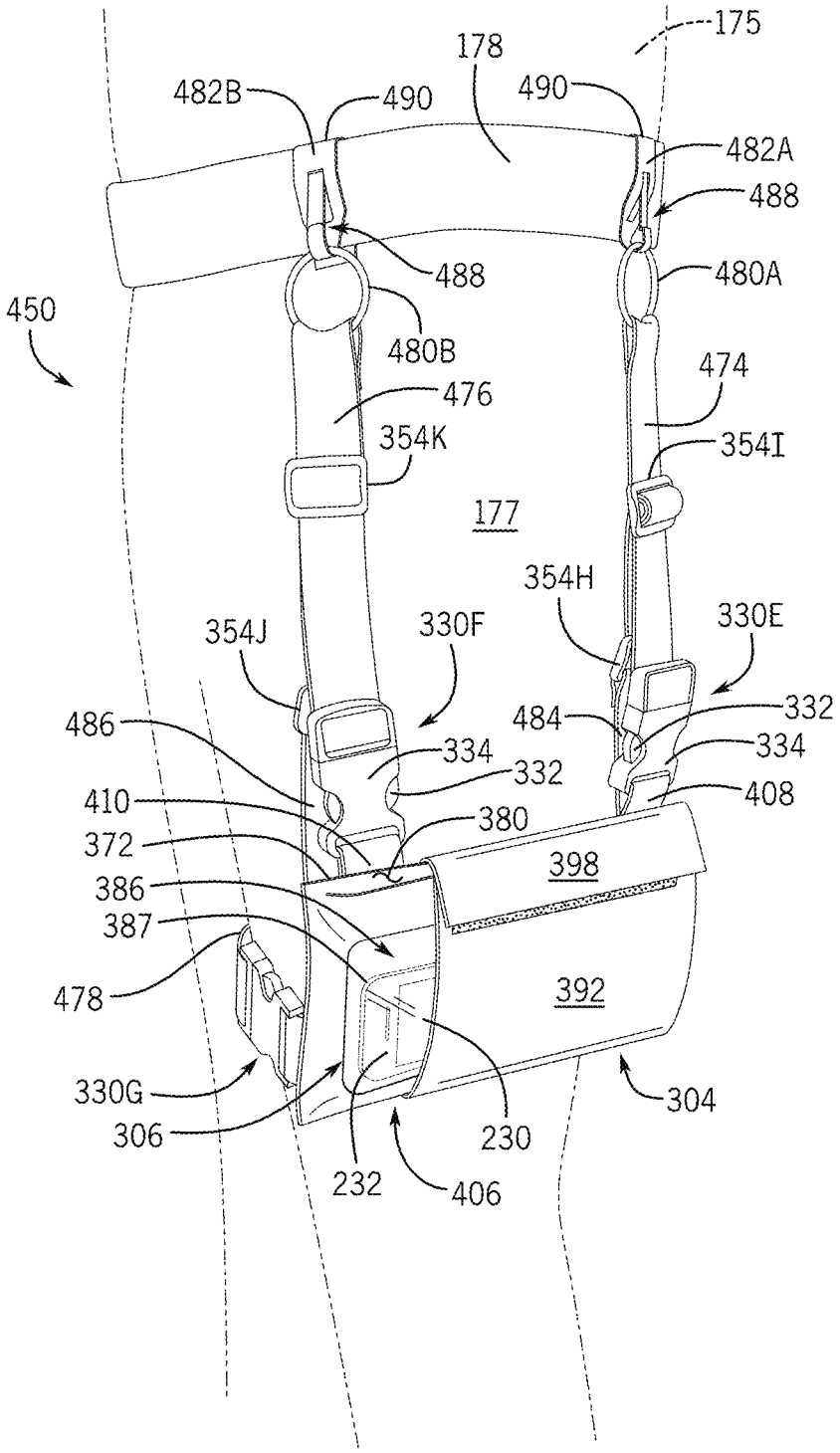
FIG. 39 is a front perspective view of the pack assembly of FIG. 13 worn in the closed on a wearer's leg.
Figure 40:
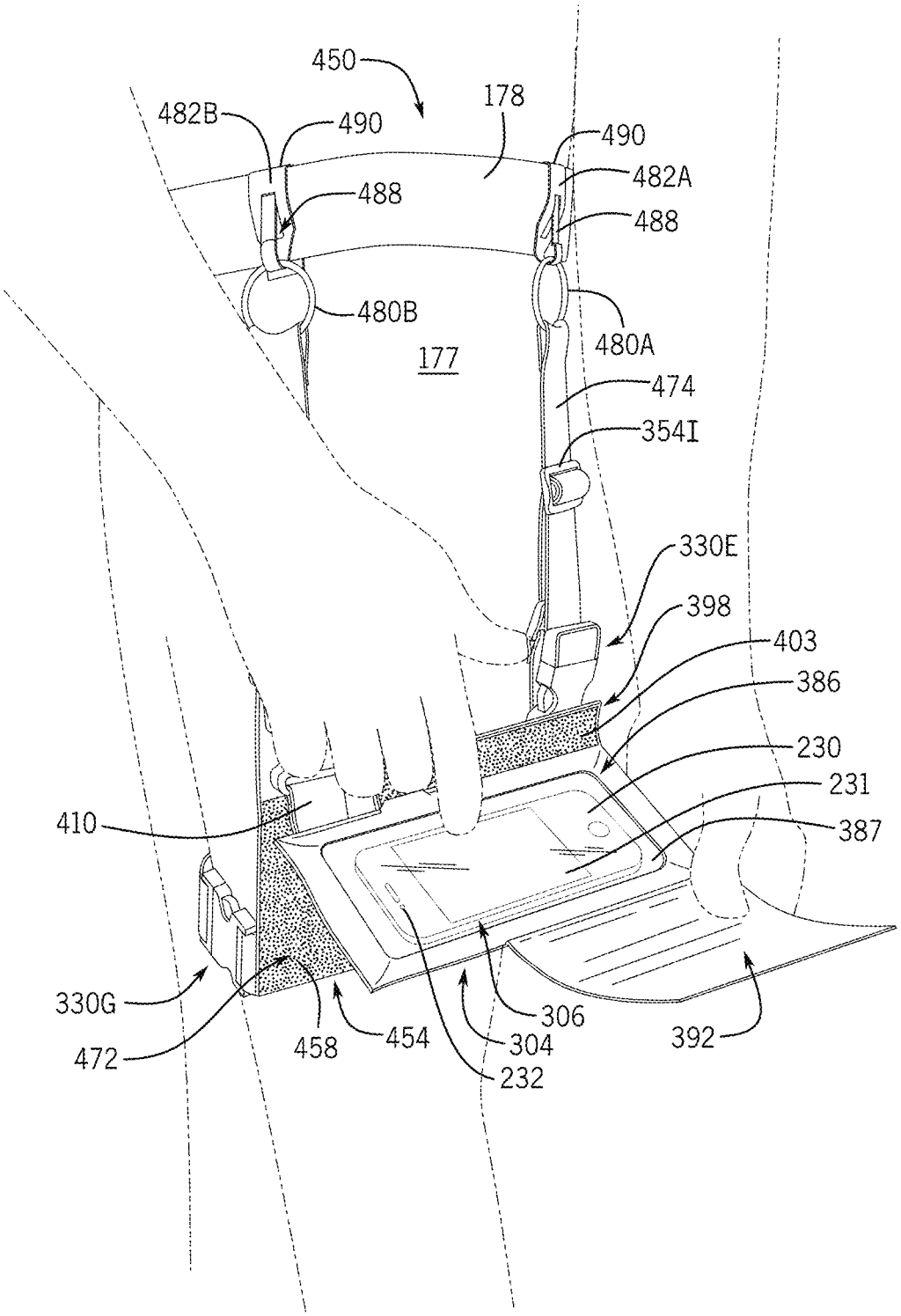
FIG. 40 is a front perspective view of the pack assembly of FIG. 13 worn in the open position on the wearer's leg and held by the wearer so the wearer can manipulate the touchscreen.

FIGS. 25 and 26 illustrate another embodiment of a harness 452 for a wearable pack assembly as described above. Harness 452 may be configured to hold a pack (e.g., pack 304 of FIG. 16) against a leg of a wearer with the pack's windowed pocket facing outwardly relative to the leg of the wearer, enabling the wearer to usefully employ the camera of the mobile device as a body camera for recording a wearer's interactions with the environment. For example, the harness 452 may position the pack on a "downhill side" of the wearer's leg, as shown in FIGS. 39-40, so the mobile device captures point-of-view images and/or video while the wearer is snowboarding.

The harness 452 can include a base 454 and strap assembly or system 456. The base 454 can be flat and generally rectangular in overall shape. In some embodiments, the base 454 is a panel assembly including a panel covered with outer layering consisting of one or more layers of material, similar to that described above with respect to base 60 of FIGS. 1-12. For example, panel is upholstered with outer layering, which encloses panel and defines the major sides and peripheral edge of base 454, as described below. Base 454 can include inner side 458 and opposed outer side 460, and peripheral edge 462. As shown in FIG. 25, peripheral edge 462 can be defined by first end edge 464 and opposed second end edge 466, and first side edge 468 and opposed second side edge 470 that extend from the first end edge 464 to second end edge 466. First and second end edges 464 and 466 are parallel with respect to each other, and first and second side edges 468 and 470 are parallel with respect to each other and are orthogonal with respect to first and second end edges 464 and 466. Base 454 therefore has a length from first end edge 464 to second end edge 466 and a width from first side edge 468 to second side edge 470. As shown, the length of base 454 can be shorter than the width of base 454, characterizing the generally rectangular shape of base 454. Furthermore, base 454 can be generally the same shape as pack 304 and/or same shape and size as base 308 of FIGS. 13-24.

Pack assembly 450 can include an engagement assembly for removably coupling pack 304 to base 454. For example, the engagement assembly includes a hook and loop fastener 472 on the inner side 458 of the base 454, as shown in FIG. 25, configured to engage a mating hook and loop fastener 328 on the pack 304, as shown in FIG. 18 and as further described below. In alternate embodiments, the hook and loop fasteners 472, 328 can be button fasteners, snap fasteners, or the like. Additionally, the engagement assembly includes buckles 330, similar to buckles 145 described above. For example, the harness 452 can include male buckle members 332 and the pack 304 can include female buckle members 334 configured to engage the male buckle members 332 of the harness 452, as further described below, to removably couple pack 304 to base 454. Strap assembly 456 may be connected to base 454, is used to strap base 454 to the leg of the wearer, and includes left and right upper straps 474, 476 and a leg strap 478. Leg strap 478 can be connected in a loop via buckle 330G, and left and right upper straps 474, 476 can be coupled to a wearer's pants or belt 178 (as shown in FIGS. 39-40) via rings 480 detachably coupled to hook members 482. However, other buckles, fastening, or attachment mechanisms may be used in other embodiments. Straps 474-478 are each fashioned of leather, tightly woven nylon, canvas, or other material or combination of materials having the properties of flexibility, resilience, tear-resistance, and ruggedness, and are conventionally length-adjustable straps. Additionally, different straps can incorporate different materials. For example, in some embodiments, one or more of straps 474-478 are fashioned of an elastic material, while one or more of connecting straps of strap assembly 456 (described below) are fashioned of a non-elastic webbing material.

Left and right upper straps 474, 476 can be coupled to first end edge 464 (e.g., at either end thereof), and to respective rings 480 detachably coupled to hook members 482. Leg strap 478 extends from first side edge 468 and second side edge 470, for example, near second end edge 466 and is connected together with buckle 330G. More specifically, left connecting strap 484 is attached to base 454 near first side edge 468, extends upward from first end edge 464, and is coupled to (e.g., looped through) a strap adjuster 354H. Left connecting strap 484 can extend the length of base 454 from first end edge 464 to second end edge 466. However, in other embodiments, left connecting strap 484 is coupled to first end edge 464. Left upper strap 474 is routed through strap adjuster 354H and includes male buckle member 332 at its forward end that is part of the engagement assembly described above (e.g., of buckle 330E). Left upper strap 474 extends upwardly from strap adjuster 354H and loops around ring 480A, which is further releasably coupled to hook member 482A. Additionally, left upper strap 474 can include an additional strap adjuster 354I to permit shortening or lengthening of left upper strap 474.

Right connecting strap 486 is attached to base 454 near second side edge 470, extends upward from first end edge 464, and is coupled to (e.g., looped through) a strap adjuster 354J. As shown in FIG. 26, right connecting strap 486 can extend the length of base 454 from first end edge 464 to second end edge 466. However, in other embodiments, right connecting strap 486 is coupled to first end edge 464. Right upper strap 476 is routed through strap adjuster 354J and includes a male buckle member 332 at its forward end that is part of the engagement assembly described above (e.g., of buckle 330F). Right upper strap 476 extends upwardly from strap adjuster 354J and loops around ring 480B, which is further releasably coupled to hook member 482B. Additionally, right upper strap 476 can include an additional strap adjuster 354K to permit shortening or lengthening of right upper strap 476. Rings 480 may be releasably coupled to hook members 482. For example, each hook member 482 can be made of plastic, metal, or another suitable material and can include a releasable clasp 488 configured to receive and secure ring 480 to hook member 482. Each hook member 482 also includes a clip portion 490 configured to engage belt 178 or pants of wearer 170 (e.g., similar to a belt clip).

Furthermore, leg strap 478 is connected to base 454 along second end edge 466 and extends rearwardly from both first side edge 468 and second side edge 470. For example, leg strap 478 extends from first side edge 468 and is coupled to (e.g., looped through) male buckle member 332 of buckle 330G. Leg strap 478 also extends from second side edge 470 and is coupled to (e.g., looped through) female buckle member 334 of buckle 330G, which can be releasably coupled to male buckle member 332 of buckle 330G to form a leg strap 478 loop. Alternatively, in some embodiments, leg strap 478 can include two straps separately coupled to and extending from either side edge 468, 470 of base 454. Additionally, leg strap 478 can include one or more strap adjusters 354H to permit shortening or lengthening of leg strap 478.

Figure 27:
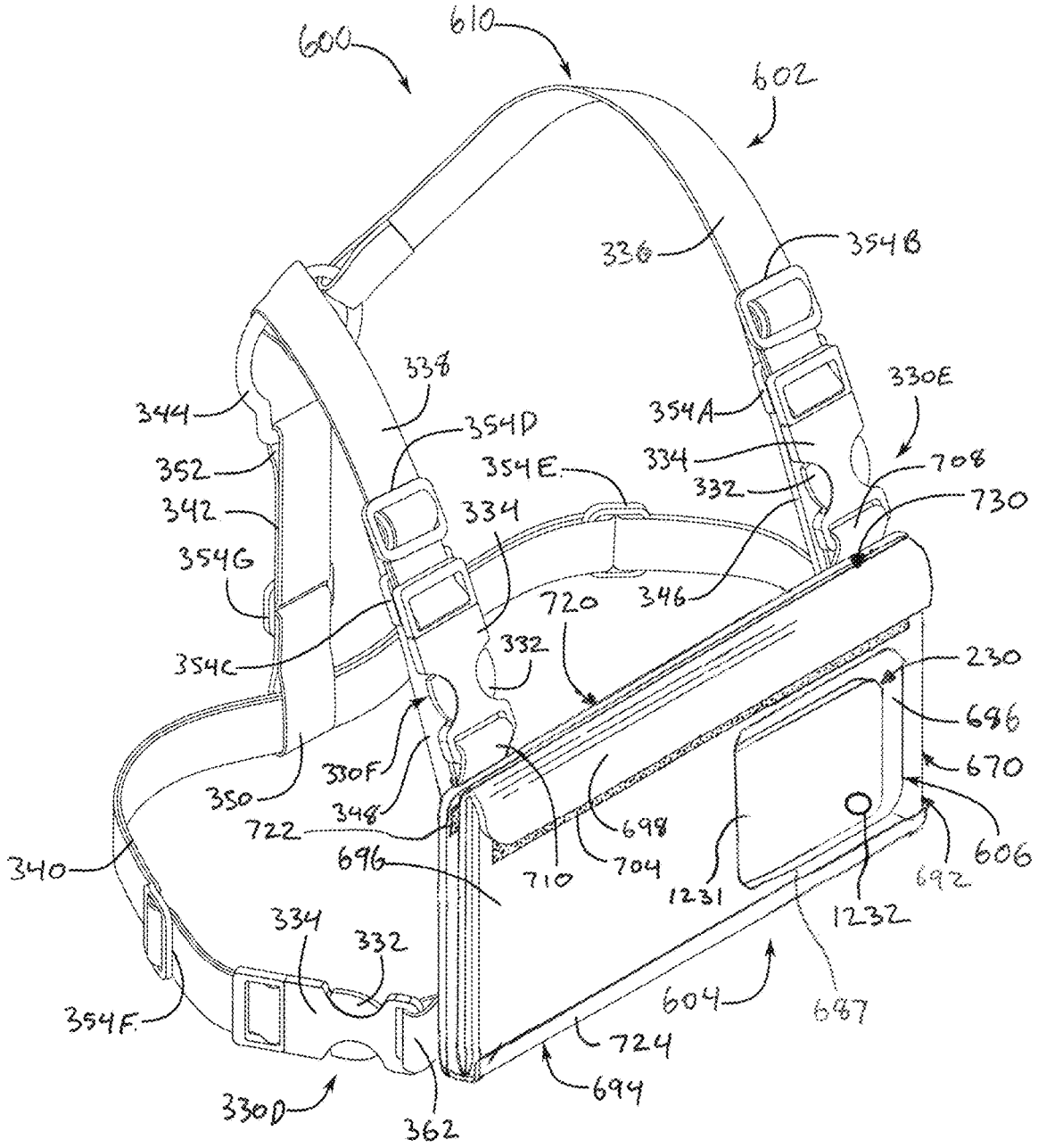
FIG. 27 is a front perspective view of another example embodiment of a wearable pack assembly for a mobile device, with a windowed pocket containing a mobile phone with a front-facing camera oriented outward.
Figure 28:
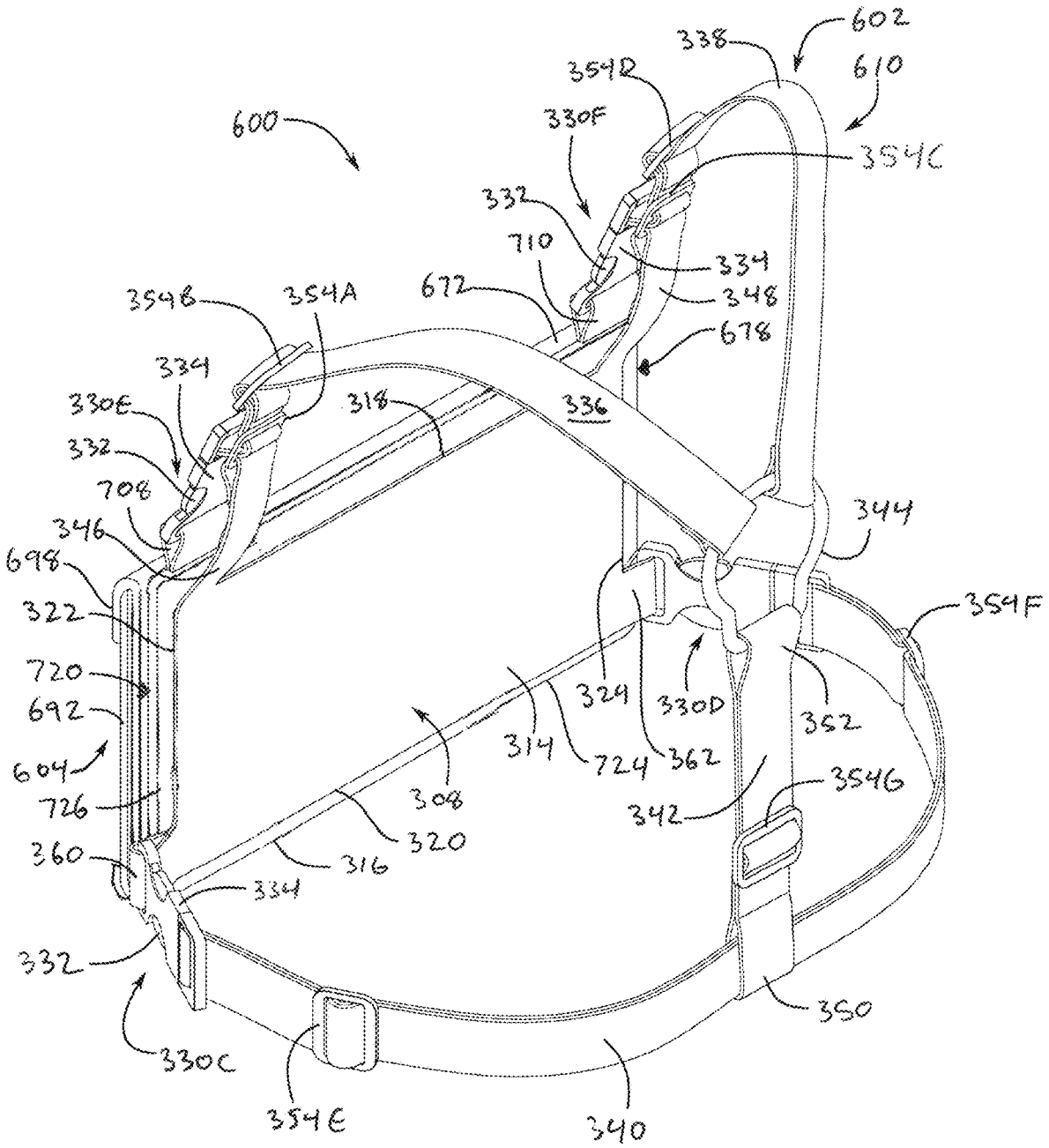
FIG. 28 is rear perspective view of the pack assembly of FIG. 27.

Referring to FIGS. 27 and 28, another embodiment of a wearable pack assembly 600, including a harness 602 and a pack 604, may be particularly configured to enable a wearer of the pack assembly 600 to capture images and video using the forward-facing camera 1232 of the mobile device 230. In this orientation, the pack 604 carries the mobile device 230 with its rear surface 1231 facing outward with respect to the wearer; the mobile device's 230 front surface (not shown), comprising the touchscreen and, optionally, a rear-facing camera as well as buttons and other interface components, faces inward with respect to the wearer. The pack 604 includes an envelope 686 formed from one or more sheets of waterproof, transparent material that is transmissive of a capacitance, so that when the mobile device 230 is contained in the envelope 686: 1) the camera 1232 or cameras capture clear, unobstructed images and video through the envelope 686; 2) the mobile device 230 is protected from moisture damage; and, 3) the wearer can manipulate the touchscreen through the envelope 686.

Figure 35:
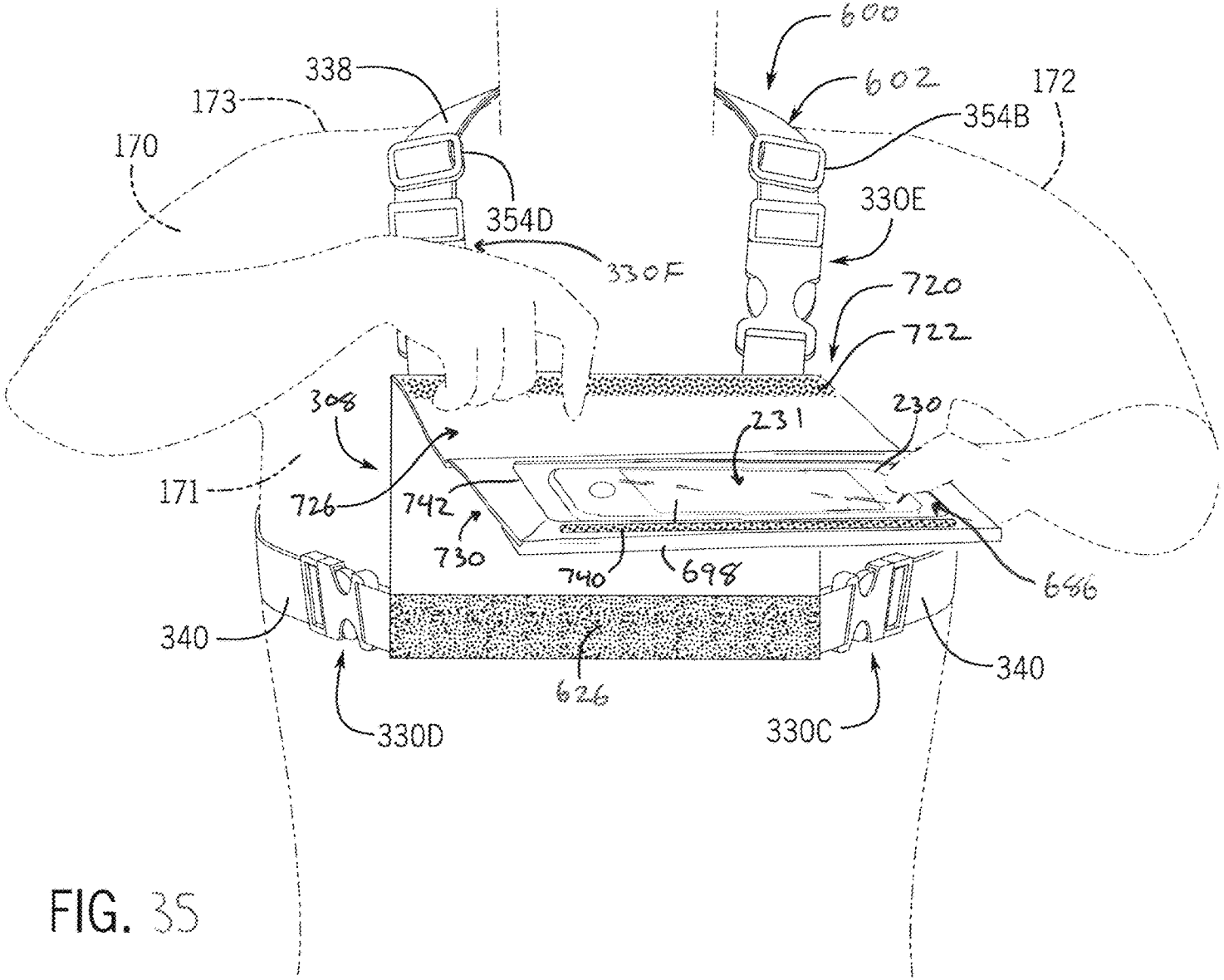
FIG. 35 is a front perspective view of the pack assembly of FIG. 27 worn and held in an extended position by the wearer, so the wearer can manipulate a mobile device touchscreen oriented inward.

The pack 604 may include an extension panel 720 and an envelope platform 730 permanently or removably attached to the extension panel 720. The extension panel 720 may be a rigid or semi-rigid planar member; preferably, the extension panel 720 has some flexibility, so as not to break apart or injure the wearer in reaction to an impact, but is sufficiently rigid and has a suitable thickness to support the envelope platform 730 when the wearer unfolds the pack 604 into an extended position, as shown in FIG. 35. In non-limiting examples, the extension panel 720 may be a fabric-covered sheet of cardboard or plastic. The height and width of the extension panel 720 may match those of the envelope platform 730, so that the platforms 720, 730 together define a peripheral edge 670 of the pack 604 extending around its perimeter.

In one embodiment, the extension panel 720 may be permanently attached to, or integral with, the envelope platform 730 at a bottom edge 694 of the pack 604. For example, a fabric covering may be disposed over both platforms 720, 730; or, corresponding fabric coverings of the platforms 720, 730 may be stitched together, or a strip of connecting material (similar to connecting flap 724, described below) may be stitched or otherwise attached to the platforms 720, 730, at the bottom edge 694. In other embodiments, such as illustrated, the envelope platform 730 may be removably attached to the extension panel 720. In one embodiment, the extension panel 720 may include a first fastener 722 disposed near a top edge of the body of the extension panel 720, and a second fastener (not shown) disposed approximate a bottom edge of the body of the extension panel 720. In one embodiment, the extension panel 720 may include a connecting flap 724 that extends from the bottom edge of the panel 720 body. The connecting flap 724 may be a flexible material, such as a strip of fabric, and may support one or more fasteners (not shown) as described below. In various embodiments, the envelope platform 730 may include corresponding fasteners that cooperate with the upper fastener 722 and the fastener(s) on the connecting flap 724 to removably attach the envelope platform 730 to the extension panel 720 at the top and bottom edges, as described further below. For example, the platforms 720, 730 may include mating portions of several hook-and-loop fasteners. In this manner, the envelope platform 730 may be detached from the fastener 722 while remaining rotatably attached to the connecting flap 724; the wearer may "swing" the top of the envelope platform 730 away from the extension panel 720, exposing the inward-facing surface (not shown) of the envelope platform 730 as described further below.

The extension panel 720 may further removably attach to the harness 602 in order to mount the pack 604 on the harness 602 for use. There may be one or multiple attachment points, and any suitable attachment mechanism(s) may be used. For example, extension panel 720 is attached approximate its bottom edge to a base 308 of the harness 602, and at its top edge to a strap assembly 610 of the harness 602. In various embodiments, including the illustrated example, the harness 602 may be substantially similar to the harness 302 of FIGS. 13-15, described above; similar or identical components are marked with the same reference numbers as previously used, and reference to the above description is made in place of repeating the description. The extension panel 720 may connect to the base 308 via one or more reattachable fasteners (not shown), such as mating portions of a strip of hook-and-loop fastener material. Harness 602 includes a strap assembly 610 that includes mostly previously-described straps, buckles, and adjusters; however, the strap assembly 610 includes connecting straps 708, 710 that are attached to or integral with the extension panel 720, extending from the top edge of the panel 720 body and connecting to one of the buckle members (e.g., female buckle member 334) of buckles 330E, 330F, respectively, as described above with respect to connecting straps 408, 410 of FIGS. 13-16. In this manner, the extension panel 720 may be detached from the base 308 at the bottom edge while remaining rotatably attached to the strap assembly 610; the wearer may "swing" the bottom of the extension panel 720 away from the base 308, bringing the envelope platform 730 upward and closer to eye-level as described further below.

The envelope platform 730 may include a cover 696 made of a waterproof fabric or other material. The cover 696 may be disposed around part or all of the envelope 686, cooperating with the envelope 686 to form a windowed pocket for containing the mobile device: on the outward-facing side of the envelope platform 730, the cover 696 may cover all but a portion of the envelope 686; an aperture 687 in the cover 696 exposes the envelope 686, forming a first window 606 through which the mobile device 230 can capture images and video, as described above. The first window 606 may be disposed at any suitable position relative to the edges of the cover 696, and is illustrated approximate the left edge 692 of the cover 696 for ease of use of right-handed wearers. In some embodiments, the window 606 may further comprise a waterproof gasket attached to the cover 696 and/or to the envelope 686 in order to seal the aperture 687 from water entering the pack 604 between the cover 696 and the envelope 686.

The cover 696 may further span the inward-facing surface (not shown) of the envelope platform 730; the cover 696 may comprise a single sheet of the waterproof material, or a plurality of sheets of the material stitched together or otherwise attached to form the cover 696 around the envelope 686. The envelope platform 730 may further include a flap 698 of waterproof material. The flap 698 may be integral with the cover 696 and may extend from the inward-facing surface of the cover 696, over an opening in the top of the cover 696 that provides access to the envelope 686 as described below. A mating hook-and-loop fastener or another fastener 704 may removably attach the end of the flap 698 to the outward-facing surface of the cover 696.

Figure 29:
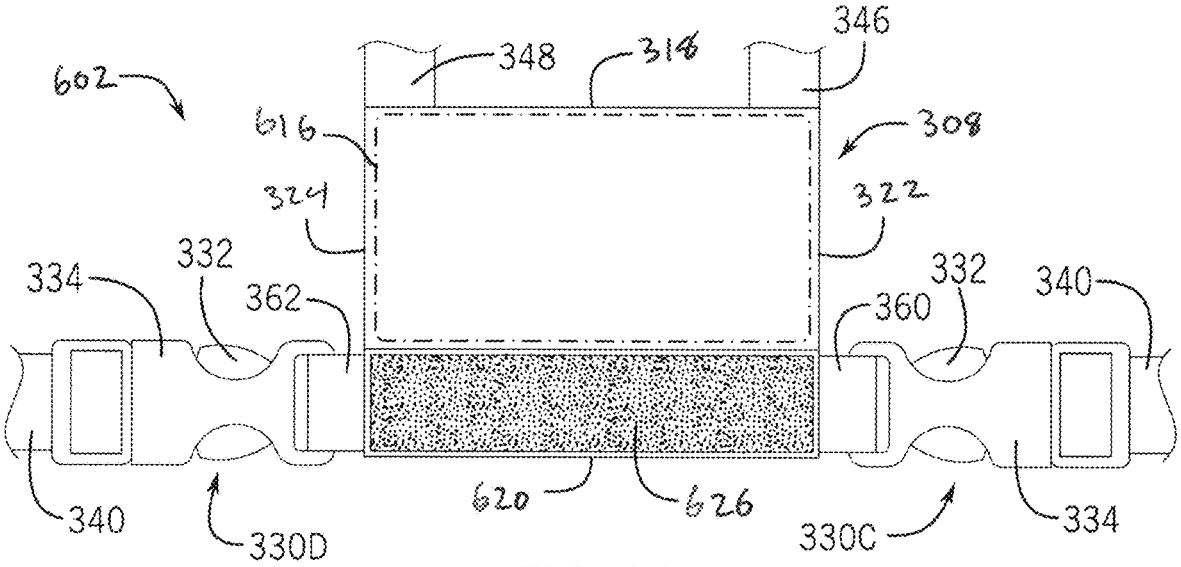
FIG. 29 is a front partial view of a harness and a base of the pack assembly of FIG. 27.

FIG. 29 illustrates the example harness 602. As indicated, the components of the harness 602 are predominantly similar or identical to the components of the harness 302 described above. In addition to the previously-described components, harness 602 may include padding 616 disposed within the base 308 for added comfort of the wearer. Also, instead of a patch of fastening material that substantially covers the base 308 as described above, the harness 602 may include a strip 626 of fastening material (e.g., hook-and-loop material) disposed approximate the bottom edge 620 of the base 308. The strip 626 engages the cooperating fastener on the back of the extension panel, described below, and may be sufficiently wide so as to securely retain the extension panel but allow the wearer to unfasten the extension panel from the strip 626 without difficulty.

Figure 30:
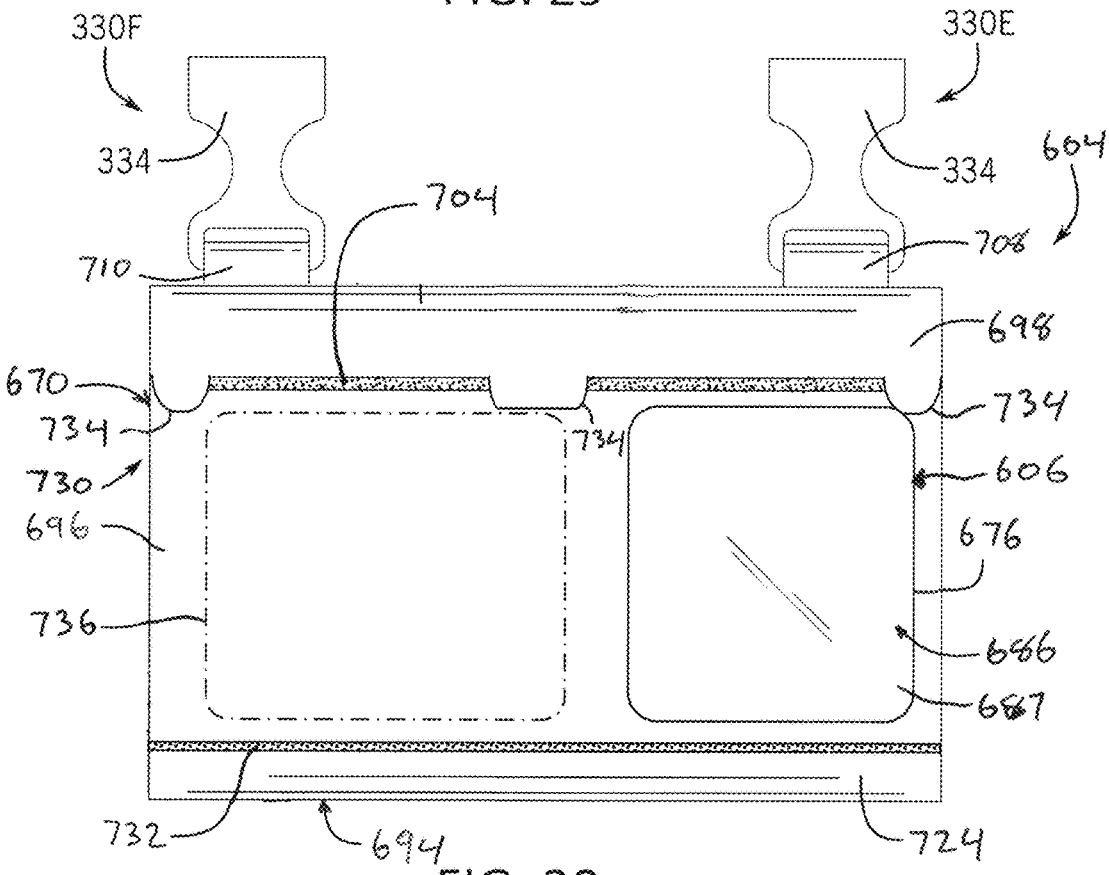
FIG. 30 is a front view of a pack of the pack assembly of FIG. 27, in a closed position.
Figure 31:
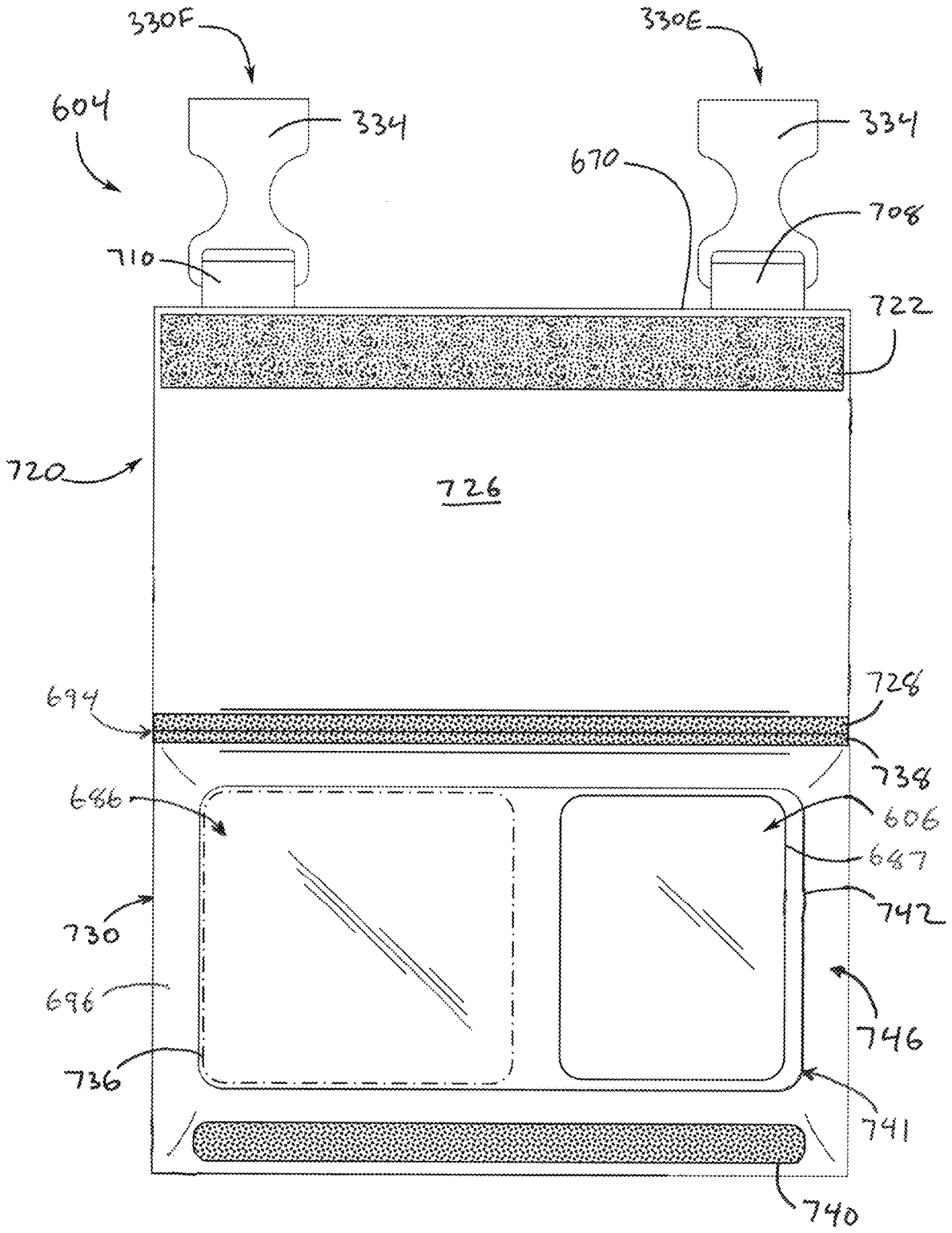
FIG. 31 is a front view of the pack of FIG. 27 in an open position.
Figure 32:
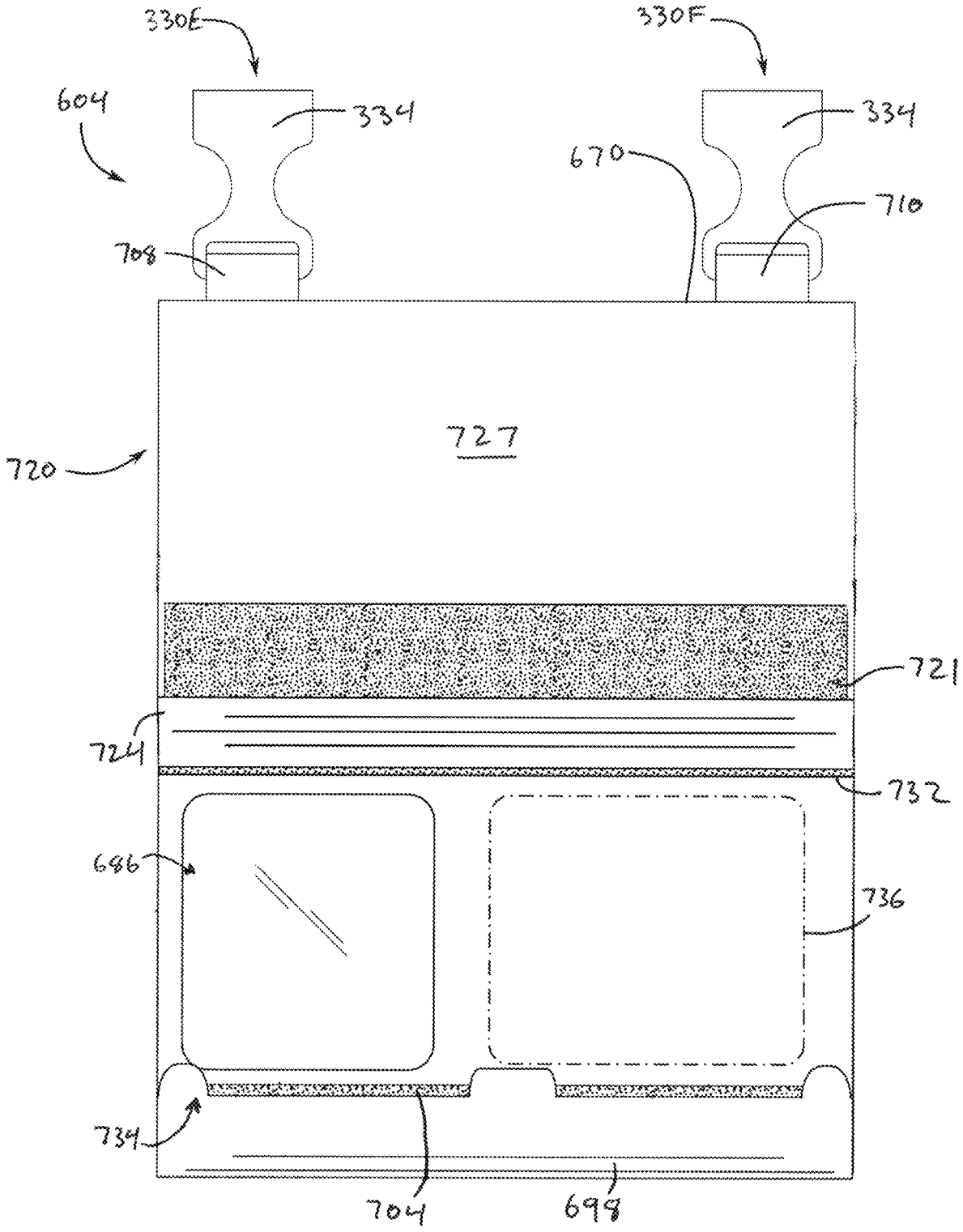
FIG. 32 is a rear view of the pack of FIG. 27 in the open position.

FIG. 30 shows the pack 604 in the closed position, with closer detail of the outward-facing surfaces. In addition to the components described above with respect to FIGS. 27-28, FIG. 30 shows: a fastener 732, such as a strip of hook-and-loop material, disposed on the outward-facing surface of the cover 696 approximate the bottom edge of the envelope platform 730, and connected to the connecting flap 724; a plurality of tabs 734 formed on the end of the flap 698, and sized to make it easier for the wearer to pull the flap 698 open (e.g., if wearing ski gloves); and, padding 736 disposed between the cover 696 and the envelope 686 to protect a contained mobile device from impact damage. In FIGS. 31 and 32, the pack 604 is shown in an open position, achieved by separating a fastener 740 disposed on the inward-facing surface of the cover 696, near the top edge of the envelope platform 730, from the fastener 722 on the outward-facing surface 726 of the extension panel 720, but leaving the platforms 720, 730 attached to each other at the bottom edge 694. In one embodiment, the attachment at the bottom edge 694 may be achieved solely via the attachment of fastener 732 to connecting strap 724; alternatively, and as illustrated, the platforms 720, 730 may further be attached via mating fasteners 728 (on the outward-facing surface 726 of the extension panel 720), 738 (on the inward-facing surface of the cover 696) disposed approximate the bottom edge 694.

An aperture 742 in the inward-facing surface 746 of the cover 696 exposes the inward-facing side of the envelope 686 to form a second window 741. The second window 741 may be large enough to allow the wearer access to the touchscreen and other interface components of the mobile device, and thus the aperture 742 may be substantially larger than the aperture 687 forming in the outward-facing surface of the cover 696. As shown in FIG. 31, when the envelope 686 is empty, the first window 606 may be partially or fully visible through the second window 741. In some embodiments, the window 741 may further comprise a waterproof gasket attached to the cover 696 and/or to the envelope 686 in order to seal the aperture 742 from water entering the pack 604 between the cover 696 and the envelope 686. Another fastener 721, such as a portion of a strip of hook-and-loop material, may be disposed on the inward-facing surface 727 of the extension panel 720 approximate the bottom edge (and, in some embodiments, approximate or abutting the connecting flap 724); the fastener 721 attaches to the mating fastener on the harness as described above.

Figure 33:
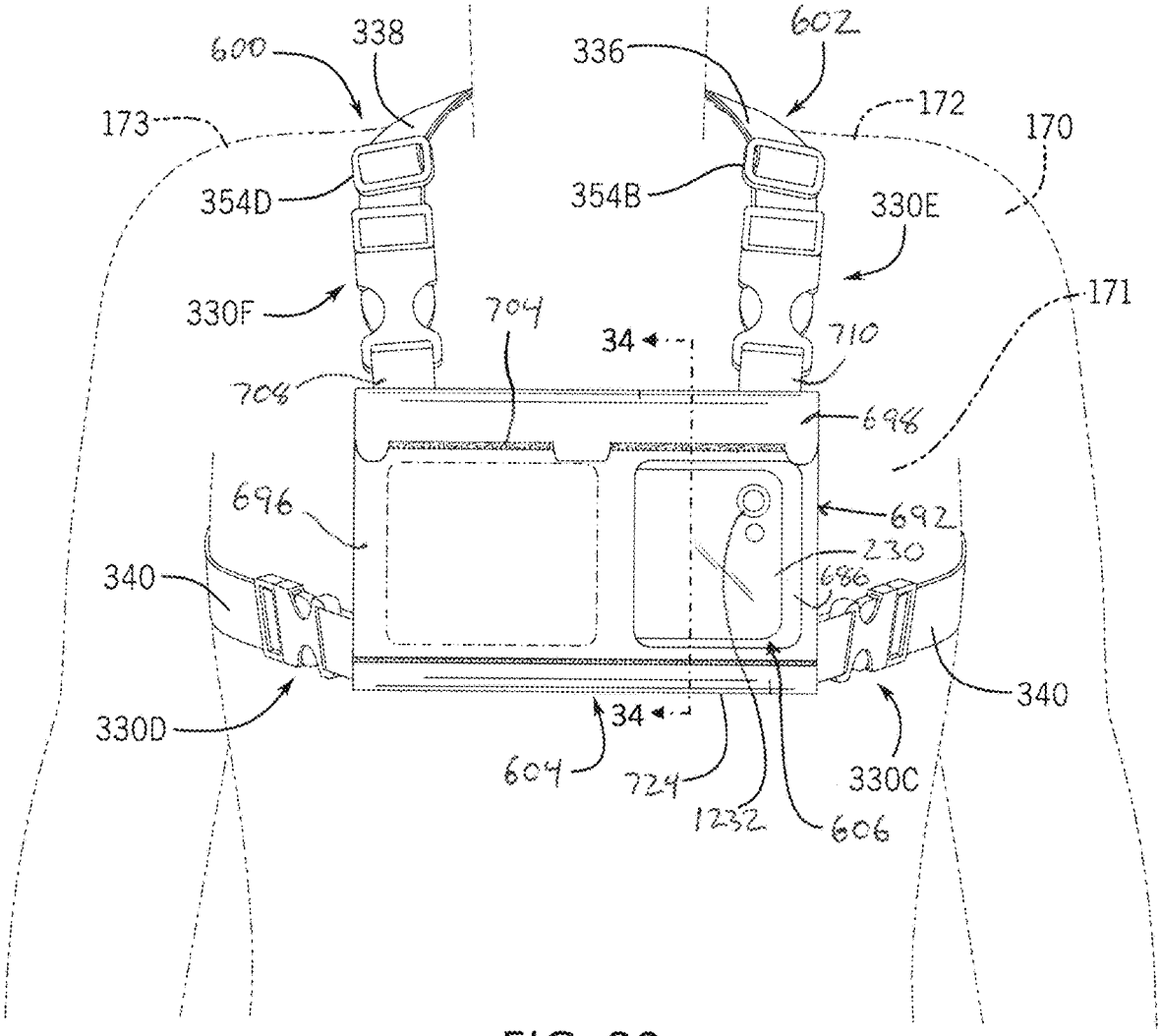
FIG. 33 is a front view of the pack assembly of FIG. 27 being worn in the closed position.
Figure 34:
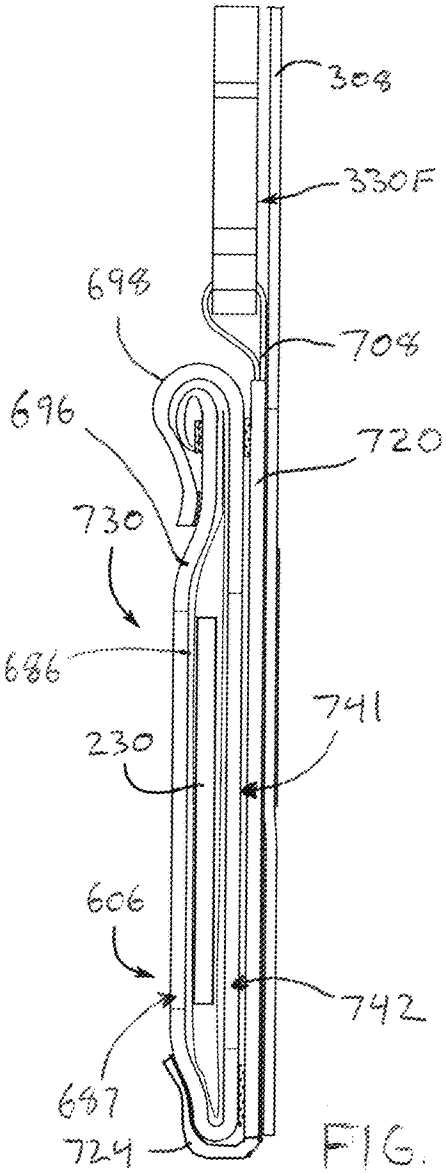
FIG. 34 is a partial section view of the pack assembly taken on line 34-34 of FIG. 33.
Figure 36:
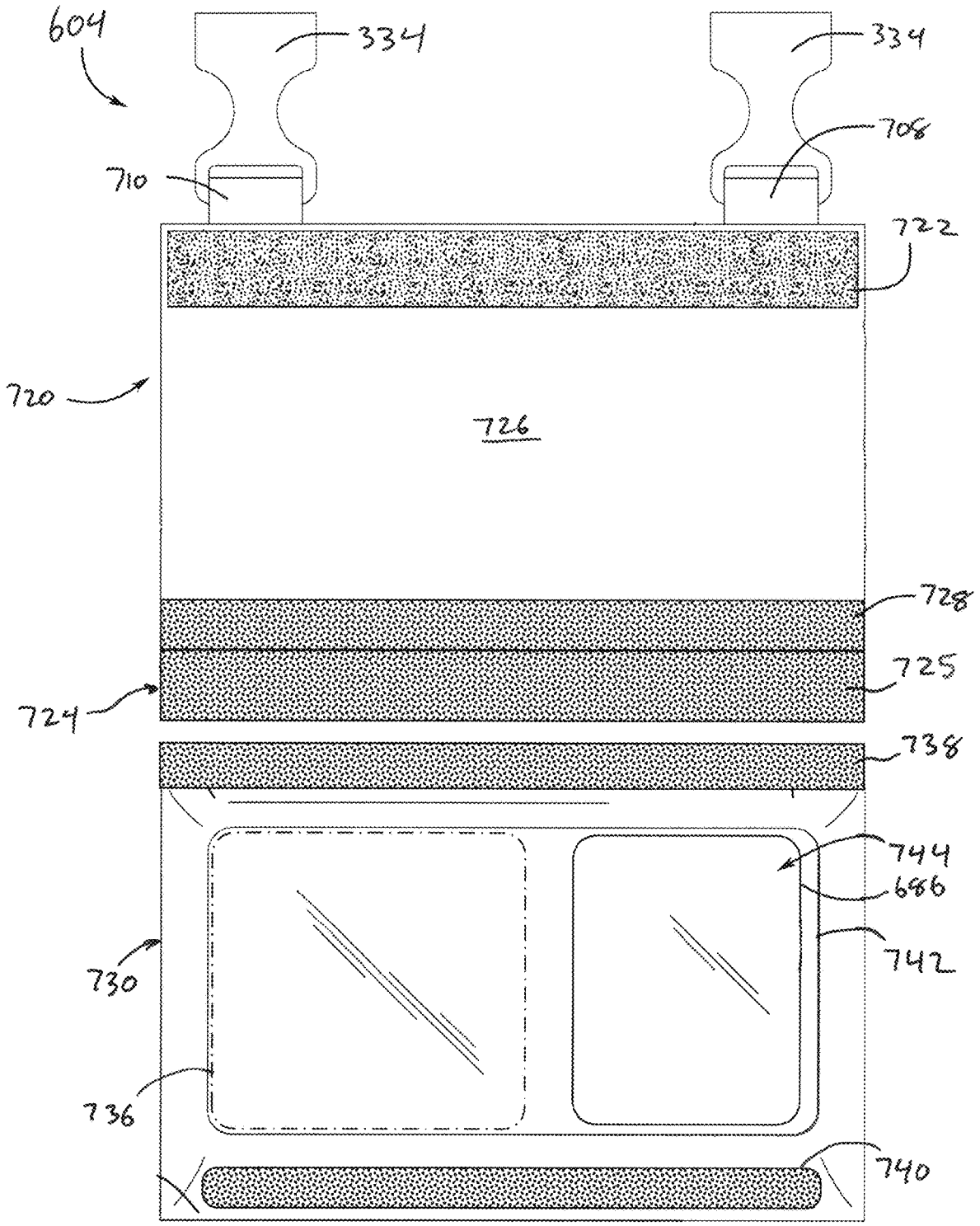
FIG. 36 is a front view of the pack of FIG. 31, shown with an envelope platform of the pack detached from an extension panel of the pack.
Figure 37:
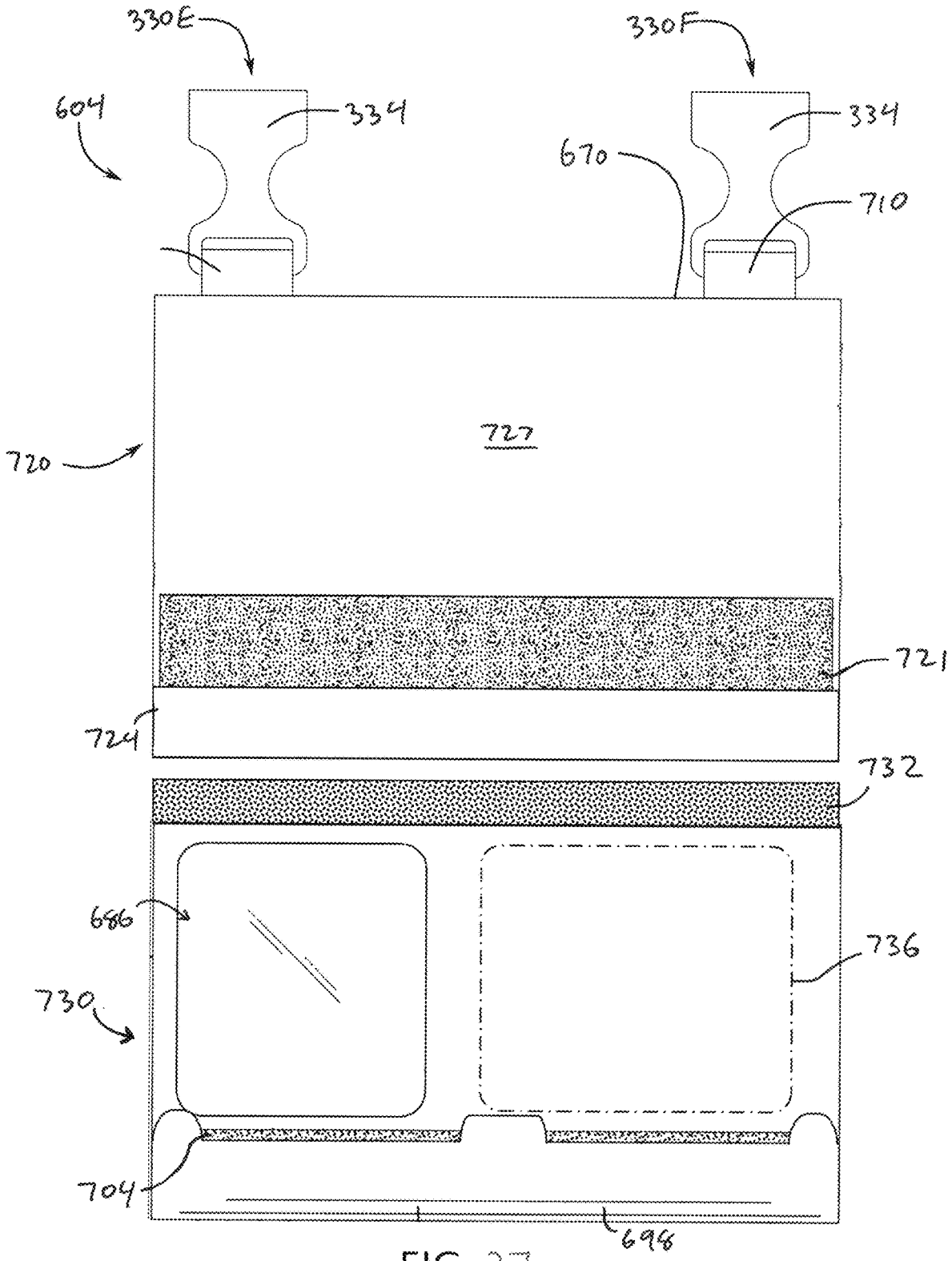
FIG. 37 is a rear view of the pack of FIG. 31 as shown in FIG. 36.

FIG. 33 illustrates the wearable pack assembly 600 described above as worn on the torso of a wearer, with the pack 604 attached to the harness 602 and the mobile device 230 secured within the envelope 686 with the front-facing camera 1232 oriented outward to secure images and/or video through the first window 606. Reference numerals for similar or identical components to those shown in FIG. 22 are again used here, with reference to the description above. FIG. 34 provides a cross-sectional view of the relative positioning of the base 308, extension panel 720, and envelope platform 730 containing the mobile device 230 and secured in the closed position as illustrated in FIG. 33. FIG. 35 demonstrates an example usage of the pack assembly 600 while it is being worn: the wearer can detach the extension panel 720 from the base 308 (e.g., by separating the extension panel 720 from the fastener 626), and can detach the top of the envelope platform 730 from the extension panel 720 (e.g., by separating fastener 740 from fastener 722); the pack 604 folds out as shown, and is retained and supported by the buckles 330E,F and by the wearer's left hand; the wearer can use the right hand to interact with the touchscreen 231 through the second window (i.e., the portion of the envelope 686 exposed by the aperture 742). From this orientation, the wearer can return the pack 604 to the closed position (i.e., by reengaging the fasteners 626, 722, 740), or separate the envelope platform 730 from the extension panel 720, and/or separate the pack 604 from the harness 602 by disengaging the buckles 330E,F. FIGS. 36-37 illustrate a complete disengagement of the pack 604, whereby all of the pack's fasteners 721, 722, 725, 732, 738, 740 for attaching the platforms 720, 730 to each other and to the harness 602 (including fastener 725 disposed on the connecting strap 724) are shown.

Figure 38A:
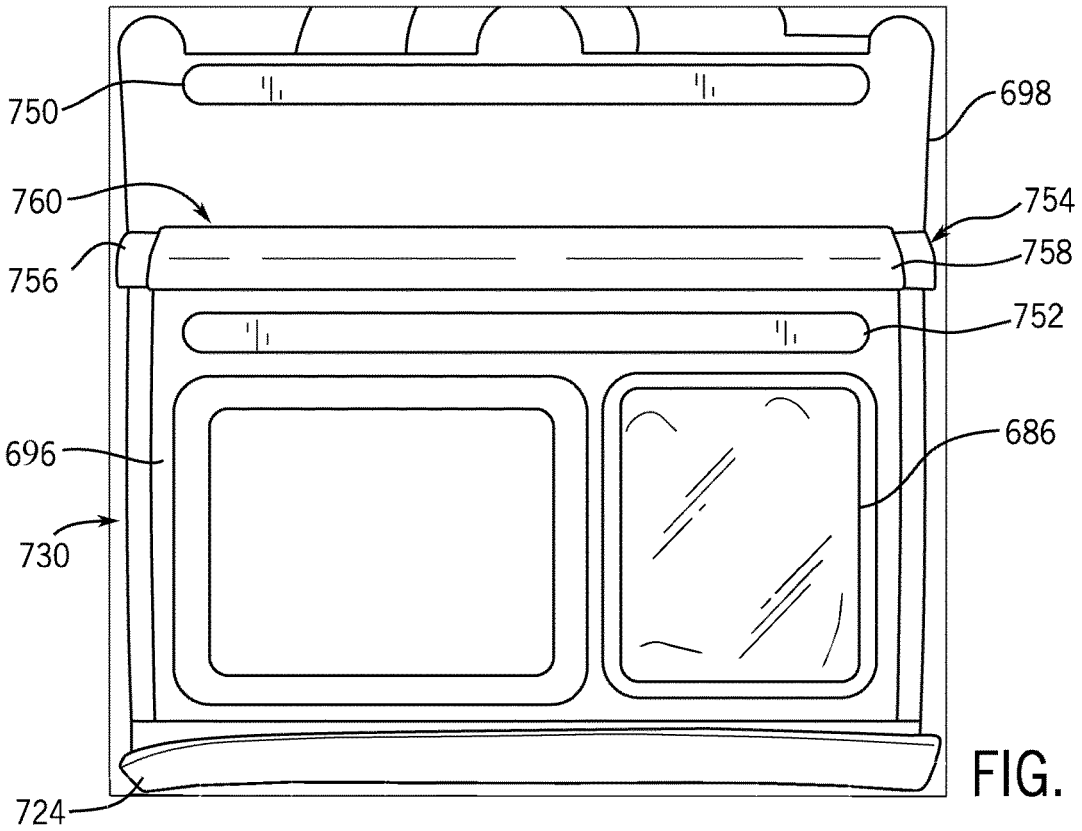
FIG. 38A is a front view of the pack of FIG. 31 with a flap of the envelope platform open to reveal a top portion of a device envelope in a secured position.
Figure 38B:
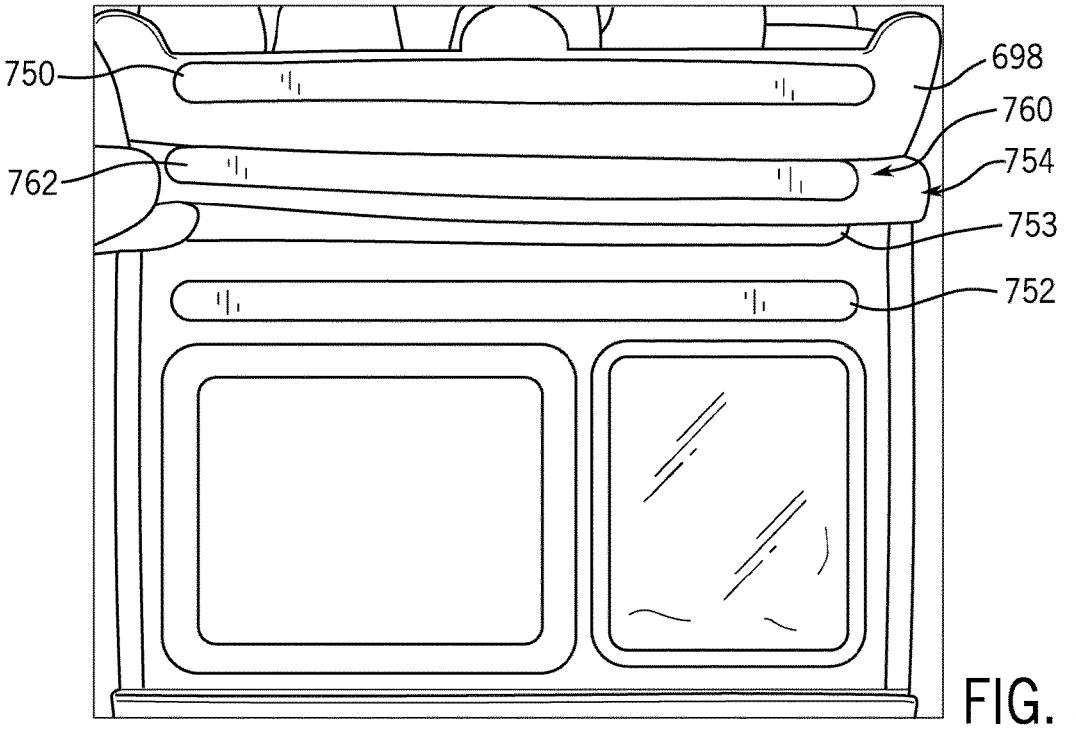
FIG. 38B is a front view of the pack of FIG. 31 as in FIG. 38A, with the top portion of the envelope unsecured by the wearer.
Figure 38C:
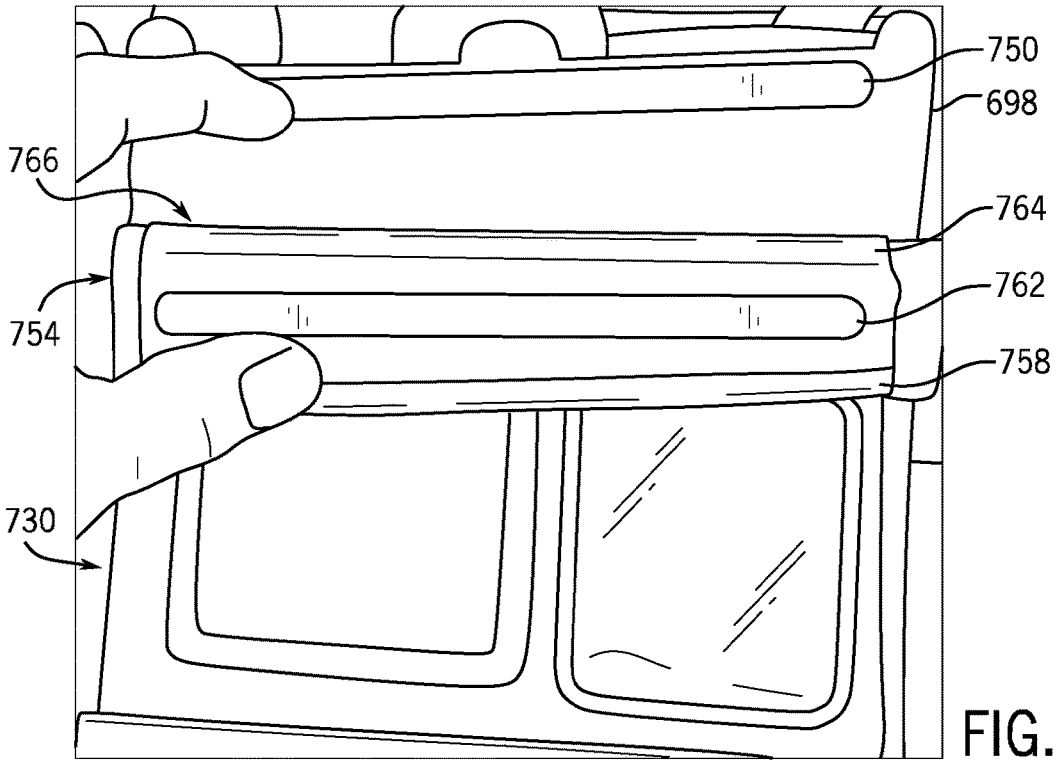
FIG. 38C is a front view of the pack of FIG. 31 as in FIG. 38A, with the top portion of the envelope unrolled by the wearer, revealing a pair of seals of the envelope.
Figure 38D:
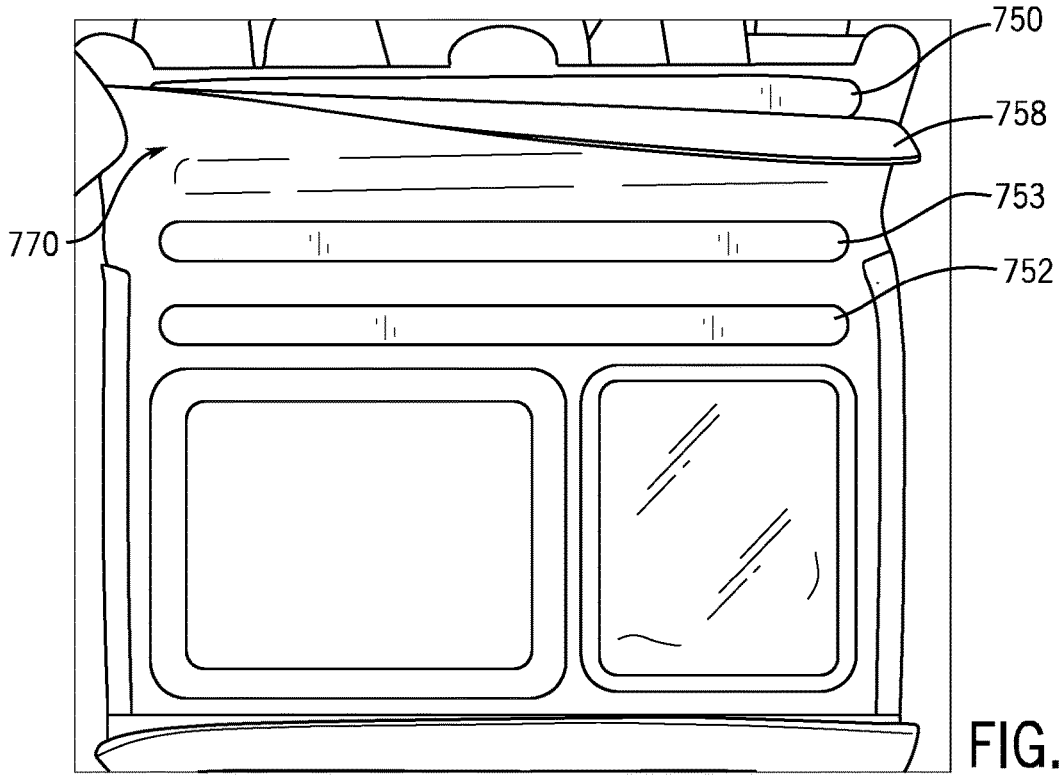
FIG. 38D is a front view of the pack of FIG. 31 as in FIG. 38A, with the top portion of the envelope being secured by the wearer in an extended position so envelope can be opened to insert or remove the mobile device.

FIGS. 38A-D illustrate an example embodiment of a pocket inlet for gaining access to, and sealing, the envelope 686. Referring to FIG. 38A, flap 698 may be opened by pulling the tab(s) 734 to separate cooperating fasteners 750, 752 securing the flap 698 over a top portion 754 of the pocket, comprising a portion 756 of the cover 696 attached to a portion 760 of the envelope 686. The top portion 754 may be rolled or folded over itself to fit under the flap 698. Referring to FIG. 38B the top portion 754 may be secured in its rolled or folded state by attaching together mating fasteners 753 (on the portion 756 cover 696), 762 (on the top portion 760 of the envelope 686) that can only interface when the top portion 754 is correctly folded/rolled. In some embodiments, as shown in FIG. 38C, the top portion 760 of the envelope 686 may comprise at least one, and preferably two seals 758, 764 comprising interlocking portions opposed on the inner surfaces of the envelope. The fastener 762 on the top portion 754 of the pocket may be disposed between the seals 758, 764, so that the seals 758, 764 are folded over each other when the top portion 754 is secured in the folded or rolled state. As shown in FIG. 38D, completely unfolding the top portion 754 may expose an outer surface 770 of the portion 756 of the cover 696; the seals 758, 764 may then be disengaged to open the pocket as shown in FIG. 19 and insert or remove the mobile device.

FIGS. 39-40 illustrate an embodiment of the presently described pack assembly 450 worn on the leg, instead of on the torso. An example harness 452 of the pack assembly 450 is described above with respect to FIGS. 25 and 26; while the illustrated example demonstrates use of the pack 304 of FIG. 13 on the harness 452, any of the above-described example embodiments of a pack (e.g., pack 604 of FIG. 27) can be mounted to the harness 452 or another harness adapted for securing to the leg so as to juxtapose a camera of the mobile device with the corresponding pack's windowed pocket to enable the viewing and the touching of the touchscreen and the taking of pictures and video with the camera as described above. Additionally, while harness 452 is shown attached to side of left leg of wearer 170 in FIGS. 39-40, harness 452 can alternately be attached to front of left leg of wearer 170, side of right leg of wearer 170, or front of right leg of wearer 170. Accordingly, left and right upper straps 474, 476, though described as "left" and "right," may instead be considered first and second upper straps, front and rear upper straps, or right and left upper straps when the harness 452 is positioned in certain orientations relative to wearer 170.

With respect to the illustrated example, outer side 460 of base 454 is positioned against leg 177 of human wearer 170.

For example, outer side 460 of base 454 can be positioned against side of upper leg (or thigh) 177 of human wearer 170. Hook members 482 (specifically, clip portions 490 of hook members 482) are attached to belt 178 or pants of human wearer 170 (e.g., along side of hip or waist of wearer 170). Left upper strap 474 extends upward along leg 177 of wearer 170 from base 454 to ring 480A, which is releasably coupled to clasp 488 of hook member 482A. Right upper strap 476 extends upward along leg 177 of wearer 170 from base 454 to ring 480B, which is releasably coupled to clasp 488 hook member 482B. Leg strap 478 extends around leg 177 of wearer 170. Male and female buckle members 332 and 334 of at least one respective buckle 330 can be selectively de-united and united to enable wearer 170 to put on harness 452. Lengths of straps 474-478 can be length-adjusted as needed (e.g., via strap adjusters 354) in order to fit harness 452 snugly/closely to wearer 170, especially on the outside of the wearer's garment(s).

Accordingly, pack 304 is configured or otherwise adapted to be coupled to, and carried by, harness 452. For example, base 454 of harness 452 may be considered in an open position in FIG. 25 when pack 304 (not shown in FIG. 25) is detached from inner side 458 of base 454 and when fastener elements 472 are detached from complemental fastener elements 328 of pack 304. To attach pack 304 to base 454 from the open position of base 454, inner side 366 of pack 304 is superimposed atop inner side 458 of base 454 so as to juxtapose first end edge 372 of pack 304 with first end edge 464 of base 454, so as to juxtapose second end edge 374 of pack 304 with second end edge 466 of base 454, so as to juxtapose first side edge 376 of pack 304 with first side edge 468 of base 454, and so as to juxtapose second side edge 378 of pack 304 with second side edge 470 of base 454. After so positioning pack 304 on base 454, in which base 454 and pack 304 are axially aligned, base 454 and pack 304 are pressed together to engage fastener elements 472, 328 and to releasably couple pack 304 to base 454. Hook and loop fastener 472 can span the entire, or substantially the entire, inner side 458 of base 454, for example, to more firmly attach pack 304 to base 454 (e.g., in comparison to fastener 326 on base 308 of FIGS. 13-24).

Additionally, to further attach pack 304 to harness 452, female buckle members 334 of buckles 330E, 330F, which are coupled to pack 304, are coupled releasably to male buckle member 332 of buckles 330E, 330F, which are coupled to left and right upper straps 474, 476 of strap assembly 456. More specifically, connecting strap 408 is attached to first end edge 372 proximate to first side edge 376 and is coupled to female buckle member 334 of buckle 330E. Male buckle member 332 of buckle 330E is coupled releasably to female buckle member 334 of buckle 330E, and left upper strap 474 extends upwardly from male buckle member 332 of buckle 330E, through strap adjuster 354I, toward ring 480A. Connecting strap 410 is attached to first end edge 372 proximate to second side edge 378 and is coupled to female buckle member 334 of buckle 330F. Male buckle member 332 of buckle 330F is coupled releasably to female buckle member 334 of buckle 330F, and right upper strap 476 extends upwardly from male buckle member 332 of buckle 330F, through strap adjuster 354K, toward ring 480B.

To detach pack 304 from harness 452, the foregoing pack installation method need only be reversed. Pack 304 can be so repeatedly attached and detached relative to harness 452. Furthermore, pack 304 can be independently attached and detached relative to base 454 or strap assembly 456. For example, pack 304 can be attached to harness 452 only via base 454, as described above. Alternately, pack 304 can be attached to harness 452 only via strap assembly 456. The latter attachment allows pack 304 to be moved relative to base 454, for example, to permit a wearer to view the windowed pocket 306 and interact with the touchscreen 231 of the mobile device 230 when harness 452 is worn by wearer 170, as shown in FIG. 40.

When mobile device 230 is inserted into windowed pocket 220 and pack 304 is coupled removably to harness 452 and door 392 is secured in its closed position in FIG. 39, pack assembly 450 is ready for use to employ mobile device 230 usefully as a body camera for taking still pictures and video with camera 232 for recording the wearer's interactions with the environment and others, according to the principle of the invention. Base 454 of harness 452 is configured to be positioned against the leg of the wearer for holding pack 304 beside leg of the wearer with windowed pocket 306 facing outwardly relative to the side of leg of the wearer. As described above, in some embodiments, base 454 of harness 452 can be configured to be positioned against leg 177 of wearer 170 for holding pack 304 in front of leg 177 of wearer 170 with windowed pocket 306 facing outwardly relative to the front of leg 177 of the wearer 170.

Inner side 458 of base 454 can be positioned against side of leg 177 of wearer 170, hook members 482 are attached to belt 178 or pants of wearer 170 (e.g., along side of hip or waist), left upper strap 474 extends upward along leg 177 of wearer 170 from base 454 to ring 480A, which is releasably coupled to hook member 482A, right upper strap 476 extends upward along leg 177 of wearer 170 from base 454 to ring 480B, which is releasably coupled to hook member 482B, and leg strap 478 extends around leg 177 of wearer 170 when harness 452 is worn by wearer 170. From this position, door 392 of pack 304 can be selectively opened to enable wearer 170 to view and touch touchscreen 231 and take pictures and video with camera 232 in the operation of mobile device 230 via sheet 387 of transparent material of windowed pocket 306 as a body camera for recording the wearer's interactions with the environment and others. Furthermore, door 392 partially covers windowed pocket 306 and protects mobile device 230 applied therein and uncovered portion 406 of windowed pocket 220 is juxtaposed with camera 232 for enabling the use of mobile device 230 as a body camera, namely, for the taking of pictures and video with camera 232 when door 392 is in the closed position, when the mobile device 230 is received in windowed pocket 306, and when touchscreen 231 and camera 232 are juxtaposed with windowed pocket 306. Thus, camera functionality of mobile device 230 is enabled when door 392 is in open and closed positions. Furthermore, while a first pack orientation is shown (e.g., similar to the first orientation shown in FIG. 21), the pack assembly 450 of some embodiments can include a pack 304 having a second pack orientation (e.g., similar to the second orientation shown in FIG. 21A). In another example, pack 604 of FIGS. 30-32 is attached to harness 452 instead of pack 304; the wearer can cause the front-facing camera of the mobile device to capture images and video through the outward-facing window, and can access and manipulate the rear-facing camera and the touchscreen of the mobile device through the inward-facing window, as illustrated and described above with respect to FIGS. 35 and 40.

Additionally, in some embodiments, pack assembly 450 can include one or more spacers configured to tip the pack 304 relative to leg 177 of wearer 170. Such spacers can be similar to spacers 412 described above with respect to FIGS. 24A-24C. For example, base 454 can include an engagement mechanism, such as a hook and loop fastener (not shown) on outer side 460 to engage spacers. In such embodiments, a spacer coupled to outer side 460 of base 454 of harness 452 can tip/tilt pack 304 downwardly relative to leg of wearer 170 for concurrently tipping mobile device 230 held by pack 304 downwardly relative to wearer 170 when mobile device 230 is inserted into windowed pocket 306. Alternatively, a spacer coupled to outer side 460 of base 454 of harness 452 can tip/tilt pack 304 upwardly relative to leg of wearer 170 for concurrently tipping mobile device 230 held by pack 304 upwardly relative to wearer 170 when mobile device 230 is inserted into windowed pocket 306.

In light of the above, embodiments of the invention provide a wearable pack assembly to be worn by a wearer. The pack assembly includes a harness with a base and a strap assembly configured to be strapped to the wearer (e.g., to the wearer's torso or leg). A pack is removably coupled to the base, and the pack includes a windowed pocket having an inlet for receiving a mobile device and is configured to enable viewing and touching of the touchscreen and taking of pictures and video with the camera from the windowed pocket. The pack also includes a door being movable between an open position away from the windowed pocket and a closed position at least partially covering the windowed pocket, where the door is configured to enable the camera to take pictures and video through the windowed pocket when the door is in either the open or closed position. In some embodiments, the harness can position the pack ahead of a chest of an upper torso of the wearer, with the windowed pocket facing outwardly relative to the chest of the upper torso of the wearer so that the camera of the mobile device can act as a body camera for recording the wearer's interactions with the environment and others (e.g., in front of the wearer). Thus, the assembly can be used by a wearer during outdoor or indoor activities where a front-facing body camera is wanted, such as skiing, running, hiking, or other activities, or during law enforcement activities. Additionally, the assembly can incorporate spacers to angle the pack and, thus, the field of view of the camera upward or downward. For example, and upward-facing field of view may be beneficial in activities where the wearer is leaning forward, such as biking, snowmobiling, or other activities. Furthermore, in some embodiments, the harness can position the pack beside or ahead of the leg of the wearer, with the windowed pocket facing outwardly relative to the leg of the wearer so that the camera of the mobile device can act as a body camera for recording the wearer's interactions with the environment and others (e.g., in front of the wearer or beside the wearer). For example, the assembly can be used by a wearer during outdoor or indoor activities where a body camera is wanted and the wearer's legs are turned, such as snowboarding or other activities.

The invention has been described above with reference to illustrative embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

What is claimed is:

1. A wearable pack assembly for a mobile device having a front surface, a touchscreen on the front surface, a rear surface opposite the front surface, and a first camera on the rear surface, the wearable pack assembly comprising:

a harness including a base; and a pack comprising:

an extension panel removably coupled to the base; and a windowed pocket coupled to the extension panel and having an inlet configured to receive the mobile device and to enable viewing and touching of the touchscreen and capture of digital photographs and video with the first camera from the windowed pocket;

wherein the harness positions the pack ahead of an upper torso of a wearer, the mobile device disposed within the windowed pocket with the first camera facing outwardly and the touchscreen facing inwardly relative to the upper torso of the wearer, when the harness is worn on the upper torso of the wearer.

2. The wearable pack assembly of claim 1, wherein the harness includes a strap assembly comprising a first shoulder strap and a second shoulder strap each coupled to the base, and the extension panel comprises a body and a first connecting strap and a second connecting strap each coupled to the body, the first connecting strap removably coupling to the first shoulder strap via a first buckle, and the second connecting strap removably coupling to the second shoulder strap via a second buckle.

3. The wearable pack assembly of claim 1, wherein:

the harness includes a strap assembly coupled to the base;

the extension panel couples to the strap assembly via a first set of mating fasteners disposed approximate a top edge of the extension panel;

the extension panel removably couples to the base via a second set of mating fasteners disposed approximate a bottom edge of the extension panel;

the windowed pocket couples to the extension panel via a third set of mating fasteners disposed approximate the bottom edge of the extension panel, and removably couples to the extension panel via a fourth set of mating fasteners disposed approximate the top edge of the extension panel; and the windowed pocket is rotatable around the third set of mating fasteners to provide the wearer access to the touchscreen by disengaging the fourth set of mating fasteners and swinging the windowed pocket away from the extension panel.

4. The wearable pack assembly of claim 3, wherein the extension panel is rotatable around the first set of mating fasteners to enable the wearer to bring the touchscreen approximate eye level of the wearer by disengaging the second set of mating fasteners and swinging the extension panel away from the base.

5. The wearable pack assembly of claim 1, wherein the pack further comprises an envelope platform coupled to the extension panel, the envelope platform comprising:

an envelope for containing the mobile device, the envelope formed of a material that is:

sufficiently transparent to enable capture of clear, unobstructed images by the first camera when the mobile device is in the envelope;

sufficiently waterproof to protect the mobile device from ingress of moisture when the mobile device is in the envelope; and sufficiently transmissive of capacitance to enable the wearer to operate the touchscreen with a finger when the mobile device is in the envelope; and a cover disposed at least partially over the envelope and cooperating with the envelope to form the windowed pocket, the cover comprising:

a first surface and a second surface, the envelope at least partially disposed between the first surface and the second surface;

a first aperture disposed through the first surface to partially expose the envelope and form a first window facing outwardly relative to the wearer such that the first camera captures images through the first window; and a second aperture disposed through the second surface to partially expose the envelope and form a second window facing inwardly relative to the wearer such that the touchscreen is accessible through the first window.

6. The wearable pack assembly of claim 5, wherein:

the inlet of the windowed pocket is formed by a top portion of the envelope, the top portion comprising a first seal and a second seal for closing the envelope, and the top portion being foldable into a folded position; and the envelope platform further comprises a flap extending from the second surface of the cover and removably attachable to the first surface of the cover, the flap covering the top portion of the envelope when the top portion is in the folded position and the flap is attached to the first surface of the cover.

7. The wearable pack assembly of claim 1, wherein the windowed pocket comprises a first window and a second window, and the pack is rotatable, with respect to the base, between:

a closed position, in which the-first window faces outward, relative to the wearer, and the first camera captures images through the first window, and the touchscreen is aligned with the second window facing inward, relative to the wearer, and is not visible to the wearer; and an open position, in which the touchscreen is viewable and can be touched by the wearer through the second window.

8. The wearable pack assembly of claim 7, wherein the pack includes a flap configured to secure the windowed pocket to the extension panel when the pack is in the closed position.

9. The wearable pack assembly of claim 8, wherein:

the inlet is formed by a top portion comprising a first seal and a second seal for closing the inlet, and the top portion being foldable into a folded position; and the flap covers the top portion in the folded position when the pack is in the closed position.

10. The wearable pack assembly of claim 1, further comprising a wedge-shaped spacer having an angled side configured to be coupled to an outer side of the base so as to tip the pack upward or downward when the pack is coupled to an inner side of the base.

11. The wearable pack assembly of claim 1, wherein the harness is configured to be worn on an upper torso of the wearer.

12. The wearable pack assembly of claim 1, further comprising a strap assembly coupled to the base.

13. The wearable pack assembly of claim 12, wherein the strap assembly includes a left shoulder strap configured to extend over the wearer's left shoulder, and a right shoulder strap configured to extend over the wearer's right shoulder, and wherein the extension panel removably couples to the left shoulder strap via a first buckle and to the right shoulder strap via a second buckle.

14. The wearable pack assembly of claim 13, wherein the extension panel further removably couples to the base, and is rotatable around an attachment point on the shoulder straps when the first and second buckles are engaged and the extension panel is decoupled from the base.

15. The wearable pack assembly of claim 1, further comprising a cover disposed at least partially over the windowed pocket and comprising at least one aperture that exposes the windowed pocket to define a first window of the pack, wherein the extension panel is coupled to the cover at a bottom edge of the pack, and the cover is rotatable around the bottom edge between:

a closed position, in which the first window aligns with the first camera facing outward relative to the wearer, and a second window of the pack aligns with the touchscreen facing inward relative to the wearer, and the second window abuts the extension panel; and an open position, in which the touchscreen is viewable and can be touched by the wearer through the second window.

16. The wearable pack assembly of claim 15, wherein the extension panel is removably coupled to the cover at the bottom edge of the pack via at least a first set of mating fasteners, and the extension panel is removably coupled to the cover approximate a top edge of the extension panel via a second set of mating fasteners, the cover being rotatable around the bottom edge of the pack when the first set of mating fasteners is engaged and the second set of mating fasteners is disengaged.

17. The wearable pack assembly of claim 16, wherein the extension panel removably couples to the base, and is rotatable around an attachment point on the strap assembly when the extension panel is coupled to the strap assembly and decoupled from the base, the pack having an extended position in which the extension panel is coupled to the strap assembly and decoupled from the base, the first set of mating fasteners is engaged, and the second set of mating fasteners is disengaged, the wearer swinging the extension panel away from the base and swinging the cover away from the extension panel to view the touchscreen through the second window.

* * * * *